US006928864B1

(12) United States Patent
Henry et al.

(10) Patent No.: US 6,928,864 B1
(45) Date of Patent: Aug. 16, 2005

(54) TOOL ASSEMBLY AND MONITORING APPLICATIONS USING SAME

(75) Inventors: Kent D. Henry, Laramie, WY (US); Zachary A. Gray, Laramie, WY (US); Mark A. Watson, Laramie, WY (US); Stanley B. Smith, Laramie, WY (US); Korey L. Kreitman, Laramie, WY (US)

(73) Assignee: In-Situ, Inc., Fort Collins, CO (US)

( * ) Notice: Subject to any disclaimer, the term of this patent is extended or adjusted under 35 U.S.C. 154(b) by 307 days.

(21) Appl. No.: 09/672,660

(22) Filed: Sep. 28, 2000

Related U.S. Application Data

(60) Provisional application No. 60/156,913, filed on Sep. 30, 1999.

(51) Int. Cl.[7] ..... E21B 49/00

(52) U.S. Cl. ..... 73/152.54; 73/53.01; 73/152.05; 73/152.29; 73/863.01; 166/54.1; 175/40; 210/170; 701/220

(58) Field of Search ..... 73/152.54, 53.01, 73/152.05, 152.29, 863.01; 166/54.1; 175/40; 210/170; 701/220

(56) References Cited

U.S. PATENT DOCUMENTS

| | | | | |
|---|---|---|---|---|
| 3,518,530 A | | 6/1970 | Wilson | |
| 4,620,189 A | | 10/1986 | Farque | 340/856 |
| 4,624,309 A | | 11/1986 | Schnatzmeyer | 166/66 |
| 4,717,473 A | * | 1/1988 | Burge et al. | 210/170 |
| 5,099,920 A | | 3/1992 | Warburton et al. | 166/250 |
| 5,166,910 A | | 11/1992 | Batzle et al. | 367/191 |
| 5,217,595 A | | 6/1993 | Smith et al. | 204/412 |
| 5,224,389 A | * | 7/1993 | Jensen et al. | 73/863.01 |
| 5,254,235 A | | 10/1993 | Wu | 204/284 |
| 5,259,452 A | | 11/1993 | Wittrisch | 166/250 |
| 5,264,368 A | * | 11/1993 | Clarke et al. | 436/3 |
| 5,293,931 A | * | 3/1994 | Nichols et al. | 166/54.1 |
| 5,432,709 A | * | 7/1995 | Vollweiler et al. | 702/32 |
| 5,515,236 A | | 5/1996 | Nolan et al. | 361/652 |
| 5,553,492 A | * | 9/1996 | Barrett et al. | 73/152.29 |
| 5,560,437 A | * | 10/1996 | Dickel et al. | 175/40 |
| 5,784,004 A | | 7/1998 | Esfahani et al. | 340/854 |
| 5,820,416 A | | 10/1998 | Carmichael | 439/668 |
| 5,821,405 A | | 10/1998 | Dickey et al. | 73/53.01 |
| 5,957,200 A | | 9/1999 | Majek et al. | 166/250.15 |
| 5,957,717 A | | 9/1999 | Monsef et al. | |
| 5,959,547 A | | 9/1999 | Tubel et al. | |
| 5,995,020 A | | 11/1999 | Owens et al. | 340/854.9 |
| 6,021,664 A | * | 2/2000 | Granato et al. | 73/53.01 |
| 6,061,000 A | | 5/2000 | Edwards | 340/854 |
| 6,331,117 B1 | | 12/2001 | Brundage | |
| 6,612,848 B1 | | 9/2003 | Brundage | |

FOREIGN PATENT DOCUMENTS

| | | |
|---|---|---|
| WO | WO 94/18722 A1 | 8/1994 |
| WO | WO 97/44947 A1 | 11/1997 |

* cited by examiner

*Primary Examiner*—Hezron Williams
*Assistant Examiner*—André K. Jackson
(74) *Attorney, Agent, or Firm*—Robert G. Crouch; Kenneth J. Johnson; Marsh Fischmann & Breyfogle LLP

(57) ABSTRACT

The present invention provides a tool assembly for use in field applications to monitor at least one condition in a well or other hole. The tool assembly may include a computing unit for directing operation of the tool assembly and may be sized to be operable in a hole having a diameter of 1 inch, and in some cases even smaller. In one aspect, the tool assembly is designed to significantly conserve power. Sensor readings may be taken at different schedules to conserve power when frequent readings are not required. Also, internal electronics of the tool assembly can be operated at a low voltage. In one aspect, the tool assembly is assemblable by simple rotatable engagement of the components, with electrical interconnections being made automatically by the rotatable engagement without keying of components. In another aspect, the tool assembly is networkable with other like tool assemblies and monitorable from a central location. In yet another embodiment, the tool assembly may include a tool bundle with a plurality of different sensor capabilities useful as a multi-parameter probe when tool diameter is not a big concern.

8 Claims, 30 Drawing Sheets

TOOL ASSEMBLY AND MONITORING APPLICATIONS USING SAME

RELATED APPLICATIONS

This patent application relates to U.S. provisional patent application Ser. No. 60/156,913 filed on Sep. 30, 1999.

FIELD OF THE INVENTION

The present invention involves a tool assembly and components from which the tool assembly is assemblable, which are typically of an elongated tubular shape adapted for insertion into wells for field monitoring of conditions in the wells; and in particular a rotatably engageable connector to couple and electrically interconnect components, data collection, processing and storage functions, networkability and adaptation for use in very small holes.

BACKGROUND OF THE INVENTION

An ever increasing emphasis is being placed on systematic monitoring of environmental conditions in relation to ground and surface water resources. Examples of some situations when monitoring of conditions of a water resource may be desired include environmental monitoring of aquifers at an industrial site to detect possible contamination of the aquifer, monitoring the flow of storm water runoff and storm water runoff drainage patterns to determine effects on surface water resources, monitoring the flow or other conditions of water in a watershed from which a municipal water supply is obtained, monitoring lake, stream or reservoir levels, and monitoring ocean tidal movements.

These applications often involve taking data over an extended time and often over large geographic areas. For many applications, data is collected inside of wells or other holes in the ground. A common technique is to drill, or otherwise excavate, a number of monitoring wells and to insert down-hole monitoring tools into the wells to monitor some condition of water in the wells. Although such monitoring wells are sometimes very deep, they are more often relatively shallow. For example, a significant percentage of monitoring wells are less than 50 feet deep. The cost of drilling monitoring wells, even when relatively shallow, is significant, especially given that a large number of wells is often required. The down-hole monitoring tools also represent a significant cost.

One way to reduce costs is to use smaller diameter monitoring wells, because smaller diameter holes are less expensive to drill. One problem with smaller diameter holes, however, is that there is a lack of tools, and especially high performance tools, that are operable in the holes. For example, only tools with very limited capabilities are available for use in 1 inch diameter holes. There is a need for high performance tools for use in such small diameter holes.

One reason for the high cost of monitoring tools is that they use expensive components and designs that frequently require significant amounts of expensive machining. The tools often require the assembly of components to form a tool assembly for insertion into the monitoring wells, and significant manufacturing expense is often required to provide structures for coupling the components and for electrically interconnecting the components. These problems become even more pronounced when trying to provide a tool at reasonable cost for use in a small diameter monitoring well. Furthermore, assembly and disassembly of components of the down-hole tools frequently require the use of wrenches or other tools, and sometimes special tools. This complicates use of the down-hole monitoring tools, and providing features on the down-hole tools to accommodate tools required for assembly and disassembly often requires machining, which significantly adds to manufacturing costs. Furthermore, electrical interconnections between components typically require special keying of the components, or of the electrical connectors between the components, which result in difficulty of use and a possibility for tool damage or malfunction due to misalignment. There is a significant need for new designs for coupling and electrically interconnecting components to permit easier assembly of down-hole monitoring tools without the need for complex structures that are difficult to manufacture.

In addition to the high cost of monitoring wells and down-hole monitoring tools, a significant amount of ongoing labor is typically required to maintain the tools and to obtain and use data collected by the tools. For example, it is frequently necessary to have someone visit the monitoring wells at periodic intervals to make sure that the tools are still working and to obtain data collected by the tools. The data must then be analyzed for use. The frequency between visits to a well may be a function of a number of variables, such as the reliability of the tools, the frequency with which batteries need to be replaced, and the capacity of the tools to collect and store data. Moreover, many down-hole tools are difficult to service and must be returned to manufacturers or distributors for even relatively simple service tasks, such as changing batteries in the tool. There is a significant need for tools that require less attention and that are easier to service.

Many of the available down-hole monitoring tools also lack significant flexibility in the way they can be used. For example, many tool designs are not designed for remote communication, for networkability or for being powered by the variety of different power sources that may be suitable for different field applications. There is a need for down-hole monitoring tools having greater flexibility.

SUMMARY OF THE INVENTION

One object of the present invention is to provide a high performance tool assembly, and components thereof, operable for field applications to monitor at least one condition in a well or other hole having a diameter of 1 inch or smaller.

Another object is to provide a tool assembly, and components thereof, operable for field applications to monitor at least one condition in a well or other hole and with a high capacity for logging data prior to requiring servicing of the tool assembly and components. A related object is to provide such a tool assembly, and components thereof, operable to log data with low power consumption to prolong operation of the tool on battery power prior to requiring a change of batteries. Another related object is to provide such a tool assembly, and components thereof, operable in a manner to conserve computer memory during data logging operations.

Another object of the invention is to provide a tool assembly, and components thereof, operable for field applications to monitor at least one condition in a well or other hole and which is easy to use and service. Related objects are to provide such a tool assembly, and components thereof, in which field assembly and disassembly of the tool assembly is accomplishable without the use of tools and in a manner so that batteries are easy to access for replacement.

Still another object of the invention is to provide a tool assembly, and components thereof, operable for field applications to monitor at least one condition in a well or other hole and being easily networkable in a network controllable by at least one of the tool assemblies. A related object is to provide a network of such tool assemblies and a method for using the network to perform field monitoring applications.

These and other objects are addressed by various aspects of the present invention as described and claimed herein.

In one aspect, the present invention provides a tool assembly, and components thereof, adapted for insertion into a small diameter well or other hole to provide high performance monitoring of at least one condition in the well or other hole. At least one component of the tool assembly includes a computing unit including a processor and memory having stored therein instructions readable and executable by the processor to direct at least one operation, and preferably substantially all operations, of the tool assembly, including direction of obtainment of sensor readings from a sensor in the tool assembly. In a preferred embodiment, the tool assembly and its components are adapted for use in monitoring wells and other holes having a hole diameter of 1 inch, and in some cases even smaller. The tool assembly, and components thereof, typically have a substantially tubular shape of a substantially constant outside diameter of smaller than about 1 inch, and preferably even smaller. In general, even when the component or the tool assembly has other than a tubular shape of constant outside diameter, a cross-section of the tool assembly, and of each of the components, taken substantially perpendicular to a longitudinal axis at any longitudinal location along the tool assembly/component, fits entirely inside a circle having diameter of smaller than about 1 inch. In preferred embodiments, the component cross-section fits inside an even smaller circle, with a circle of smaller than about 0.75 inch being particularly preferred. In one embodiment, the tool assembly is connectable with an external power source when deployed for operation. The ability to power the tool assembly with an external power source significantly enhances the flexibility of the tool and permits the tool to be deployed for longer periods and enhances utility of the tool assembly for network applications, providing significant advantages over existing monitoring tools designed for insertion into small diameter holes size. The connection to an external power source is made via dedicated conductors in a cable from which the tool assembly is suspended during use. In a preferred embodiment, the tool assembly has the flexibility to be connected with at least two different external power sources, including a higher voltage external power source that is stepped down for use by the tool assembly and a lower-voltage external power source that can be used directly by the tool assembly.

In another aspect, the computing unit is capable of directing that sensor readings be taken according to at least two different sampling schedules, each having a different time interval between sensor readings, with the computing unit being capable of directing a change from one sampling schedule to another sampling schedule based on determination by the computing unit of the occurrence of a predefined event. For example, the predefined event could be a predefined change between consecutive sensor readings, passage of a predefined period of time, or receipt of a predefined control signal from a remote device. In this way, sensor readings may be taken more frequently when the need occurs due to the occurrence of a transient event of interest. This situation might occur, for example, when the tool assembly is monitoring for the presence of storm runoff water. When a sensor reading indicates that storm runoff has commenced, the sampling frequency can be increased to provide more detailed information about the storm runoff event. By taking very frequent sensor readings only during the transient event of interest, significant power and memory space are conserved. Additional memory space can be conserved by not tagging each data record with a time tag, but only tagging an occasional data point to indicate a change to a new sampling schedule.

In another aspect of the present invention, the tool assembly, and the components thereof, permit sensor readings to be taken and sensor reading data to be logged with low power consumption. Signals are processed at a voltage of smaller than about 4 volts, and preferably a voltage of about 3 volts or smaller. The processor also operates at a compatibly low voltage. Furthermore, a number of factors are designed to conserve power during operation, thereby permitting longer operation prior to requiring battery replacement. Also, notwithstanding operation at the lower voltage, in one embodiment the tool assembly permits the flexibility to use a higher voltage external power source to supply power to operate the tool. In this embodiment, the higher voltage power is stepped down in the tool assembly. Optionally, the power may be stepped down in a manner to maintain separate groundings for the electronics of the tool assembly and for the higher voltage external power source. For some sensors, such as electrochemical sensors in direct contact with an aqueous liquid, maintaining separate groundings is important to prevent interference with operation of the sensor. In another embodiment, a lower voltage external power source may alternatively be used, providing for significant flexibility in the use of the tool assembly.

In another aspect of the invention, components of the tool assembly are assemblable and disassemblable without any keying required between components. In one configuration, components of the tool assembly are assemblable and disassemblable through rotatable engagement and rotatable disengagement, respectively, of the components in a manner not requiring the use of wrenches or other tools. Electrical interconnection of the components is automatically made through the simple rotatable engagement. Electrical interconnection is made through a multiple connector unit, which in one embodiment comprises a small elastomeric strip with a number of small, parallel conductive paths. The multiple connector unit is sandwiched between two sets of electrical leads, which each typically comprise conductive features on an insulating substrate, in a way to make isolated electrical interconnections between the two sets of electrical leads. The rotatable engagement feature significantly simplifies use of the tool assembly and also permits design of the tool assembly for easy access to batteries and other components for ease of servicing. In other configurations, electrical connections may be established between components through means other than rotatable connectors. The configuration would provide alignment between components along a common axis and exert a sufficient compressive force in order to maintain an electrical connection.

In yet another aspect of the invention, the tool assembly is networkable in a communications network with a number of other like tool assemblies. Interconnections may be established between the tool assemblies through use of one or more network junction boxes to which each of the tool assemblies is connectable. The networked tool assemblies may be configured as a monitoring system for monitoring one or more measurable conditions. The monitoring system may comprise a central controller, such as a personal computer or palm top computer, which is also connectable to the communications network and may be employed to perform various functions with regards to monitoring of the networked tool assemblies as well as providing an interface through which a system user may initiate various functions.

The central controller may be configured to interface with one or more different types of communications networks such that the lines of communication may be established with the tool assemblies. In one configuration of the invention, the communications network may comprise a programming cable which is directly connectable between a communications port on the central controller and one or more tool assemblies. The connection to the tool assembly may be made directly or through use of some sort of connection box.

Another configuration of the communications network may comprise the use of the public switch telephone network (PSTN). As such, the central controller is equipped with a modem such that an outgoing call may be placed, and the node on the communications network to which each of the tool assemblies is connected may further comprise a modem/controller, which also provides for establishing connections over the PSTN. When a telephonic connection is established between the central controller and modem/controller, messages may be exchanged between these components.

In yet another configuration of the communications network, radio transceivers may be in electrical connection with both the central controller and a remotely located network junction box which provides a further connection to each of the tool assemblies connected to the network. The transceivers provide for the conversion of electrical signals to radio signals such that lines of communications are established between the central controller and the various tool assemblies connected to the communications network.

As was discussed above, the central controller may be configured to include a number of processing modules which are employable to provide monitoring functions for the various tool assemblies. One module which may be included provides for the performance of various communications functions with regards to tool assemblies connected to the network such as identifying tool assemblies connected to the communications network, and which further provides for generating and addressing messages, which are sent from the central controller to the various tool assemblies. The communications module may further provide for the receipt of messages from the tool assembly and the performance of various functions with regards to confirming whether certain tool assemblies connected to the network have provided desired information.

Another processing module which may be included as part of the central controller relates performance of certain functions to view and amend parameters which one or more of the tool assemblies employ in performing monitoring functions. Through an interface such as an interactive screen display, parameter information may be viewed and/or amended. In the event that communications information has been amended, the communications module may then be employed for delivering the amended parameter information to the selected tool assembly.

Further included in the central controller may be a test processing module. This module may be employed to perform various functions with regards to the tests the tool assemblies perform. Functionality is provided as part of this testing module to view tests, which are currently loaded on a particular tool assembly. Interactive screen displays are also provided for creating new tests, amending existing tests or manually initiating existing tests. Various information, which may be entered via the test processing module, includes a schedule for performing automated testing. Information provided via the interactive screen display is converted by the communications module to a message, which is transmittable over the communications network to selected tool assemblies.

The test processing module may be further employed to extract information from a selected tool assembly. Particular tests may be selected for a tool assembly and messages generated which include the programming for the test. These message are then transmittable to the selected tool assembly. The tool processing module may be further employed for extracting data. Various display and/or outputs functionality is included in the central controller for displaying the extracted test data in a desired format.

As part of the operations of at the monitoring system described herein, at least one of the tool assemblies in the network is capable of transmitting a communication signal in the network to cause at least one other of the tool assemblies to perform a monitoring operation comprising obtainment of a sensor reading. In one embodiment, the communication signal is transmitted when the transmitting tool assembly determines that a predefined event has occurred. In one embodiment, the receiving tool assembly is directed to change its sampling schedule to a schedule with a shorter interval between sensor readings when more frequent sensor readings are desired due to an identified transient condition. In one embodiment, the transmitting tool assembly communicates directly with the receiving tool assembly. In another embodiment, a personal computer, palm top computer or other network controller may receive and process the transmitted signal and transmit a control signal to direct the receiving tool assembly to perform the desired operation. One example of when the tool assemblies may advantageously be deployed in a network is to monitor water availability in a municipal water supply system. For example, tool assemblies indicating pressure sensors can be located in different portions of the water supply network, such as various streams, rivers, aquifers, reservoirs, etc. that contribute to the water supply. Based on analysis of pressure readings provided by the various tool assemblies, the capacity of different portions of the water supply to provide water to satisfy a projected demand can be determined, and water can be supplied from different portions of the water supply system as appropriate. As another example, a network of the tool assemblies can be placed in monitoring wells surrounding a contaminated site, and pressure can be monitored to identify infiltration of water into the contaminated site and the characteristics of the infiltration and/or the infiltrating fluids. As yet another example, a network of the tool assemblies could be located in different injection and withdrawal wells of a solution mining operation, to monitor the quality of injected fluids and the quality of produced fluids, to monitor the overall performance of the operation.

These and other aspects of the present invention are discussed in greater detail below.

DETAILED DESCRIPTION

In one aspect, the present invention provides a tool assembly and components that are assemblable to make the tool assembly. The tool assembly, and each of the components from which the tool assembly is assemblable, are adapted for insertion into a well or other hole for the purpose of monitoring at least one condition present in the well or other hole. At least one component of the tool assembly includes a computing unit capable of directing at least one operation of the tool assembly, and preferably substantially all operations of the tool assembly, the computing unit includes a processor and memory having stored therein instructions readable and executable by the processor to direct operation of the tool assembly. The tool assembly also includes a sensor, which may be located in the same component with the computing unit or may be located in a different component. The sensor is capable of providing sensor readings to the computing unit, with each sensor reading including generation by the sensor of at least one sensor output signal, which includes sensor reading data, processable by the computing unit, corresponding to at least one monitored condition. The sensor may also be referred to as a transducer and a monitored condition may be referred to as a measurand.

The tool assembly also permits interconnection with a cable including a plurality of electrical conductors, or conductive lines, operably connectable with the computing unit and through which the tool assembly can communicate with a remote device and/or through which power can be supplied to the tool assembly from an external power source, such as to provide power to operate the computing unit.

Figure 1:
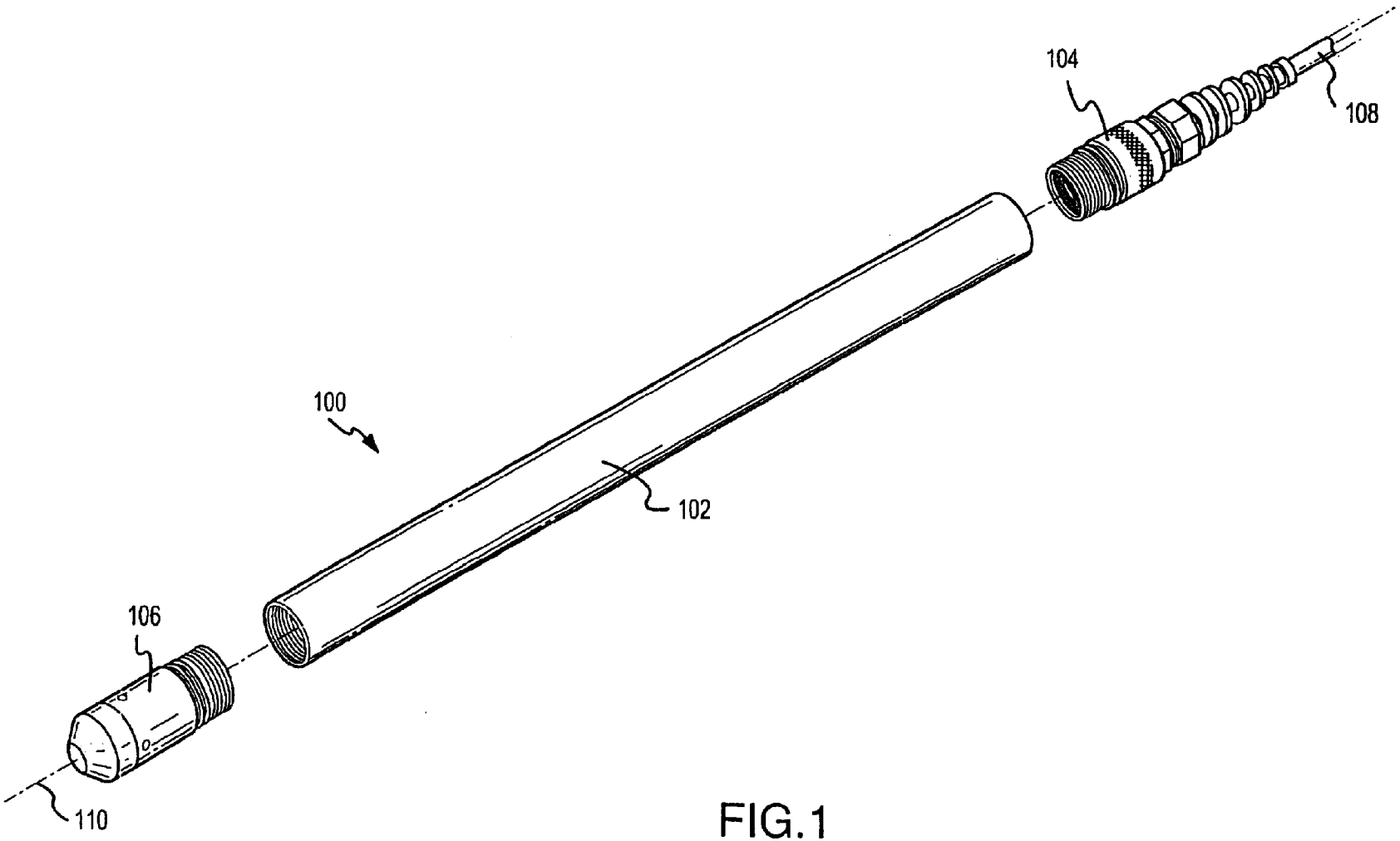
FIG. 1 is an exploded perspective view of one embodiment of a three-component tool assembly of the present invention showing.
Figure 2:
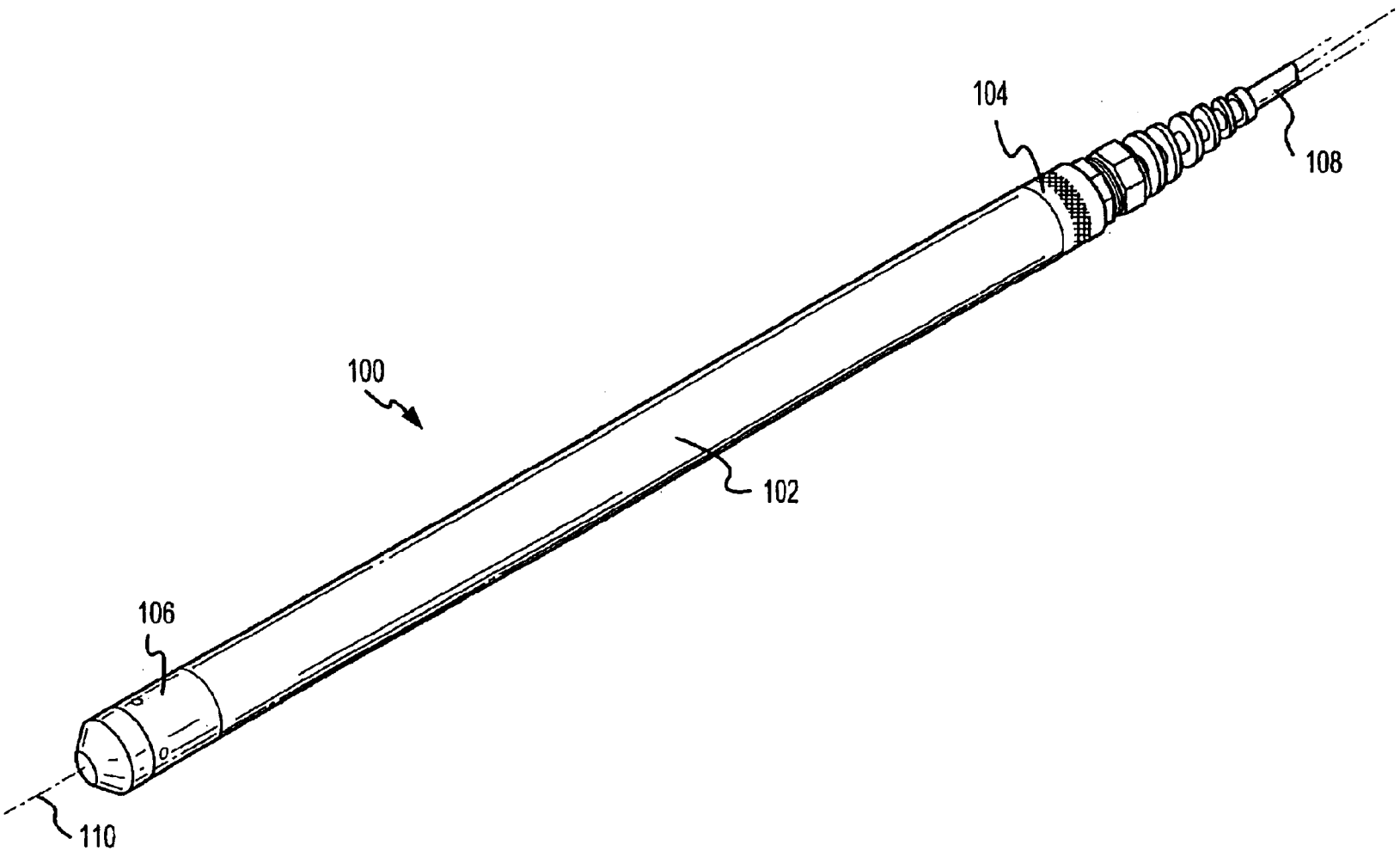
FIG. 2 is a perspective view showing the tool assembly of FIG. 1 fully assembled.

Referring now to FIGS. 1 and 2, one embodiment of the tool assembly including three components is shown. FIG. 1 shows a perspective view of a three-component tool assembly 100 exploded to show the three components that are assemblable to form the tool assembly 100. FIG. 2 shows a perspective view of the three-component tool assembly 100 as it appears when fully assembled.

With continued reference to FIGS. 1 and 2, the tool assembly 100 includes a control component 102, a cable component 104 and a sensor component 106. The tool assembly 100 has a generally elongated tubular shape adapted for insertion into a well or other hole, except that the ends of the tool assembly are beveled to reduce the potential for sharp edges to hang up inside of the well or other hole during use.

The control component 102 is engageable at one end with the cable component 104 and is engageable at the other end with the sensor component 106, to form the fully-assembled tool assembly 100. As shown in FIGS. 1 and 2, engagement of the control component 102 with each of the cable component 104 and the sensor component 106 is accomplished by rotatable engagement of complementary threaded structures present on the different components. Other engagement structures could be used, providing that the tool assembly 100 retains a shape suitable for insertion into a well or other hole. Threaded connections are preferred for simplicity of use and because threaded connections permit engagement of the components in a manner to achieve an exterior for the tool assembly 100 that has a smooth and regular tubular shape at locations where the components are engaged. Avoiding the presence of shape irregularities on the exterior surface of the tool assembly 100 is important to reduce the possibility of tool hang-up in a well and also to avoid higher manufacturing costs associated with machining that may be required to include special exterior surface features. To prevent improper component connections, it is preferred that the rotatable engagement to one end of the control component 102 is by right-hand threads and that rotatable engagement to the other end of control component 102 is by left-hand threads. Furthermore, the tool assembly 100 may be assembled by hand. No wrench or other tools are required for assembly or disassembly of the tool assembly 100 and, accordingly, no specially machined features are required to accommodate the use of such tools.

As seen best in FIG. 2, the tool assembly 100 has a generally tubular shape with a substantially circular cross-section of uniform diameter over substantially the entire length of the tool assembly 100. Such a tubular shape of substantially constant diameter is preferred, although other shapes could be used if desired for a particular application. Furthermore, although a circular cross-section of substantially uniform diameter is preferred, it is possible that one or more of the control component 102, the cable component 104 and the sensor component 106 may have a larger or smaller outside diameter than another component, if desired for a particular application. In the embodiment shown in FIGS. 1 and 2, the control component 102, the cable component 104 and the sensor component 106 are aligned in a longitudinal direction along a longitudinal axis 110.

In the three-component tool assembly 100, as shown in FIGS. 1 and 2, the control component 102 includes the computing unit (not shown), the sensor component 106 includes the sensor (not shown), and the cable component 104 includes the terminal end of a cable 108.

With continued reference to FIGS. 1 and 2 and also now to FIGS. 3–6, the details of the three-component tool assembly 100, as well as the control component 102, the cable component 104 and the sensor component 106, will be further described.

Figure 3:
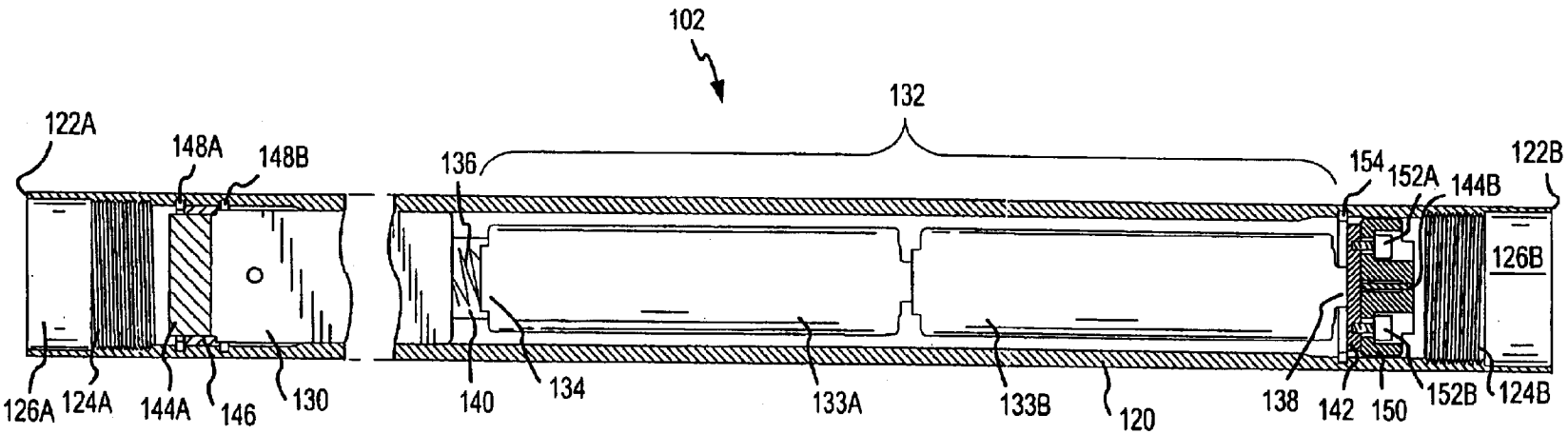
FIG. 3 is a sectional side view of one embodiment of a control component of the present invention.

FIG. 3 is a cross-section of the control component 102. With primary reference to FIG. 3, the control component 102 includes a substantially tubular housing 120. The housing 120 has two longitudinal ends 122A,B. Located adjacent each longitudinal end 122A,B is an engagement structure 124A,B, each of which includes a female threaded structure. The engagement structure 124A is capable of rotatably engaging a complementary male threaded engagement structure of the sensor component 106, and the engagement structure 124B is capable of rotatably engaging a complementary male threaded engagement structure of the cable component 104. By rotatable engagement, it is meant that complementary engagement structures are engageable through relative rotation of the complementary engagement structures, such as is the case with engagement of complementary threaded structures. Adjacent the engagement structures 124A,B are smooth surfaces 126A,B against which O-rings on the sensor component 106 or the cable component 104, as the case may be, can seal when the sensor component 106 or the cable component 104, as the case may be, is rotatably engaged with the control unit 102. Placement of the smooth surfaces 126A,B between the threaded structure and the respective longitudinal ends 124A,B provides a significant advantage in that when the tool assembly 100 is assembled, the threads are protected by O-ring seals. In this way, the threads are less susceptible to gum-up or to otherwise be damaged from conditions existing in a well.

With continued reference primarily to FIG. 3, disposed within the housing 120 is a main circuit board 130, which includes the computing unit and the main electronics for operation of the tool assembly 100. Also disposed within the housing 120, is an energy storage unit 132 for supplying power to the main circuit board 130. The energy storage unit 132 is an internal electrical power source to power the tool assembly 100. As discussed below, in a preferred embodiment, the tool assembly 100 may also be powered by an external electrical power source.

As shown in FIG. 3, a preferred embodiment for the energy storage unit 132 is a plurality (typically two) of electrochemical cells 133A,B connected in series. Type AA cells are preferred for the electrochemical cells 133A,B. Cells other than AA cells could be used, however, and the energy storage unit 132 could include only a single electrochemical cell, provided that the single cell delivers power at the desired voltage. Moreover, the electrochemical cells 133A,B may include any suitable active electrode materials. For example, the electrochemical cells 133A,B could be alkaline cells, nickel-cadmium cells, nickel-metal hydride cells or lithium cells. A first electrode 134 of the energy storage unit 132 is electronically interconnected with the main circuit board 130 via a spring contact 136. A second electrode 138 of the energy storage unit 132 is electronically interconnected with the main circuit board 130 via a flexible circuit unit 140. The flexible circuit unit 140 includes a contact end 142 that contacts the second electrode 138, and the flexible circuit unit 140 extends from the contact end 142 across the entire length of the energy storage unit 132 to electrically interconnect with the main circuit board 130, thereby completing a circuit for supplying power from the energy storage unit 132 to the main circuit board 130. It should be noted that although the control unit 102 has been described as including the energy storage unit 132, it is optional. If the energy storage unit 132 is not included, the housing 120 may be shortened and the flexible circuit unit 140 could be eliminated, or the flexible circuit unit 140 could still be included, but the contact end 142 would directly contact the spring contact 136. Furthermore, the main circuit board 130 preferably includes a diode or diodes through which current delivered to the main circuit board 130 from the energy storage unit 132 passes. The diode(s) provide protection to prevent current from flowing the wrong direction through the energy storage unit 132 and the flexible circuit unit 140. This protection is important, for example, should the electrochemical cells 133A,B be installed in reverse polarity or be absent altogether.

With continued reference primarily to FIG. 3, also disposed inside the housing 120 are multiple connector units 144A,B. A first multiple connector unit 144A is used to make electrical interconnections between the control component 102 and the sensor component 106 when the engagement structure 124A of the control component 102 is rotatably engaged with a complementary engagement structure of the sensor component 106. The first multiple connector unit 144A, therefore, serves as an interconnection interface in the control unit 102 for electrically interconnecting the control component 102 with the sensor component 106. A second multiple connector unit 144B is used to make electrical interconnections between the control component 102 and the cable component 104 when the engagement structure 124B of the control component 102 is rotatably engaged with a complementary engagement structure of the cable component 104. The second multiple connector unit 144B, therefore, serves as an interconnection interface in the control unit 102 for electrically interconnecting the control component 102 with the cable component 104. The first multiple connector unit 144A is retained by a first retainer 146, which is held in place within the housing 120 between two wire retaining rings 148A,B. The second multiple connector unit 144B is retained by a second retainer 150, which is connected to the contact end 142 of the flexible circuit unit 140 by two retaining screws 152A,B. A wire retaining ring 154 serves as a compression stop for the second retainer 150 when the engagement structure 124B of the control component 102 and the complementary engagement structure of the cable component 104 are rotatably engaged.

Figure 4:
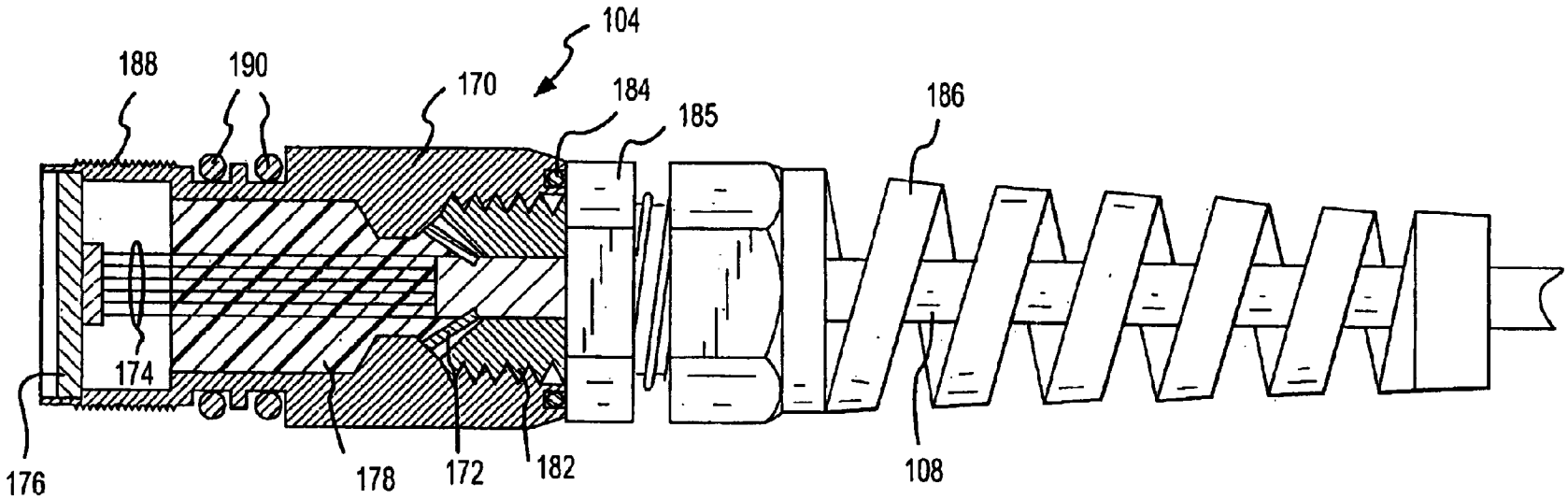
FIG. 4 is a side view, in partial cross section, of one embodiment of a cable component of the present invention.

FIG. 4 shows the cable component 104, with the portion of the cable component 104 in which the cable 108 terminates being shown in cross-section. The cable component 104 includes a tubular housing 170 in which a terminal end 172 of the cable 108 is located. Inside the housing 170, a plurality of electrical conductors 174 from the cable 108 connect to a printed circuit board 176, which serves as an interconnection interface within the cable component 104 for electrically interconnecting the cable component 104 with the control component 102. It is noted that, as used herein, the terms "circuit board" and "printed circuit board" refer to a structure including thin electrically conductive features (e.g., in the form of metallic films) supported on an insulting substrate, whether the conductive features are truly printed(e.g., by screen printing) or are formed in a different manner, such as by etching. For protective purposes, the cable conductors 174 are embedded in a protective mass of epoxy resin 178 located between the terminal end 172 of the cable 108 and the location where connection of the conductors 174 is made to the printed circuit board 176. The cable 108 is secured within the housing 170 by the use of a ferrule 172 compressed to the sheath of the cable 108 by a first threaded end of a compression ring 182. An O-ring 184 makes a seal with a nut portion 185 of the threaded compression ring 182. Attached to a second threaded end of the compression ring 182 is a cable protector 186 to protect the cable 108 from being excessively strained in the vicinity of the cable unit 104. The cable component 104 also includes an engagement structure 188, including a male threaded structure, capable of rotatably engaging the complementary threaded engagement structure 124B (shown in FIG. 3) of the control component 102, as previously discussed. The cable component 104 includes two O_rings 190 for sealing with the smooth surface 126B (shown in FIG. 3) of the control component 102 when the control component 102 and the cable component 1104 are rotatably engaged.

Figure 5:
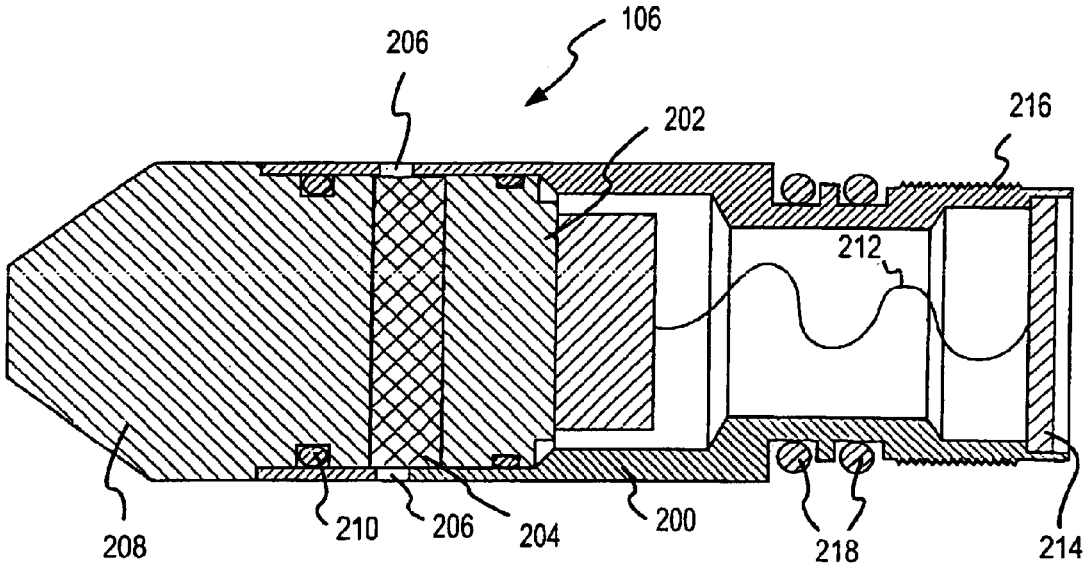
FIG. 5 is a sectional side view of one embodiment of a sensor component of the present invention.

FIG. 5 shows the sensor component 106 in cross-section. The sensor component 106 includes a housing 200 inside of which is disposed a sensor 202. Adjacent to the sensor 202 is a sample chamber circumferentially enclosed by a screen 204. Port holes 206 extending through the wall of the housing 200 permit a fluid to enter the sample chamber so that sensor readings can be made by the sensor 202 of at least one monitored condition of the fluid. The sensor may be any sensor capable of providing the sensor readings and could include, for example, a temperature sensor, a pressure sensor, a turbidity sensor, a chlorophyll sensor, an electrochemical sensor for monitoring a variety of conditions, such as pH, oxygen reduction potential ORP), total dissolved solids (TDS), or the presence of a specific component (e.g., dissolved oxygen (DO) or specific ions such as nitrates, sulfates or chlorides). In one preferred embodiment, the sensor 202 is a pressure sensor. In a preferred embodiment, in addition to the sensor 202, the tool assembly 100 also includes a temperature sensor (not shown) located on the main circuit board 130 (shown in FIG. 3). The temperature sensor may be mounted on the main circuit board 130, because it is typically not necessary for the temperature sensor to contact the fluid being monitored. The temperature sensor may be of any suitable type, such as, for example, a precision silicon temperature sensor obtainable from a number of manufacturers including Dallas Semiconductor Corp. and National Semiconductor Corp. Readings obtained from the temperature sensor can be used to make temperature corrections for sensor readings that are obtained from the sensor 202. Also, in one preferred embodiment, the sensor 202 is a gauge pressure sensor and the cable 108 (shown in FIG. 4) is a vented cable, including a fluid conductive path in fluid communication with the atmosphere. The use of a vented cable to permit gauge pressure readings to be taken is extremely advantageous, especially when the tool assembly 100 is deployed in a relatively shallow monitoring well, because changes in barometric pressure could otherwise significantly affect pressure readings.

With continued reference primarily to FIG. 5, at one end of the sensor component 104 is a nose cone 208 secured to the housing 200 by an O-ring 210. The nose cone 208 is tapered on the outside to facilitate unhindered insertion into a well or other hole without hanging up. The sensor 202 is connected to a ribbon cable 212, which includes a plurality of conductive lines connected to a printed circuit board 214. The printed circuit board 214 serves as an interconnection interface in the sensor component 106 for electrically interconnecting the sensor component 106 with the control component 102. The sensor component 104 also includes an engagement structure 216, including a male threaded structure, capable of rotatably engaging the complementary threaded structure 124A (shown in FIG. 3) on the control unit 102, as previously discussed. The sensor component 104 includes two O-rings 218 for sealing with the smooth surface 126A (shown in FIG. 3) of the control component 102 when the control component 102 and the sensor component 106 are rotatably engaged.

Figure 6:
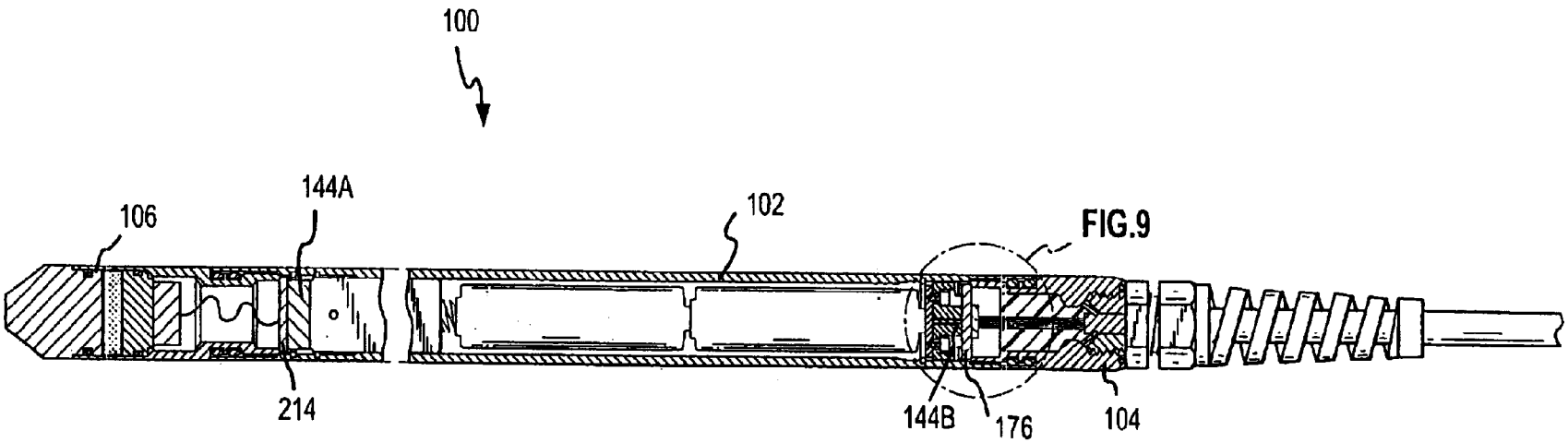
FIG. 6 is a side view, in partial cross section, showing one embodiment of a fully assembled three-component tool assembly of the present invention.

FIG. 6 shows a cross-section of the three-component tool assembly 100 with the control component 102 rotatably engaged with both the sensor component 106 and the cable component 104. As seen in FIG. 6, when the control component 102 and the cable component 104 are rotatably engaged, the multiple connector unit 144B of the control unit contacts the printed circuit board 176 of the cable component 104, thereby electrically interconnecting the control component 102 with the cable component 104. Also, when the control component 102 and the sensor component 106 are rotatably engaged, the multiple connector unit 144A of the control component 102 contacts the printed circuit board 214 of the sensor component 106, thereby electrically interconnecting the control component 102 and the sensor component 106.

The embodiment of the tool assembly discussed so far with reference to FIGS. 1–6 includes three components. The tool assembly, however, may include a larger or smaller number of components, and may include features in addition to those discussed above. In one embodiment of the present invention, the tool assembly may include only two components. Such a two-component tool assembly will now be described with reference to FIGS. 7 and 8. The same reference numerals are used in FIGS. 7 and 8 as are used in FIGS. 1–6, except as noted.

Figure 7:
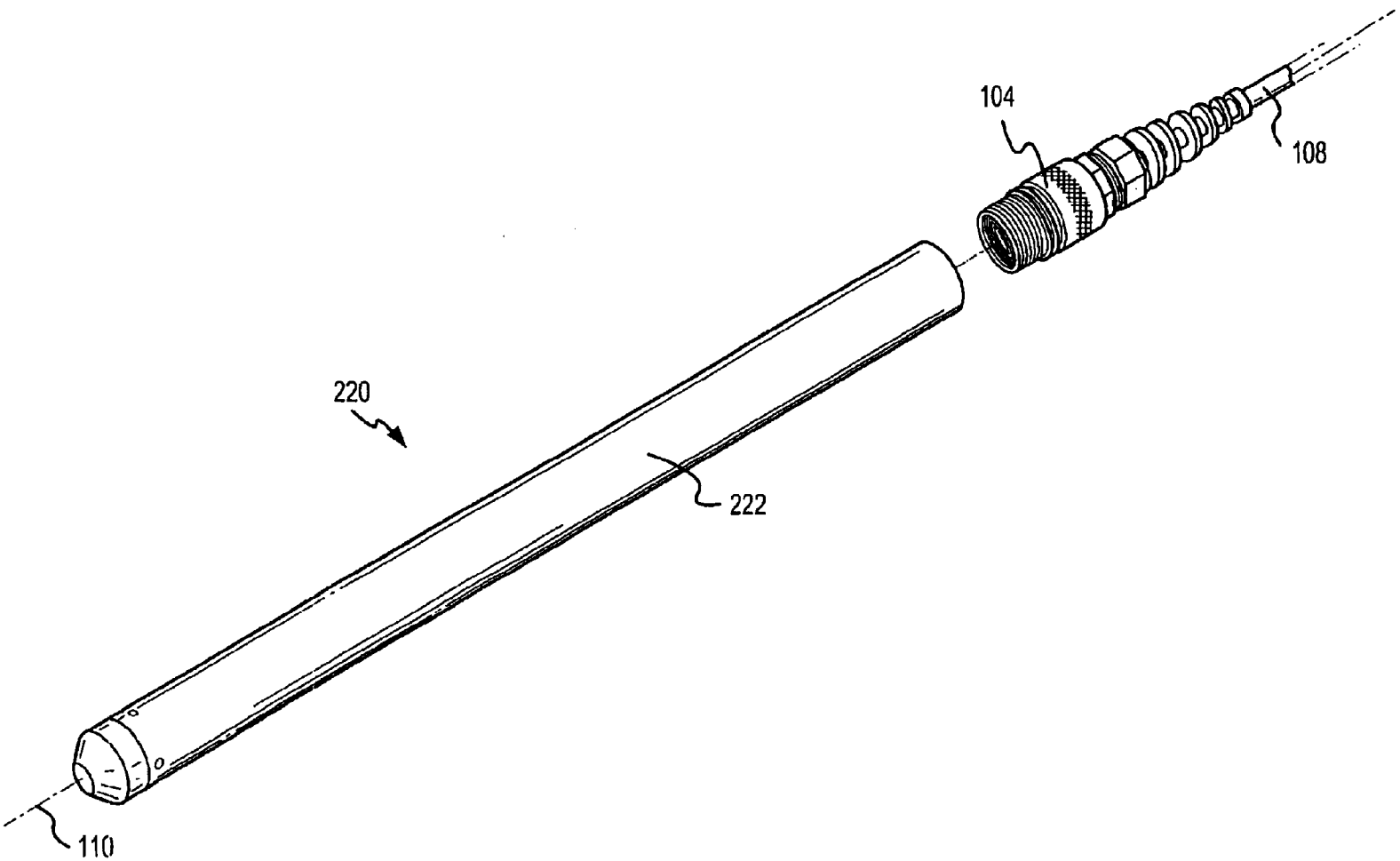
FIG. 7 is an exploded perspective view of one embodiment of a two-component tool assembly of the present invention.

FIG. 7 is a perspective view of a two-component tool assembly 220, exploded to show the two different components. The tool assembly 220 includes the cable component 104 rotatably engaged with a combination control/sensor component 222, which combines in a single component the sensor features and control features of the control component 102 and the sensor component 106, as described previously with reference to FIGS. 1–6. The cable unit 104 is the same as that described previously with reference to FIGS. 1–6.

Figure 8:
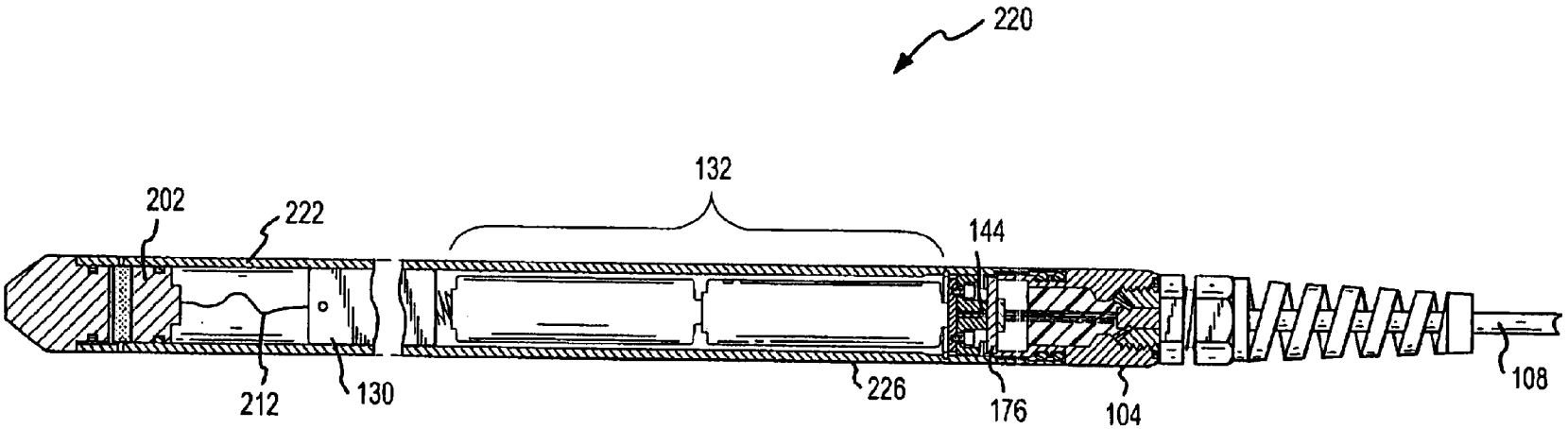
FIG. 8 is a side view, in partial cross section, of one embodiment of a two-component tool assembly of the present invention.

FIG. 8 shows a cross-section of the two-component tool assembly 220. As seen in FIG. 8, the control/sensor component 222 includes only a single multiple connector unit 144, which contacts the printed circuit board 176 of the cable component 104, thereby electrically interconnecting the control/sensor component 222 and the cable component 104 when the control/sensor component 222 and the cable component 104 are rotatably engaged. The rotatable engagement between the control/sensor component 222 and the cable component 104 is made using complementary rotatable engagement structures, preferably complementary threaded structures, of the type previously described with reference to FIGS. 1–6. Because the main circuit board 130 and the sensor 202 are both disposed inside of the housing 226 of the control/sensor component 222, the ribbon cable 212 is connected directly to the main circuit board 130 and serves as the interface through which the main circuit board 130 and the computing unit are electrically interconnected with the sensor 202. In that regard, the interface through which the main circuit board 130 is interconnectable with the sensor 202 may be any electrically conductive pathway. For example, the printed circuit board 130 may include conductive features on the edge of the board, and the sensor 202 may be interconnected with the main circuit board 130 by direct soldering of connector pins on the sensor 202 to the conductive features on the edge of the main circuit board 130. In that embodiment, the conductive features on the edge of the board would serve as the interface through which the computing unit is interconnectable with the sensor 202.

One important aspect of the present invention is an electrical connector that can be used to make electrical interconnections between the components of the tool assembly without keying. The electrical connector includes two connector portions that in one configuration of the invention are engageable by rotatable engagement of complementary engagement structures, one located on each of the connector portions. Although the configuration described herein employs connectors which are engageable by rotatable engagement, other types of engagement, which do not require keying shall fall within the scope of the present invention. For example, connectors which provide for alignment of components along a common axis, and apply a compressive force to keep the components in place, such as snaps and latches, fall within the scope.

With regards to the rotatable connector, each connector portion includes a set of electrical leads. The engagement structure also includes a multiple connector unit that, when the complementary engagement structures are rotatably engaged, is sandwiched between and contacts the sets of electrical leads of the two connector portions. The two connector portions may be integral with or separately connected to electronic components to be electrically interconnected. A significant advantage of the electrical connector of the present invention is that it requires no keying to orient the two connector portions to make the desired electrical interconnection between the two sets of electrical leads. Furthermore, because the connector portions are engageable by simple rotatable engagement of the engagement structures, the electrical connector is readily adaptable for use in a variety of applications. Although the electrical connector may be used to electrically interconnect a wide variety of electronic components, the electrical connector will be described herein primarily with reference to the tool assembly of the present invention.

By using the electrical connector of the present invention, electrical interconnections can be made between components through simple rotatable engagement of the components, facilitating ease-of-use and efficient manufacturability. The tool assembly is easy to assemble because the components are physically secured to each other and electrical interconnection is made between the components simply by rotatably engaging the components. No keying between the components is required to orient the components for engagement or electrical interconnection, which significantly simplifies assembly of the tool assembly. The rotatable engagement and electrical interconnection of components using the electrical connector will now be discussed in greater detail in relation to coupling of the cable unit 104 and the control component 102 with reference to FIGS. 6 and 9–14. As will be appreciated, the same principles apply equally to engagement of any two components by rotatable engagement according to the present invention. For example, a similar electrical connector structure is used in coupling the control component 102 and the sensor component 106 and in coupling the control/sensor component 222 and the cable component 104 (in the two-component tool assembly 220 shown in FIGS. 7 and 8).

Figure 9:
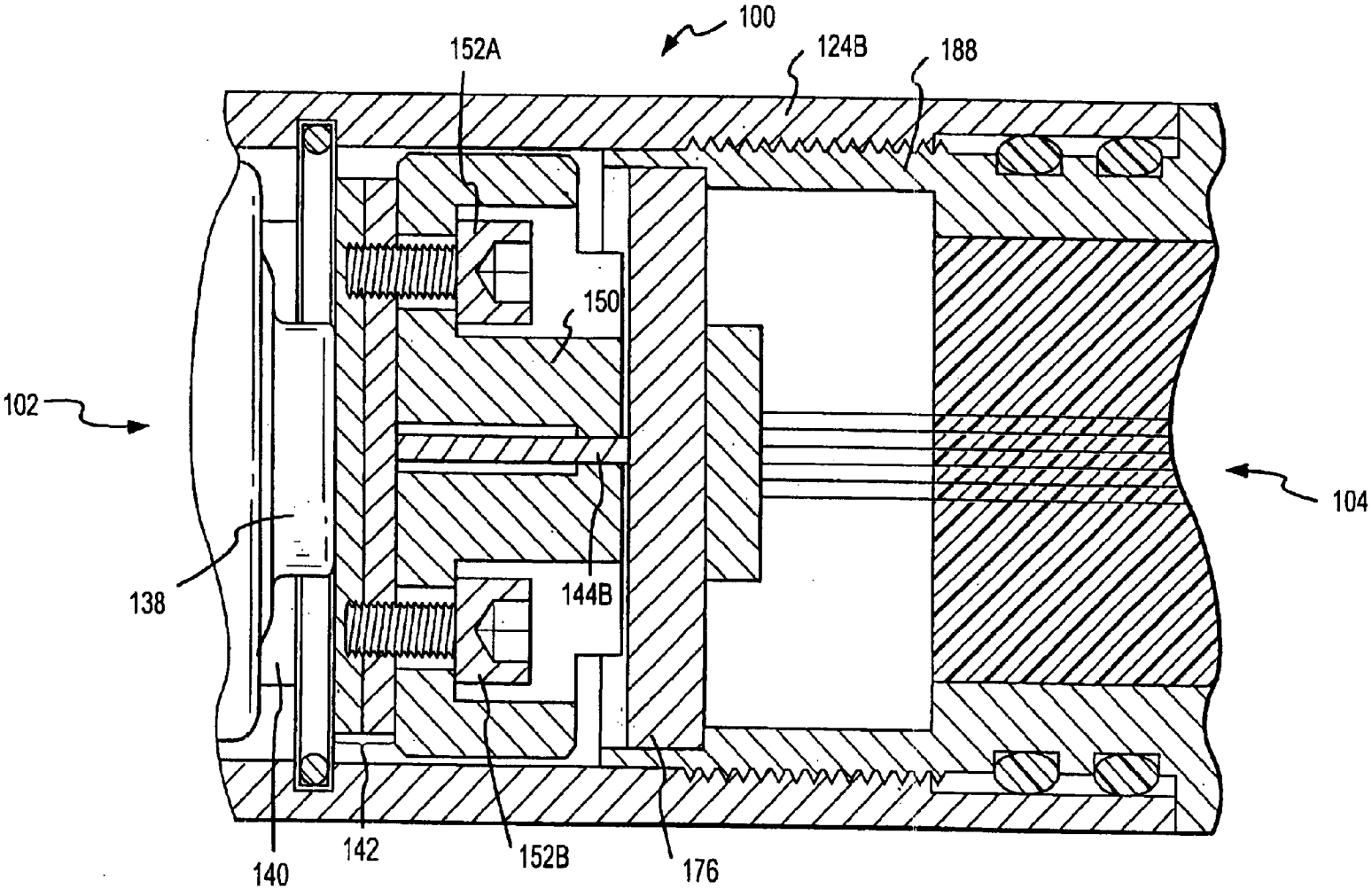
FIG. 9 a is side view, in partial cross-section, of a portion of the tool assembly shown in FIG. 6 showing an enlargement of the portion of the tool assembly where the control component and the cable component are interconnected.

FIG. 9 shows an enlarged cross-section of the portion of the tool assembly 100 enclosed by the dashed circle in FIG. 6, where the control component 102 and the cable component 104 are coupled, with electrical interconnection between the components being made using one embodiment of the electrical connector of the present invention. Reference numerals are the same as those used in FIGS. 1–6. As clearly seen in FIG. 9, the control component 102 and the cable component 104 are coupled through rotatable engagement of the complementary threaded engagement structures 124B and 188. This rotatable engagement physically secures the control unit 102 to the cable unit 104. Furthermore, when the control unit 102 and the cable unit 104 are fully rotatably engaged, the multiple connector unit 144B and the printed circuit board 176 make contact, thereby electrically interconnecting the control component 102 and the cable component 104.

Figure 10:
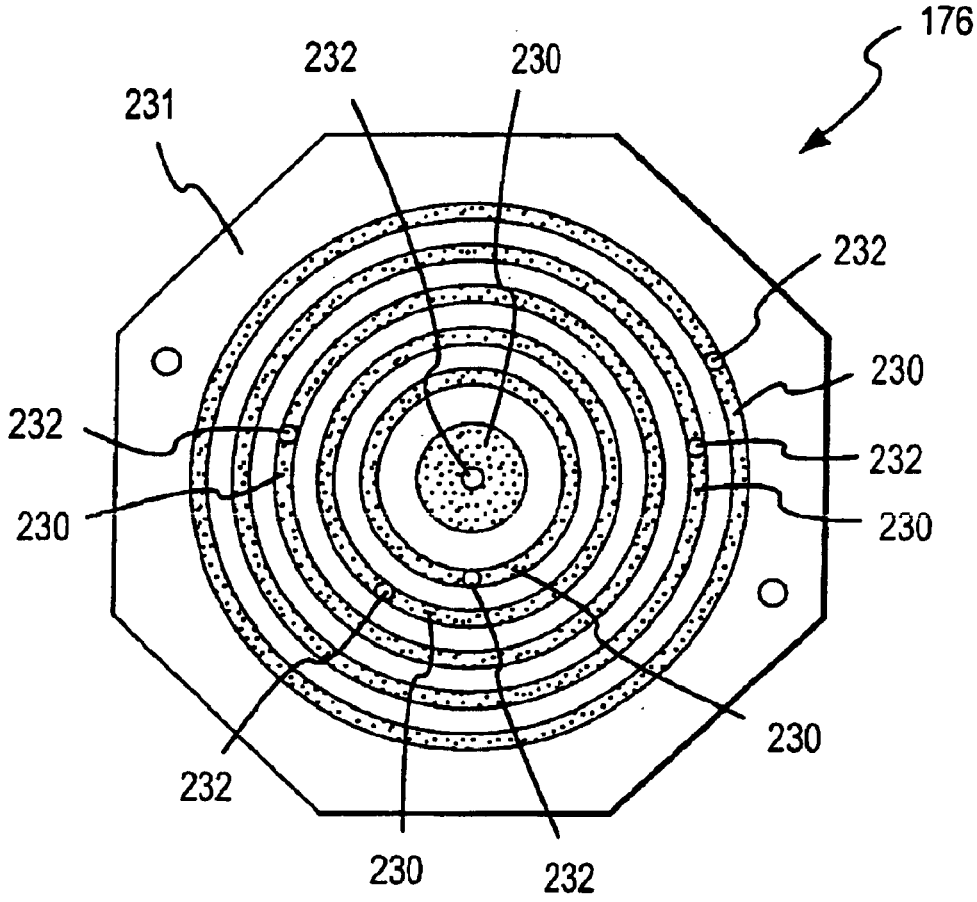
FIG. 10 is a top view of a printed circuit board used in an interconnection structure in one embodiment of the present invention for interconnecting components of a tool assembly of the present invention.

FIG. 10 shows the front side of the printed circuit board 176. The front side of the printed circuit board 176 is the side that contacts the multiple connector unit 144B. Located on the front side of the printed circuit board 176 are a plurality of electrical leads 230, in the form of concentric circles supported on an insulating substrate 231. Although it is possible that other shapes could be used for the electrical leads 230, it is preferred that the electrical leads 230 each include at least an arc of a concentric circle. These electrical leads 230 are preferably made of an electrically conductive metal or metals. Gold is particularly preferred due to its high reliability for making good electrical connections. When gold is used, it is typically a gold plate over another conductive metal, such tin. In the embodiment of the printed circuit board 176 shown in FIG. 10, the printed circuit board 176 includes six of the electrical leads 230, permitting a total of six electrical connections to be made between the control component 102 and cable component 104. As will be appreciated, any number of electrical leads 230 could be included, limited only by the size and geometry of the printed circuit board 176 and the electrical leads 230. The printed circuit board 176 also includes a plurality of vias 232, which are metallized apertures through the printed circuit board 176 used to make electrical connections from the electrical leads 230 to the back side of the printed circuit board 176. As seen in FIG. 10, there is one of the vias 232 corresponding with each of the electrical leads 230.

Figure 11:
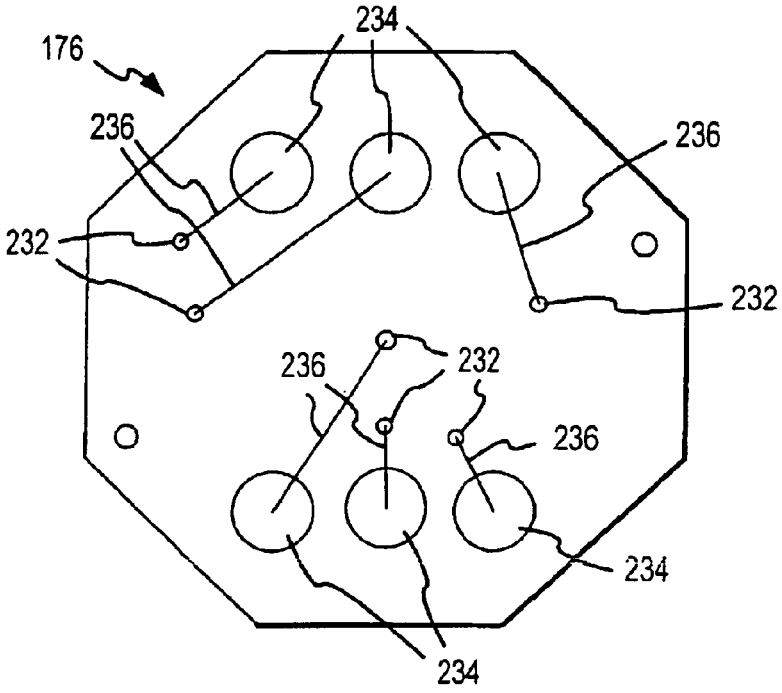
FIG. 11 is a bottom view of the printed circuit board shown in FIG. 10.

FIG. 11 shows the back side of the printed circuit board 176. Located on the back side of the printed circuit board 176 are a plurality of electrically conductive bonding locations 234 connected to the vias 232 by conductive lines 236. The bonding locations 234 provide a location for electrical conductors 174 from the cable 108 (as shown in FIG. 4) to be connected to the printed circuit board 176, such as by soldering, wire bonding, etc. The bonding locations 234 and the conductive lines 236 are preferably thin electrically conductive features and may be made of any suitably conductive material, preferably a conductive metal or metals. A preferred metal is gold, which may be present as a plated layer on top of another conductive metal, such as tin. In the configuration of the printed circuit board disclosed in FIGS. 11 and 12, direct electrical connections are shown between the electrical leads 230 on the front side and the conductive bonding locations on the back side. In an alternate configuration of the invention, one or more circuit breaker devices may be disposed between these elements in order to provide electrical protection the various electrical components employed in the tool assembly.

Figure 12:
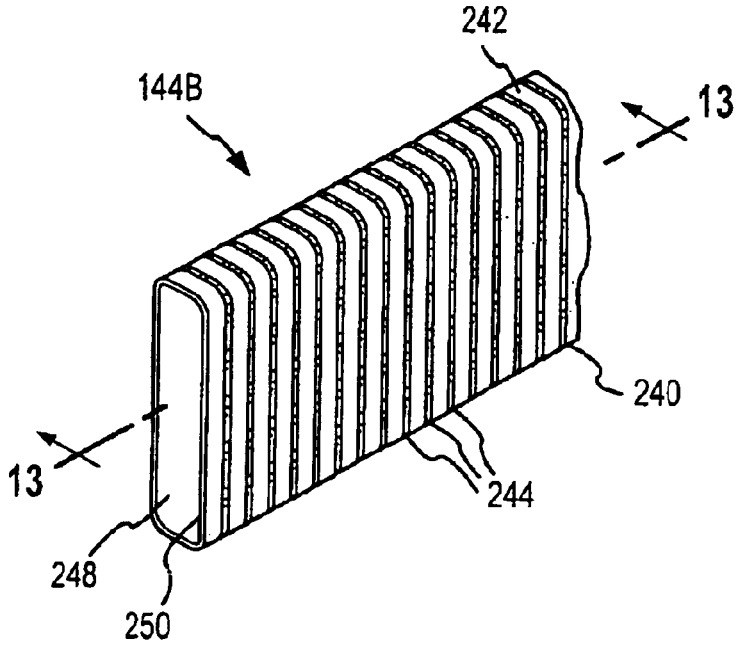
FIG. 12 is a partial perspective view of one embodiment of a multiple connector unit for use with a tool assembly of the present invention.
Figure 13:
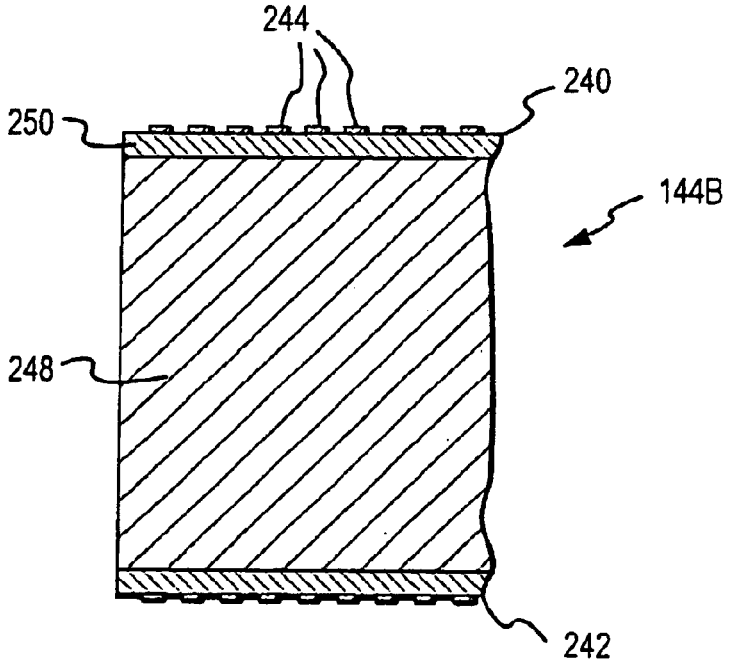
FIG. 13 shows a partial side view, in cross section, of the multiple connector unit of FIG. 12.

The multiple connector unit 144B is a small elongated strip with a plurality of isolated conductive paths through which isolated electrical connections can be made to the electrical leads 230 of the printed circuit board 176. FIGS. 12 and 13 show the multiple connector unit 144B, with FIG. 12 being a partial view in perspective and FIG. 13 being a partial cross-section. As shown in FIGS. 12 and 13, the multiple connector unit 144B has a first side 240, which contacts the top side of the printed circuit board 176 to make electrical connections to the electrical leads 230. The connector unit 144B also has a second side 242, opposite the first side 240. The multiple connector unit 144B further includes a plurality of substantially parallel, electrically isolated conductive portions 244, or conductive lines, that extend all the way from the first side 240 to the second side 242. In the embodiment shown in FIGS. 12 and 13, the multiple connector unit 144B includes an electrically insulating core 248. A flexible film 250, which serves as a substrate on which the isolated conductive portions 244 are supported, is wrapped around and adhered to the core 248. The flexible film 250 may be made of any suitable electrically insulating film, such as a film of polyimide material. Furthermore, it is not necessary that the flexible film 250 extend entirely around the perimeter of the core 248, as is shown in FIG. 13. It is only necessary that the conductive portions 244 provide isolated conductive paths from the first side 240 to the second side 242. For example, the flexible 250 could be attached to only three sides of the core, the first side 240, the second side 242, and one of the other two sides. Moreover, it is not necessary that the multiple connector unit have a rectangular cross-section, as shown in FIG. 13. For example, the cross-section shape could be circular, oval, triangular, etc. Also, other structures for the multiple connector unit are possible. For example, the multiple connector unit could be made of a body including alternating strips of conductive and nonconductive materials, such as would be the case for a silicone rubber body with alternating conductive and nonconductive strips. The conductive strips could be formed by filling the silicone rubber, in the areas of the conductive strips, with an electrically conductive powder, such as a silver powder. As another example, the multiple connector unit could include small conductive wires imbedded in and passing through an electrically insulating matrix, such a matrix of silicone rubber. Any structure for the multiple connector unit is sufficient so long as isolated conductive portions extend substantially entirely from a first side to an opposite second side to make isolated electrical contacts across the multiple connector unit. Furthermore, the conductive portions 244 may be spaced using any pitch desired for the particular application. For most applications, however, the conductive portions will have a pitch of smaller than about 0.01 inch, and more typically smaller than about 0.006 inch.

It is also desirable that the multiple connector unit 144B be sufficiently deformable so that it readily conforms to the surface of the printed circuit board 176 to make good electrical contact with the electrical leads 230 and without significant damage to the electrical leads 230. In that regard, the core 248 is preferably made of a deformable material, and preferably an elastomerically deformable material, such as a natural or synthetic rubber or another thermosetting or thermoplastic polymeric material. A preferred elastomeric material is silicone rubber. Multiple connector units that are elastomerically deformable are sometimes referred to as elastomeric electrical connectors. One source for such elastomeric electrical connectors is the Zebra™ elastomeric connector line from Fujipoly America Corp., of Kenilworth, N.J., U.S.A. Another source is the Z_Axis Connector Company of Jamison, Pa., U.S.A., which has several lines of elastomeric electrical connectors.

Reference is now made primarily to FIGS. 9, 12, 13 and 14 to further describe the manner in which electrical interconnections are made between the multiple connector unit 144B and the printed circuit board 176 when the control component 102 and the cable component 104 are rotatably engaged. As the complementary engagement structures 124B and 188 of the control unit 102 and the cable unit 104, respectively, are being rotatably engaged, the multiple connector unit 144B and the printed circuit board 176 rotate relative to each other until the complementary engagements structures 124B and 188 are fully rotatably engaged, at which time the printed circuit board 176 and the multiple connector unit 144B have come into contact.

Figure 14:
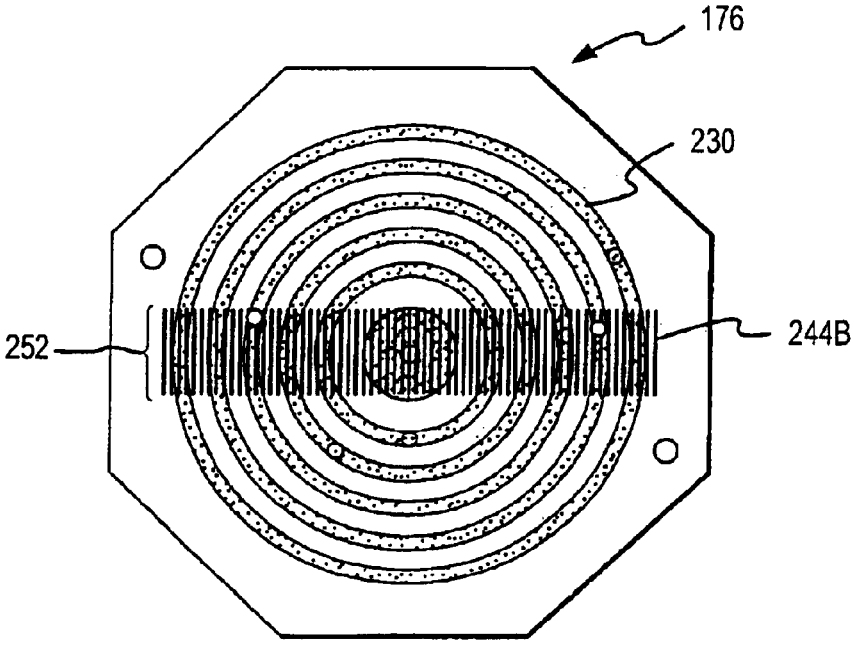
FIG. 14 is a top view of the printed circuit board shown in FIG. 10, further showing an overlay pattern of a multiple connector unit for making electrical interconnections between components according to one embodiment of the present invention.

FIG. 14 shows an overlay representing an example of the positioning of the conductive portions 244 on the first side 240 of the multiple connector unit 144B with relation to the electrical leads 230 on the top side of the printed circuit board 176 when the complementary engagement structures 124B and 188 of control unit 102 and the cable unit 104, respectively, are fully rotatably engaged. An important feature of the rotatable engagement is that an isolated electrical contact is made through the conductive portions 244 of the multiple connector unit 144B to each of the electrical leads 230. To achieve such isolated electrical contacts to the electrical leads 230, it is important that the space between the electrical leads 230, the space between the electrically conductive strips 244 and the length 252 of the electrically conductive strips 244 on the first side 240 of the multiple connector unit 144B be designed to ensure that the conductive strips do not short circuit across adjacent electrical leads 230.

To briefly summarize, electrical interconnection of the control component 102 and the cable component 104 is made through contact between the conductive strips 244 of the multiple connector unit 144B and the electrical leads 230 on the printed circuit board 176 simply by rotatably engaging the complementary threaded structures 124B and 188 of the control component 102 and the cable component 104, respectively. No keying is required to orient the control component 102 and the cable component 106, and no keyed cable connections are required. This absence of keying significantly simplifies assembly of the tool assembly of the present invention for ease of use. Furthermore, the manufacturing complexity required to make a keyed arrangement is avoided, simplifying manufacturing and reducing manufacturing costs.

As noted previously, the electrical connector of the present invention includes two connector portions engageable by rotatably engageable complementary engagement structures and a multiple connector unit disposed between and in contact with each of two sets of electrical leads. For the electrical interconnection between the control component 102 and the cable component 104, the two connector portions are the end portions of the components being engaged. One set of electrical leads for the electrical connector are the electrical leads 230 on the printed circuit board 176, which are in contact with the first side 240 of the multiple connector unit 144B. The other set of electrical leads required for the electrical connector, which are in contact with the second side 242 of the multiple connector unit 144B, is located on the contact end 142 of the flexible circuit unit 140. It should be noted that in the embodiment of the tool assembly 100 just described, the multiple connector units 144A,B have been incorporated in the control component 102. The multiple connector unit 144A could instead have been incorporated into the sensor component 106 and the multiple connector unit 144B could instead have been incorporated into the cable unit 104. Alternatively, the connector units 144A,B could have initially been a part of neither component and would instead be inserted between the appropriate components prior to engagement, although such an embodiment is not preferred.

Figure 15:
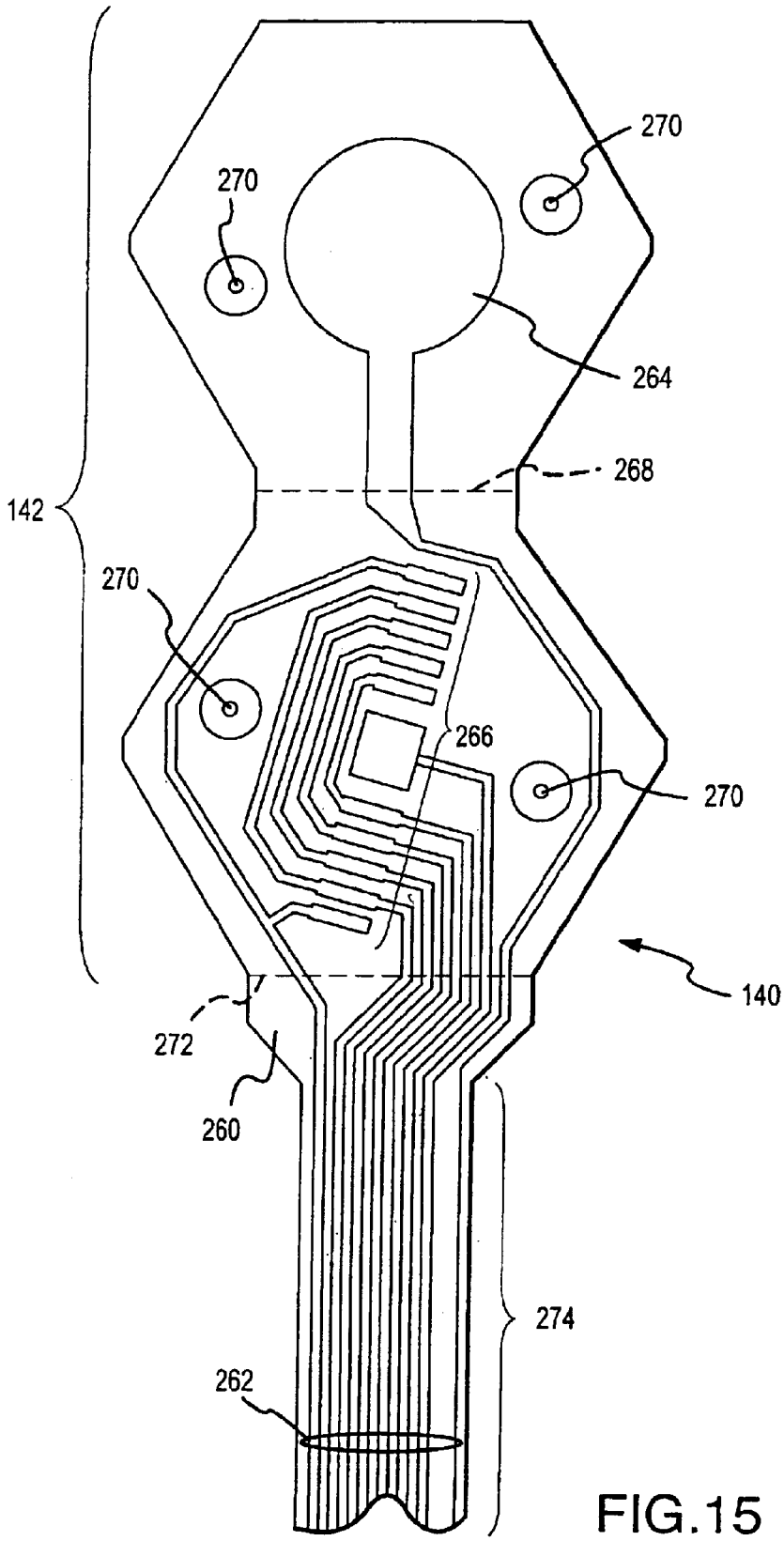
FIG. 15 shows a partial top view of one embodiment of a flexible circuit unit for use with a tool assembly of the present invention.

Features of the flexible circuit unit 140 will now be described in greater detail, including the electrical leads for contacting the multiple connector unit 144B. Referring to FIG. 15, a partial top view is shown of the flexible circuit unit 140, showing the contact end 142. The flexible circuit unit 140 includes a flexible substrate 260, such as a flexible polyimide film, on the surface of which is located thin electrically conductive features. The electrically conductive features include a contact pad 264, located on the contact end 142, which contacts the second electrode 138 of the energy storage unit 132 (as shown in FIGS. 3, 6 and 9). In an embodiment when the tool assembly of the present invention does not include the energy storage unit 132, then the contact pad 264 would directly contact the spring contact 136 (shown in FIGS. 3 and 6). The conductive features also include electrical leads 266, also located on the contact end 142, which contact the multiple connector unit 144B (as shown in FIGS. 6 and 9). The electrically conductive features also include a plurality of electrically conductive lines 262, which extend down a neck portion 274 of the flexible circuit unit 140 substantially all the way to the end of the flexible circuit unit 140 opposite the contact end 142, to make contact with the main circuit board 130 (as shown in FIG. 3).

Referring now to FIGS. 9, 12, 13 and 15, when the control component 102 and the cable component 104 are rotatably engaged, the multiple connector unit 144B is sandwiched between the circuit board 176 and the contact end 142 of the flexible circuit unit 140 so that the conductive portions 244 of the multiple connector unit 144B are in contact with both the electrical leads 230 on the printed circuit board 176 and the electrical leads 266 on the flexible circuit unit 140, thereby making isolated electrical connections between the electrical leads 230 and the electrical leads 266 to electrically interconnect the control component 102 and the cable unit 104. To make the desired isolated electrical connections, it will be appreciated that due consideration must be given to the relationship between the size and spacing of the electrical leads 266, the size and the spacing of the electrical leads 230 and the size and pitch of the conductive strips 244. Furthermore, the multiple connector unit 144B is held in a fixed position relative to the electrical leads 266 by the second retainer 150, which is attached to the contact end 142 of the flexible circuit unit 140 by the set screws 152A,B.

As shown in FIG. 15, the contact end 142 of the flexible circuit unit 140 is shown as a flat sheet, which is the form in which it is manufactured. When incorporated into the control component 102, however, the contact end 142 is folded 180 degrees at the fold line 268 (folded so that the contact pad 264 and the electrical leads 266 are facing opposite directions), with the set screws 152A,B (as shown in FIGS. 6 and 9)extending through the screw holes 270 to maintain the contact end 142 in a folded state about the fold line 268 and to fasten the contact end 142 to the second retainer 150 (as shown in FIGS. 6 and 9). In a preferred embodiment, a thin rigid sheet is inserted between the overlapping portions of the contact end 142 when folded about the fold line 268 to serve as a stiffener for the folded structure. The rigid sheet has holes corresponding to the screw holes 270, to center the set screws 152A,B extending through the screw holes 270. Also, the contact end 142 is typically glued, such as with an epoxy glue, to the rigid sheet to enhance structural integrity. The flexible circuit unit 140 is also folded at the fold line 272 at an angle of approximately 90 degrees so that the contact pad 264 is facing the second electrode 138 of the energy storage unit 132 and the electrical leads 266 are facing the multiple connector unit 144B. With this configuration, as seen best in FIGS. 3, 6 and 9, the contact end 142 of the flexible circuit unit 140 can be moved out of the way, by folding back the neck portion 274 of the flexible circuit unit 140, to permit access to the energy storage unit 132 so that the electrochemical cells 133A,B may be removed and replaced as needed. Furthermore, there should preferably be sufficient slack in the flexible circuit unit 140 to permit the contact end 142 to be completely withdrawn from the housing 120 of the control component 102 to permit even easier access to the energy electrical storage unit 132. This feature will now be further described with reference to FIG. 16.

Figure 16:
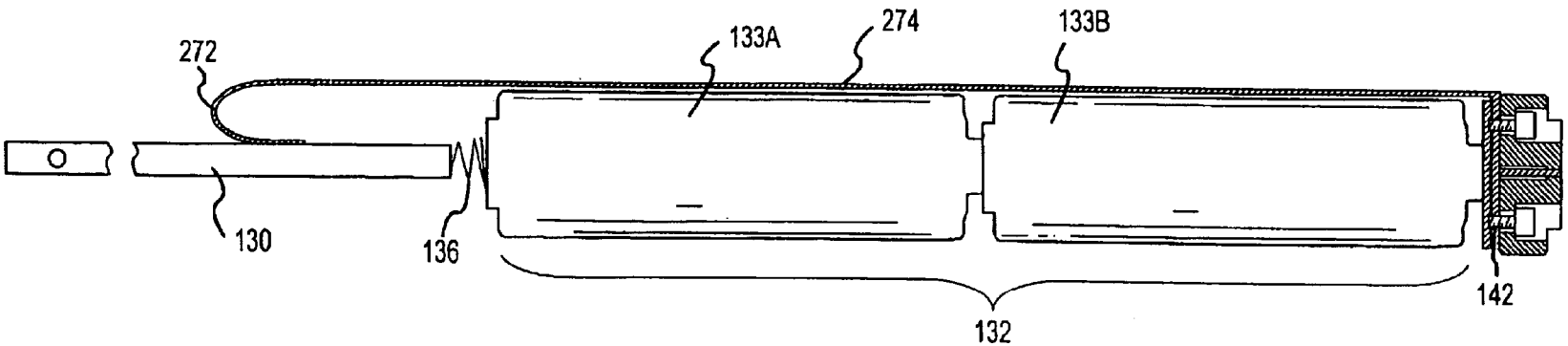
FIG. 16 is a schematic showing one embodiment of use of a flexible circuit unit to make electrical interconnections in one embodiment of a tool assembly of the present invention.

FIG. 16 shows the configuration of the flexible circuit unit 140 in relation to the energy storage unit 132 and the main circuit board 130. As shown in FIG. 16, the flexible circuit unit 140 extends from the contact end 142 across the entire length of the energy storage unit 132 to the main circuit board 130. A slack portion 272 of the neck portion 274 of the flexible circuit unit 140 permits the contact end 142 to be completely withdrawn from the housing 120 (shown in FIG. 3) to permit easier access to replace the electrochemical cells 133A,B. Use of the flexible circuit unit 140 to complete a circuit between the main circuit board 130 and the energy storage unit 132 is a significant aspect of the present invention, and inclusion of the slack portion 272 to permit easier access to the energy storage unit 132 is also a significant aspect of present invention. The use of the flexible circuit unit 140 to provide the electrical leads 266 through which electrical connections are made to the cable unit 104 is also a significant aspect of the present invention.

As noted previously, the electrical connector of the present invention is not limited to use with the tool assembly and components of the present invention. For example, the electrical connector could be used to electrically interconnect components of other tools designed for insertion into a hole, including those used in petroleum, natural gas and geothermal wells. Also, the electrical connector could be used to electrically interconnect components for medical devices, such as tubular components for endoscopic and laparoscopic devices. For these and other situations where the tools are of an elongated tubular shape, the connector portions should preferably be integral with the components to be electrically interconnected, similar to the integral nature of the connector components in the tool assembly of the present invention. Furthermore, the electrical connectors of the invention could be used in a cable connector structure to electrically interconnect components via a cable. For example, a cable end could be fitted with a first connector portion that rotatably engages a complementary second connector portion on an electric component (which could be another cable) to connect the cable to the component. In this situation, the connector component on the cable end may include a threaded rotating sleeve as the engagement structure that rotatably engages a threaded nipple on the electrical component. In this case, the rotating sleeve could rotatably engage the threaded nipple, but the electrical leads on the cable portion would not rotate, as was the case with the electrical connections of the tool assembly of the present invention. Rather, the rotating sleeve would rotate relative to the cable end, so as not to torsionally stress the cable. Alternatively, the rotating sleeve could be on the electronic component and the threaded nipple on the cable end.

Moreover, for many applications, the electrical leads in each of the two connector portions will be thin electrical conductive features on rigid circuit boards. For example, the printed circuit board 214 in the sensor component 106 (as shown in FIG. 5) includes electrical leads that contact the multiple connector unit 144A when the sensor component 106 and the control component 102 are rotatably engaged. The main circuit board 130 (as shown in FIG. 3) includes electrical leads on the end of the main circuit board 130, which contacts the multiple connector unit 144A. Also, these are only some examples of the types of electrical leads that may be used with the electrical connector of the present invention. Other electrical leads could be used instead, so long as the electrical leads are capable of making the isolated electrical connections through the multiple connector unit when complementary engagement structures of the connector portions are rotatably engaged.

The present invention also includes several aspects of operation of the tool assembly, and of operation of the components of the tool assembly. During operation, the tool assembly is typically field deployed as a field monitoring unit submerged in a liquid, typically an aqueous liquid, to field monitor at least one condition of the liquid. Most often, the tool assembly will be positioned inside of a well or other hole. As an example, the well may be a monitoring well to monitor for environmental contamination, water quality or for the presence of runoff water, etc. Alternatively, the tool assembly may be contained in a fluid permeable enclosure in a drainage area, river, lake, ocean or other geographic feature where water is found. At least one, and preferably substantially all of the operations of the tool assembly are directed by the computing unit located on the main circuit board. As noted previously, the computing unit includes a processor and memory, with the memory having stored therein instructions, in the form of code, that are readable and executable by the processor to direct the operations of the tool. The memory is preferably non-volatile memory, meaning that the contents of the memory are retained without power. Preferred non-volatile memory are firmware chips, such as EPROM chips, EEPROM chips and flash memory chips. Particularly preferred are flash memory chips, which permit rapid updating of the code as necessary without removing the memory chips from the tool assembly. Although the use of firmware code is preferred for operation of the tool assembly, it is possible that the tool assembly could also be operated using software code. As used herein, software code refers to code held in volatile memory, which is lost when power is discontinued to the volatile memory. Software code is not preferred for use with the present invention because of the substantial power required to maintain the code in volatile memory. For that reason, operation of the tool assembly, and components thereof, will be described primarily with reference to the use of firmware code contained in non-volatile memory.

The computing unit also includes a real time clock/calendar, which consumes only a very small amount of power. During operation, the tool assembly is normally in a sleep mode, in which the real time clock/calendar is operably disconnected from the processor. The tool assembly is occasionally awakened to an awake mode to perform some operation involving the processor. When the tool assembly is awakened, the clock/calendar is operably connected with the processor and the processor performs some operation. The operation to be performed when the tool assembly is awakened is frequently to obtain a periodic sensor reading, to process sensor reading data and store a data record, or data point, containing the data in memory. Other operations could also be performed during the awake mode, such as communication with an external device. The tool assembly stays awake only long enough to perform the operation and then returns to the sleep mode to conserve power.

Figure 17:
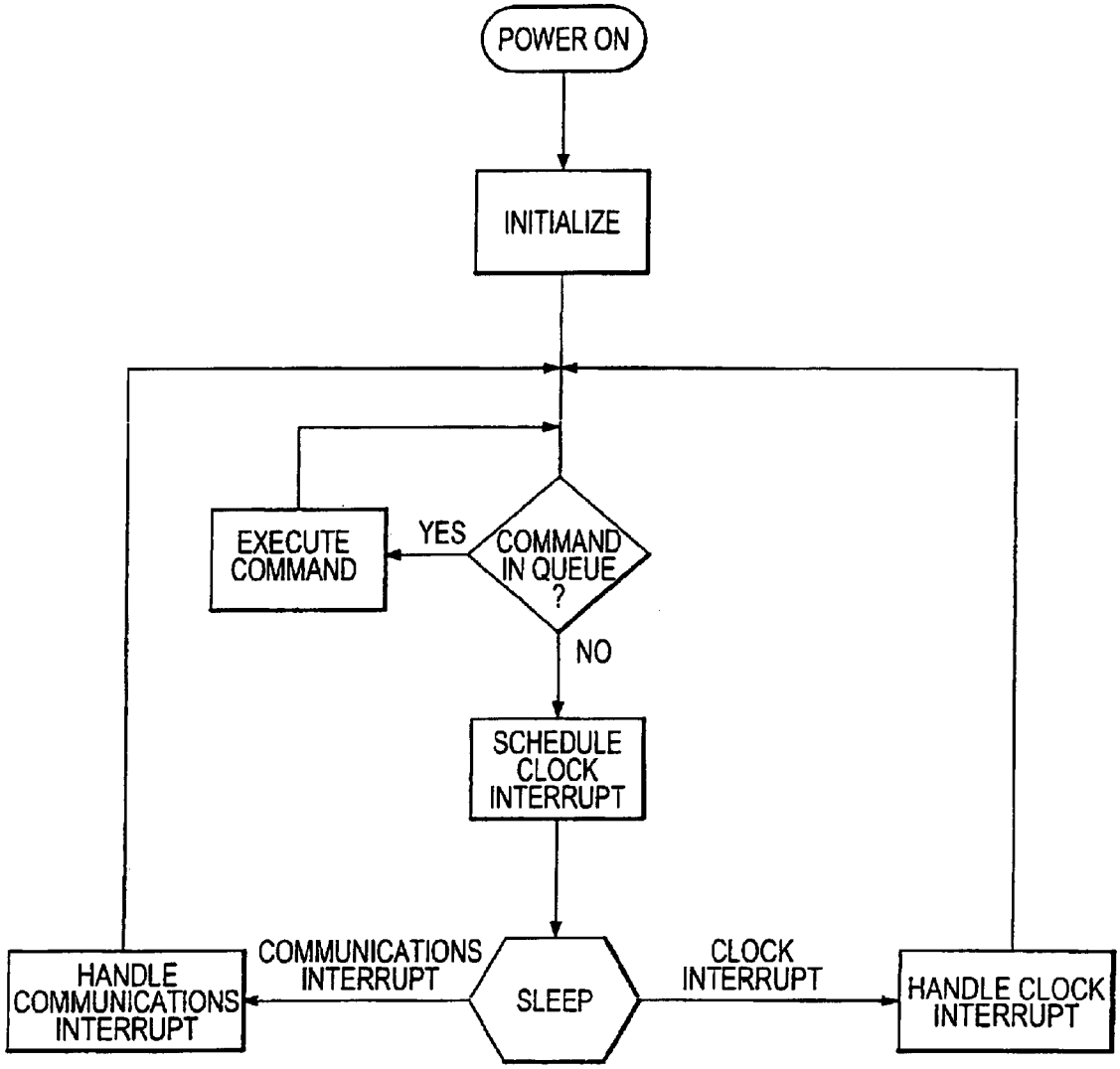
FIG. 17 shows a flow diagram of a main program loop for operation of one embodiment of a tool assembly of the present invention.

FIG. 17 is a flow chart showing the main program logic of the firmware code for operation of the tool assembly. When power is initially turned on to the computing unit, an initialization step is performed to initialize the firmware program. Following initialization, any commands that need to be executed are executed. When no further commands are in the queue for execution, then any required clock interrupts are scheduled, such as would be required to take a periodic sensor reading according to a predefined sampling schedule. After scheduling clock interrupts, the computing unit goes into a sleep mode, in which power is turned off to the processor. When in the sleep mode, the tool assembly can be awakened by an interrupt signal to the processor, which may be a clock interrupt generated by the clock/calendar on the main circuit board, or may be a communications interrupt, which may be caused, for example, by a communication signal received from a remote device. The remote device could be, for example, a remote controller, typically a personal computer, or another like tool assembly in a network of such tool assemblies. When an interrupt occurs, the computing unit is awakened and returns through the main program loop to execute any commands required by the interrupt and to schedule any required clock interrupts, before returning to the sleep mode.

Figure 18:
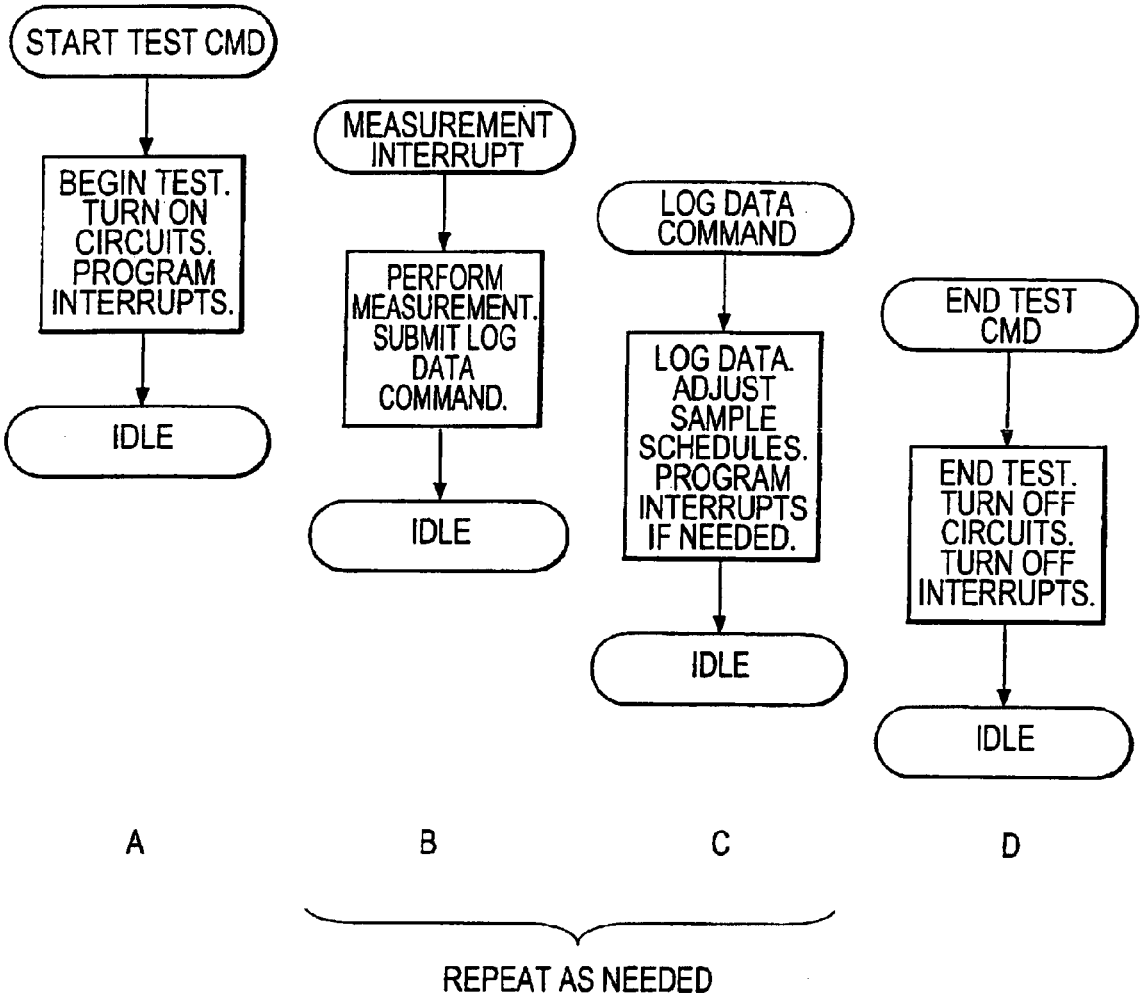
FIG. 18 shows a flow diagram for measuring and logging data in one embodiment of a tool assembly of the present invention.

FIG. 18 is a flow chart showing steps of a test sequence to take sensor readings and save sensor reading data. The test sequence proceeds through four basic steps A–D. The test sequence is commenced by executing the start test command, which begins the sampling test, turns on necessary circuits and programs clock interrupts, such as are required for a predefined sampling schedule. The sampling schedule involves taking a series of sensor readings at periodic intervals. The interval between taking sensor readings may be any desired interval. Typical intervals are, for example, every five minutes, every 15 minutes, every 30 minutes or every hour. Extremely short intervals or extremely long intervals are, however, also possible. Furthermore, it has been recognized that the firmware may be programmed to change the sampling schedule, and thereby change the interval between the taking of sensor readings, in response to identification by the computing unit of the occurrence of a predefined event. For example, the firmware could cause a shift to be made to a sampling schedule with a shorter interval when a significant change occurs between sensor readings, indicating that a perturbation event involving the monitored condition has occurred. For example, the sampling schedule could be changed from a first schedule having a first interval between sensor readings to a second schedule having a second interval between sensor readings, with the second interval being shorter than the first interval. The sampling schedule could then be returned to the original sampling schedule, including a longer interval between sensor readings, when the computing unit determines, from sensor reading data, that the perturbation event is over. Any event identifiable by the computer as having occurred could be used to trigger a change of the sampling schedule, or to initiate a sampling schedule to begin with. A significant predefined change in consecutive sensor readings is an example of one such event. As another example, the event could be the passing of a predefined period of time as measured by the clock/calendar.

With continued reference to FIG. 18, following execution of the test command, the test sequence is idle, and the computing unit will typically be in the sleep mode until a sensor reading is to be taken. In step B, a measurement interrupt is generated by the clock/calendar, which causes the processor to obtain a sensor reading from the sensor and submits a log data command for execution by the processor. In step C, the log data command is executed and sensor reading data is processed and stored in memory in a data table. The sensor reading data for the sensor reading is compared to a predefined standard to determine whether the sampling schedule should be changed. If the sampling schedule is to be changed, then the processor directs the appropriate adjustment to be made in the sampling interval. Interrupts are then programmed as necessary and a test sequence returns to an idle state, typically with the computing unit again being in the sleep mode awaiting the next scheduled sensor reading. One of the interrupts that may be programmed as a result of execution of the log data command is an interrupt that would cause the processor to direct transmission of a communication signal to another like tool assembly in a network, with the communication signal directing the other like tool assembly to commence a sampling schedule or to change an existing sampling schedule to another sampling schedule. The ability of the computing unit to change the sampling schedule in the tool assembly and the ability to transmit a communication signal to another like tool assembly to direct the other tool assembly to change sampling schedules are both significant aspects of the present invention and provide significant benefits with respect to reduced power consumption.

With continued reference to FIG. 18, steps B and C are repeated as necessary to take a series of sensor readings and to log corresponding sensor reading data according to a sampling schedule, or schedules, in effect. When the test sequence is to be terminated, the end test command is executed, which ends the test sequence, turns off circuits and turns off any remaining interrupts that have been scheduled. The test sequence is typically terminated by directions received from a remote device, which may be, for example, a remote controller such as a personal computer, palm top computer or may be another like tool assembly in a network of such tool assemblies.

As noted, the ability of the computing unit to change the sampling schedule, in response to the occurrence of a predefined event, can result in significantly reduced power consumption. Such energy conservation is extremely advantageous for field deployable units, such as the tool assembly of the present invention. This is because that when the tool assembly is field deployed, it often must be powered by batteries, which are either located within the tool assembly or located elsewhere at the field location. This is true whether the tool assembly is operating independently or as part of a network with other such tool assemblies. With the tool assembly of the present invention, the sampling schedule may initially be set with a long interval between the taking of sensor readings, such as perhaps every 15 minutes, 30 minutes or even one hour or longer. When a perturbation event is identified, the sampling schedule is changed to include a shorter interval between sensor readings. For example, the shorter interval may be every 5 minutes, 2 minutes, or even 1 minute or shorter. The sampling schedule may then be returned to the original sampling schedule, having a longer interval between sensor readings, when the perturbation event has ended. In this manner, frequent sensor readings are obtained and corresponding sensor reading data points are logged only during the perturbation event, when more careful monitoring is desired. This ability to adapt the sampling schedule to the situation is referred to as adaptive schedule sampling.

In addition to conserving energy, it is also desirable to minimize the amount of memory consumed to log the sensor reading data. With the present invention, not only is energy significantly conserved, but memory space is also conserved. In some prior art devices, for example, a logging tool may have a set sampling schedule with a short interval between sensor readings. To conserve memory space, however, the tool only infrequently logs a sensor reading data point. Logging of intermediate data points occurs only if the intermediate data point is significantly different than a previously logged data point. Although this prior art technique conserves memory space, it does not conserve energy because the logging tool is required to obtain a number of data points that are not logged. Furthermore, because the time interval between logged data points varies, a previous technique has been to save a time tag with each logged data point. With the present invention, however, it has been determined that sensor reading data may be logged without consuming the memory space required to tag every data point with a time tag.

One way, according to the present invention, to log the sensor reading data in a manner to avoid tagging each data point with a time tag, is to switch data files and save the data points to a different data file after the sampling schedule changes. Because the sample interval between data points logged in the data file are constant, the time at which each data point was taken can be calculated. One problem with this technique, however, is that it is not easy to relate the data points between different data files. Therefore, in a preferred embodiment of the present invention, only a single data file is used to log sensor reading data. In this preferred embodiment, to avoid the requirement of a time tag with each data point, data points are tagged only when the sampling schedule is being changed. For example, the first data point logged may be tagged to indicate the time interval between sensor readings for the sampling schedule in effect and the time at which sampling is initiated. The time of any data point taken during the sampling schedule can then be calculated based on its number in sequence following the tagged data point. When the sampling schedule is changed, the data point that marks the commencement of the new sampling schedule change is tagged with information indicating the interval between sensor readings for the new sampling schedule. In this way, a continuous record in a single data file may be recorded without the burden of including a time tag for every data point. This data logging technique conserves significant memory space. Moreover, because only a single data file is used, it is very easy for the user to interrelate data points and interpret the data that has been logged. Accordingly, with a preferred embodiment for the present invention, the tool assembly significantly conserves both energy and memory space, and in a manner that facilitates easy use of the tool assembly to interpret logged data.

As noted, a significant advantage of the tool assembly of the present invention is that it has been designed with significant energy conservation features. One of those features is use of adaptive schedule sampling to avoid taking more sensor readings than is necessary. In a preferred embodiment of the tool assembly of the present invention, significant additional energy conservation is accomplished through design of the tool assembly to operate with efficient electronic components at a low voltage. Preferably the tool assembly operates at a voltage of smaller than about 4 volts, more preferably smaller than about 3.5 volts, still more preferably at a voltage of about 3.3 volts and most preferably at a voltage of about 3 volts or smaller. The tool assembly, or discrete electronic parts thereof, could operate at very low voltages. For example, the processor (and/or other electronic parts) could operate at a voltage of 2.7 volts, or even 1.8 volts. This low voltage operation is in contrast to most current logging tools, which typically operate at a voltage of 5 volts or higher. By operating the tool at a lower voltage and with high efficiency electronic parts, power consumption during operation may be considerably reduced, resulting in a significant lengthening of the life of batteries providing power to operate the tool assembly. With the present invention, current draw when the tool is awake is typically smaller than about 100 milliamps at a voltage of about 4 volts or less, requiring only about 0.4 watts of power, or less, for operation in the awake mode. In many instances, the power consumption can be even smaller. For example, when the tool assembly is designed for taking pressure readings, and includes only a pressure sensor and a temperature sensor, power consumption during operation in the awake mode may be kept at smaller than about 25 milliamps.

For the tool assembly to operate at a suitably low voltage, electronic components in the tool assembly must be properly selected. For example, the processor must be capable of operating at the low voltage. Furthermore, as discussed in more detail below, the dimensions of the processor are critical for preferred embodiments of the tool assembly when the tool assembly is designed to be insertable into a 1 inch diameter hole. It is desirable to use 1 inch wells for monitoring purposes because of the lower cost associated with drilling the wells, but there is a lack of available high-performance tools operable for use in such small holes. Although any processor satisfying power consumption and size requirements for this embodiment of the present invention could be used, the Motorola™ HC-11 processor has been identified as a preferred processor. In addition to the processor, it is also necessary to use a sensor that operates at the low voltage. A number of sensors are available that operate at voltages sufficiently low to be used with the tool assembly of the present invention. Supplies of such sensors include Lucas Nova Sensor™ and EG&G™ IC Sensors.

In addition to the computing unit, the main circuit board of the tool assembly also includes signal processing circuitry. For example, the main circuit board includes analog-to-digital converter circuitry for converting analog signals from the sensor into digital signals for use by the computing unit. The main circuit board would also include digital-to-analog converter circuitry for embodiments where the sensor requires a stimulation signal to take a sensor reading, so that digital simulation signals from the computing unit could be converted into analog signals for use by the sensor. This signal processing circuitry also must be selected to operate at the low voltage. As will be appreciated by those skilled in the art of signal processing, the circuitry associated with processing lower voltage signals typically requires more extensive filtering to ensure adequate signals for processing.

When the tool assembly transmits/receives communication signals to/from a remote device via the cable, the communication will typically be at a higher voltage than the voltage at which the computing unit operates. Typically, communication will be conducted according to a communication protocol that operates with approximately 5 volt signals, and which permits networking with a significant number of other like tool assemblies distributed over a large area. Moreover, to reduce the number of conductive lines in the cable dedicated to communication, half duplex communication is preferred. RS-485 is a preferred communication protocol for use with the present invention. It should be noted that although half duplex communication is preferred, it is possible with the present invention to conduct communications via only a single communication line, if desired. For example, communication could be conducted both directions through a single fiber optic line in the cable.

Also, it should be noted that the energy storage unit in the tool assembly, as discussed previously, must be designed to deliver power at a low voltage consistent with the low voltage signal processing requirements. In this regard, two AA cells in series typically provide power at a nominal voltage of approximately 3 volts. Alternatively, cells other than AA cells could be used that deliver power at an appropriate voltage. For example, a pair in series of AAA, N, C, D or DD cells could be used to provide a power source with a nominal voltage of about 3 volts. AAA, AA and N cells are preferred because of their small size, with AA cells being particularly preferred. Furthermore, the energy storage unit could include only a single electrochemical cell, provided that the cell is of the proper voltage. Also, any suitable cell types may be used, such as alkaline cells, nickel-cadmium cells, nickel-metal hydride or lithium cells, and the cells may be primary or secondary cells. For enhanced performance flexibility, however, lithium cells are generally preferred, primarily because lithium cells can be used over a wider temperature range, permitting the tool assembly to be used over a wider range of environmental conditions.

In another aspect of the present invention, the main circuit board also includes a capacitor or capacitors having sufficient capacitance so that when power is discontinued to the main circuit board, the capacitor(s) can continue to provide power to maintain the real time clock/calendar for at least about 30 minutes, preferably at least about 60 minutes, and more preferably at least about 90 minutes, to permit the batteries to be replaced without having to re-program the tool assembly. For example, when batteries in the tool assembly are changed, all power to the main circuit board is discontinued, but the real time clock/calendar continues to be powered by the capacitor(s) until the replacement batteries have been installed. Also, after battery power to the main circuit board is resumed, the real time clock/calendar is capable of sending an interrupt signal to the processor to cause the computing unit to resume whatever operation might have been interrupted during battery replacement. For example, the computing unit could automatically continue sampling operations according to a sampling schedule that was in effect prior to the battery replacement. The capacitor (s) are typically included on the main circuit board. Examples of capacitors that may be used include Series EL Electric Double Layer Capacitors from Panasonic, such as the Panasonic EECE0EL 104A capacitor.

Another aspect of the present invention is that the tool assembly has been designed to be insertable into a 1 inch hole, as noted previously. This is because of the significant need for high performance tools operable for use in such small diameter holes.

Because the tool assembly of the present invention, in a preferred embodiment, is designed for insertion into a 1 inch diameter hole, the outside diameter of the tool assembly must be smaller than 1 inch. Preferably, the outside diameter of the tool assembly is smaller than about 0.9 inch, more preferably smaller than about 0.8 inch and even more preferably smaller than about 0.75 inch. Particularly preferred is an outside tool diameter of smaller than about 0.72 inch. As noted previously, it is preferred that the tool assembly have a substantially tubular outside shape, with a substantially constant diameter. For such a tool assembly, there are no protrusions extending beyond the outside diameter of the tool. Similarly, should the tool assembly have other than a tubular shape, then a cross-section of the tool assembly, taken substantially perpendicular to the longitudinal axis of the tool assembly at any longitudinal location along with tool assembly, should fit entirely inside a circle having a diameter of smaller than the above referenced dimensions, depending upon the particular embodiment.

A significant aspect of the present invention is to provide an easy-to-use, high performance tool with networking capabilities for use in 1 inch diameter holes. Significant features are contained on the main circuit board disposed inside of the tool assembly. Referring again to FIG. 3, it is necessary to provide these features on the main circuit board 130 within dimensional constraints imposed by use of the tool assembly in 1 inch holes. The main circuit board 130 has a length dimension, a width dimension and a thickness dimension. The length dimension can be several inches long. The thickness dimension must be very small adjacent the walls of the housing 120, typically thinner than about 0.1 inch, preferably thinner than about 0.075 inch and more preferably thinner than about 0.06 inch. As will be appreciated, the thickness of the main circuit board 130 may be larger at locations along the board's width that are significantly away from the wall of the housing 120. For example, the thickness may range from 0.06 inch adjacent the wall of the housing 120 up to perhaps 0.31 inch or more in the center of the housing 120, depending upon the diameter of the housing 120. The width dimension must not be larger than the inside diameter of the housing 120, and from a practical standpoint must be smaller than the diameter to accommodate the thickness of the board. In that regard, it is preferred that the width dimension of the main circuit board 130 at its outer edge is smaller than about 0.8 inch, preferably smaller than about 0.7 inch, and more preferably smaller than about 0.6 inch. Particularly preferred is for the main circuit board 130 to have a width dimension at its outer edge of no larger than about 0.56 inch. It is also important that the processor be of a size to be mountable on the main circuit board 130 in a way so that the main circuit board 130, including the processor, fits inside of the housing 120. The processor has a length, width and thickness dimension. The length dimension can be quite long, but the width and thickness dimension must be carefully chosen. The width dimension of the processor is typically smaller than about 0.6 inch, preferably smaller than about 0.55 inch, and more preferably no larger than about 0.52 inch. The thickness dimension is typically smaller than about 0.1 inch and preferably smaller than about 0.075 inch. One available processor that has been found particularly useful with the present invention is the HC-11 processor from Motorola™. As noted previously, it is also important that the processor operate at a low voltage. The HC-11 processor has both a small width dimension and is operable at a low voltage.

Although a rigid circuit board is shown in FIG. 3 for use as the main circuit board 130, it is possible that such a rigid board could be replaced by a flexible circuit board that is rolled or folded to fit into the inside of the housing 120. Because of the complexity of manufacturing such a flexible board, the rigid board is preferred.

Figure 19:
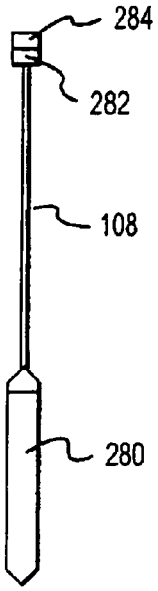
FIG. 19 is a schematic showing one embodiment for field deploying a tool assembly of the present invention.
Figure 20:
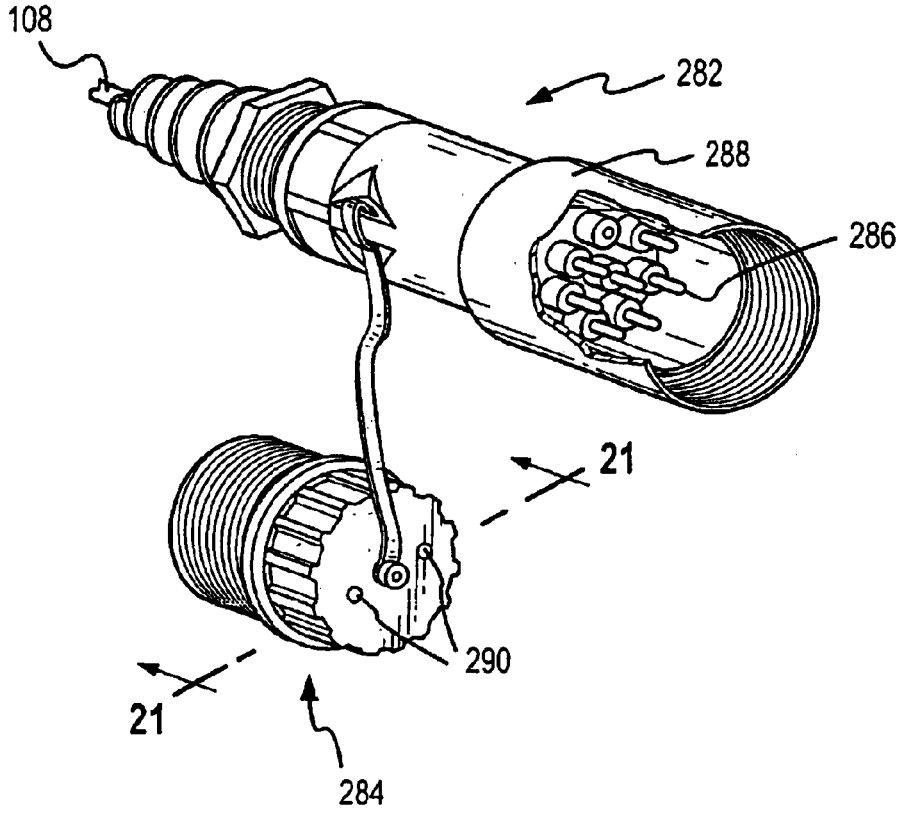
FIG. 20 is a perspective view of a connector and vent cap for use with a tool assembly of the present invention.

As noted previously, the tool assembly can be used alone or in a network with other like tool assemblies. FIG. 19 shows a single tool assembly 280 suspended from the cable 108, as would be the case when the tool assembly 280 is inserted into a hole. At the surface end of the cable 108 is an electrical connector 282, to which is attached a vent cap 284. FIG. 20 shows a perspective view of the connector 282 and the vent cap 284. As seen in FIG. 20, the connector 282 includes a plurality of connector pins 286 for interconnecting the cable 108 with other electronic devices. The connector 282 also includes a rotatable, threaded sleeve 288 into which the threaded portion of the vent cap 284 screws to protect the connector pins 286 when the connector 282 is not connected to another device. The threaded sleeve 288 rotates freely relative to the body of the connector 282 and re-tracts along the body of the connector 282 to permit access to the connector pins 286. The vent cap 284 includes vent holes 290 through the end of the vent cap 284 to permit ventilation. In that regard, the cable 108 is frequently a vented cable, as previously discussed. As seen in FIG. 20, the embodiment of the connector 282 shown includes eight locations for connector pins, but only 7 of the locations are occupied by the connector pins 286. The unoccupied connector pin location is used to key the connector 282 for connection with other devices. The cable 108 will be a vented cable at least when the sensor in the tool assembly preferably includes a pressure sensor for providing gauge pressure readings, with gauge pressure readings being pressure readings that are relative to atmospheric pressure. To be able to provide a gauge pressure reading, it is necessary that the tool assembly be in fluid communication with the atmosphere. This fluid communication is permitted, in the embodiment shown in FIGS. 19 and 20 through the vent holes 290.

Figure 21:
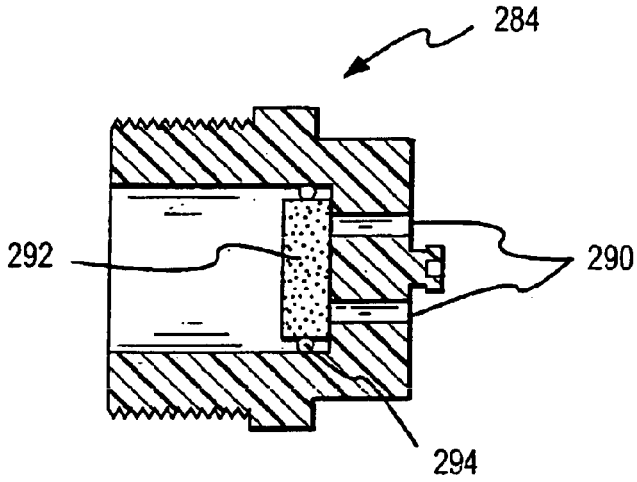
FIG. 21 is a sectional side view of the vent cap shown in FIG. 20.

So that there is not a significant build-up of moisture inside the cable 108 or the connector 282, the vent cap 284 preferably includes desiccant inside of the vent cap 284. FIG. 21 is a cross-section of one embodiment of the vent cap 284 showing a desiccant pack 292 attached to the vent cap 284 adjacent the vent holes 290, so that the desiccant pack 292 can remove moisture from air entering the vent cap 284. The desiccant pack 292 may comprise any desiccant-containing structure. Preferably, the desiccant pack 292 is a small container filled with silica desiccant, with the container being glued to the vent cap 284. Also as shown in FIG. 21, the desiccant pack 292 is sealed against the inner wall of the vent cap 284 with an O-ring 294. In a preferred embodiment, the vent cap 284 further includes a membrane (not shown) disposed between the desiccant pack 292 and the vent holes 290, to act as a further barrier to impede the movement of water into the interior of the vent cap 284. The membrane is a thin film, such as a film of polyethylene.

Figure 22:
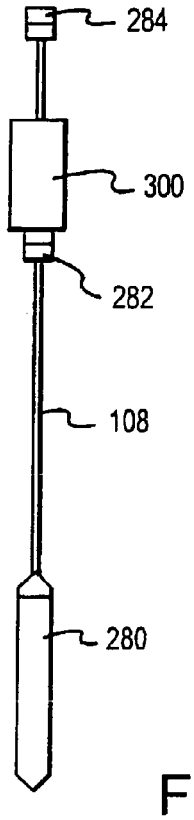
FIG. 22 is a schematic showing one embodiment for field deploying a tool assembly of the present invention.

In another aspect of the present invention, a variety of devices may be interconnected with the tool assembly via the cable from which the tool assembly is suspended during use. FIG. 22 shows the tool assembly 280 suspended from the cable 108 having the connector 282. Connected to the connector 282 is a low-voltage external power unit 300. At one end of the low-voltage external power unit 300 is the connector 282 and the vent cap 284, which are as described previously. The low-voltage power unit 300 supplies power at a low voltage consistent with the low voltage power requirements of the preferred embodiment of the tool assembly, as discussed previously. In that regard, the low-voltage power unit 300 preferably supplies power at a voltage of smaller than about 4 volts, more preferably at voltage of smaller than about 3.5 volts and most preferably at a voltage of about 3 volts or smaller. Particularly preferred is for the low-voltage power unit 300 to supply power at a nominal voltage of about 3 volts, which may be provided, for example, by two C, D or DD cells in series, although any number and any other suitable types of cells may be used in the low-voltage power unit 300. In the embodiment shown in FIG. 22, it is necessary that the cable 108 include at least four electrical conductors, with at least two of the conductors being dedicated to communication (half duplex communication) and at least two other of the conductors being dedicated to supplying power to the tool assembly 280 from the low-voltage external power unit 300.

Figure 23:
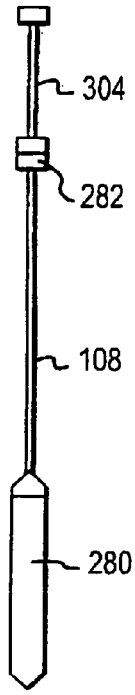
FIG. 23 is a schematic showing another embodiment for field deploying the tool assembly of the present invention.

Another possibility for providing external power to the tool assembly the present invention is shown in FIG. 23. As shown in FIG. 23, a vented external power cable 304 is connected via the connector 282 to the cable 108. The vented external power cable 304 is adapted for connection with a high-voltage external power source (not shown). The high-voltage external power source would deliver power at a voltage of larger than about 5 volts, typically in a range of from about 5 volts to about 8 volts, and most preferably at a voltage of about 6 volts. The high-voltage external power source may be any suitable power source, and may be provided from batteries or a transformer off of line power. A typical source for the high-voltage external power source is one or more 12 volt batteries supplying power that is stepped down to about 6 volts. In the embodiment shown in FIG. 23, the cable 108 will typically include at least four conductors, with at least two of the conductors dedicated to communication (half duplex communication) and at least two other of the conductors dedicated to supplying power to the tool assembly 280 from the high-voltage external power source.

With the embodiment shown in FIG. 23, it is typically necessary that the power supplied by the high-voltage external power source be stepped-down to a lower voltage, preferably to a voltage of smaller than about 4 volts, more preferably smaller than about 3.5 volts, with a stepped-down voltage of about 3.3 volts being particularly preferred. Stepping-down of the voltage could occur at the surface, but preferably occurs in the tool assembly 280, and even more preferably occurs on the main circuit board within the tool assembly 280. Also, with the tool assembly of the present invention, it is sometimes desirable to maintain a grounding for the sensor and other electronic components of the tool assembly that is isolated from the grounding of the high-voltage external power source. This is desirable for operation of many sensors to provide accurate sensor readings. For example, the operation of electrochemical sensors in direct contact with an aqueous liquid would be significantly impaired if separate groundings are not maintained. In other instances, maintenance of separate groundings is not required. For example, a pressure sensor completely encased to prevent direct contact with the fluid would not require isolated groundings. When separate groundings are to be maintained, an isolation barrier is typically provided on the main circuit board of the tool assembly 280. The isolation barrier steps down the voltage while maintaining a separation between the groundings of the high-voltage external power source and the sensor in the tool assembly 280. This isolation barrier is typically provided by circuitry for a transformer coupled switching regulator located on the main circuit board.

In a preferred embodiment, the cable from which the tool assembly of the present invention is suspended during use includes at least six conductors, with at least two of the conductors being dedicated to communication (half duplex communication), at least two of the conductors being dedicated to delivery of power from a low-voltage external power source (such as described with respect to the low-voltage external power unit shown in FIG. 22) and at least two of the conductors dedicated for delivery of power from a high-voltage external power source (such as described with respect to FIG. 23). In a particularly preferred embodiment, the cable includes exactly six conductors, so that the cost of the cable is kept to a minimum, while providing significant flexibility in the utility of the tool assembly. Conductors dedicated to delivery of external power will be electrically conductive lines. In a preferred embodiment the conductors dedicated to communication are also electrically conductive lines, but could alternatively be optically conductive lines, such as fiber optic lines.

Figure 24:
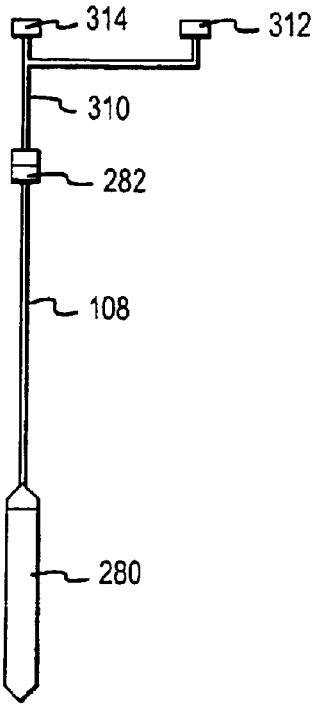
FIG. 24 is a schematic showing another one embodiment for field deploying the tool assembly of the present invention.

Referring now to FIG. 24, another embodiment demonstrating the flexibility of the tool assembly of the present invention is shown. As shown in FIG. 24, attached to the connector 282 at the surface end of the cable 108 is a multiple connector cable 310 including a first connector 312 for connecting with a high-voltage external power source (in a manner as previously described with reference to FIG. 23) and a second connector 314 for making a communication connection, such as to a personal computer or palm top computer to obtain logged data from the tool assembly 280 or to update programming of the tool assembly 280. Because the tool assembly of the present invention typically transmits low voltage communication signals using a communication protocol that is different than that employed by most other devices, including most personal computers, the multiple cable connector unit 310 should preferably include a converter to convert from the communication protocol used by the tool assembly 280 to the communication protocol used by a personal computer, palm top computer or other device that may be connected through the second connector 314.

For most applications, this converter will convert communication signals from an RS 485 protocol to an RS 232 protocol. The communication converter is preferably incorporated into the second connector 314.

As noted previously, a significant aspect of the present invention is that the tool assembly of the present invention is, in one embodiment, networkable with other like tool assemblies. In that regard, at least one, and preferably each one, of the tool assemblies in a network is capable of transmitting, under the direction of the computing unit, a communication signal causing at least one other tool assembly (the receiving tool assembly) in the network to perform an operation, typically involving the taking of a sensor reading. Frequently, the receiving tool assembly will be directed to initiate a sampling schedule, which may involve changing from an existing sampling schedule to a new sampling schedule, as previously described. Preferably each of the tool assemblies in a network is capable of both transmitting and receiving communication signals. Furthermore, a tool assembly transmitting a communication signal is capable of saving in its memory information indicating that a communication signal was transmitted to the receiving tool assembly, and the receiving tool assembly is capable of saving in its memory information indicating that the communication signal was received from the transmitting tool assembly.

In a one embodiment, when the tool assemblies are networked, more than one, and preferably substantially all, of the tool assemblies in the network are programmed to transmit a communication signal in the network based on the occurrence of an event identified by the transmitting tool assembly as having occurred. For example, when a network of tool assemblies are deployed along a water course or other drainage area, identification by one tool assembly of the occurrence of a significant increase in a pressure sensor reading (indicating the presence of an increased head of water) causes that tool assembly to transmit a communication signal to one or more other tool assemblies in the network, directing the receiving tool assemblies to change the sampling schedule to a more frequent interval between sensor readings. This type of deployment of a network of the tool assemblies would be useful, for example, to monitor storm water runoff in areas of interest. In one embodiment, a communication signal transmitted by one tool assembly is transmitted to the other tool assemblies in the network, and the other tool assemblies are each capable of analyzing the signal and determining whether an operation is to be performed. In another embodiment, a central network controller could make the determination and send a control signal to direct that an operation be performed. For example, the tool assemblies could be connected to a network controller which would determine whether a sampling schedule change is appropriate, based on predefined criteria, for any of the tool assemblies, including the tool assembly originally identifying the occurrence of an event. The tool assembly identifying the occurrence of an event would transmit a signal and the controller would determine whether a sampling schedule change should be made in that tool assembly or any other tool assembly in the network. The controller would then send a signal or signals directing the appropriate tool assembly or tool assemblies to change the sampling schedule.

In a preferred embodiment, the tool assemblies in a network are capable of directly communicating with each other, without the need for a central network controller. If desired, however, such a central controller could be used to receive and interpret a signal generated by a tool assembly and transmit an appropriate command signal to direct one or more other tool assemblies to perform the desired operation. Such a central controller will typically be a personal computer or palm top computer, although any other suitable network controller could be used.

Not all of the tool assemblies in the network need to contain the same sensor capabilities. For example, one or more of the tool assemblies may contain a pressure sensor for monitoring for an increase in water head, and one or more other tool assemblies may contain different sensors for monitoring one or more other condition. For example, the other tool assemblies could include a turbidity sensor, a chlorophyll sensor or one or more type of electrochemical sensors for monitoring a condition indicative of the quality of water. An electrochemical sensor could, for example, monitor for pH, oxidation-reduction potential (ORP), dissolved oxygen (DO), or dissolved nitrates (or any other specific dissolved ion). In this situation, for example, when one tool assembly including a pressure sensor identifies the occurrence of a predefined increase in water head, as indicated by an increased pressure sensor reading, the tool assembly would transmit a communication signal to direct (with or without the aid of a network central controller) at least one other tool assembly to the network, including an electrochemical sensor, to either commence a sampling schedule or to change the sampling schedule to a more frequent interval between sensor readings. In this way, not only can the movement of storm water runoff be monitored, but water quality conditions of the runoff can also be monitored.

Figure 25:
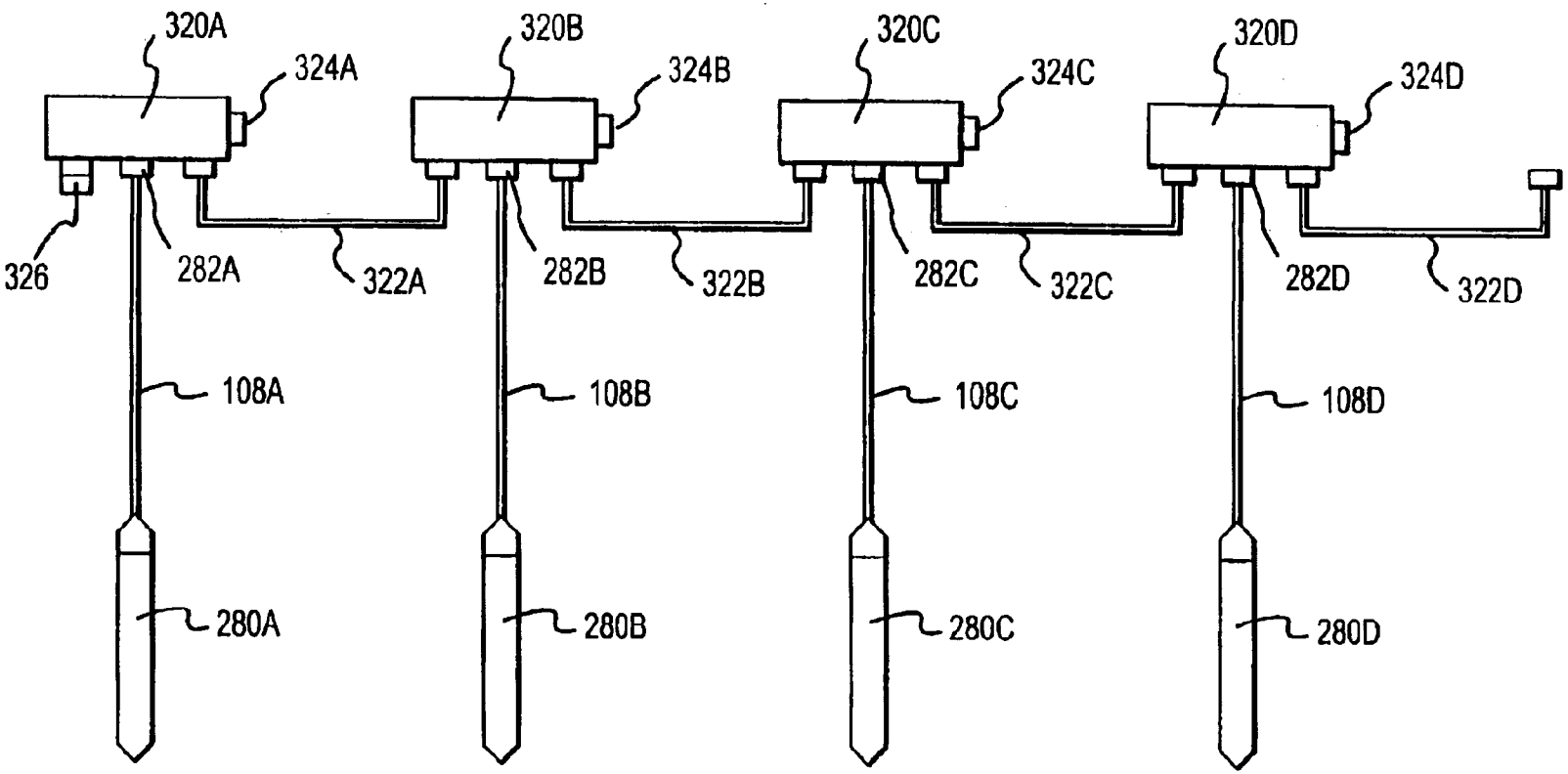
FIG. 25 is a schematic showing one embodiment for field deploying a tool assembly of the present invention in a network with other like tool assemblies.

A significant aspect of the present invention is that the tool assembly is specifically designed for field deployment, such as in monitoring wells located along a water course or other drainage area, in monitoring wells in fluid communication with an aquifer or directly in a river, lake, ocean or other water feature. As typically field deployed, each of the tool assemblies is suspended from the cable. FIG. 25 shows a network of four of the tool assemblies 280 suspended from the cables 108. Each of the cables 108 is connected into a network junction box 320, from which the tool assemblies 280 are connected into a network by network interconnect cables 322. Because each of the cables 108 is a vented cable, each of the network junction boxes 320 includes a vent cap 324, having a design similar to that of the vent cap previously discussed with reference to FIGS. 20–23. The first network junction box 320A has a free connection location that is capped by a connector cap 326 to prevent moisture from entering into the first network junction box 320A.

With continued reference to FIG. 25, the final network interconnect cable 322D is typically connected to a high-voltage power supply of higher than about 10 volts, and preferably about 12 volts, such as could be provided by 12 volt batteries or by a line connection with power stepped down to approximately 12 volts. In a preferred embodiment, power delivered through the network interconnect cables 322 to the network junction boxes 320 is stepped down in each of the junction boxes 320 prior to delivery of power to the corresponding cable 108. Typically, the power is stepped down for delivery to the cable 108 to a voltage of from about 5 volts to about 8 volts (preferably about 6 volts). As discussed previously, the voltage is further stepped down in the tool assemblies 280 to a voltage of typically smaller than about 4 volts, preferably smaller than about 3.5 volts, and more preferably to a voltage of about 3.3 volts. In this embodiment, the network is operating at a voltage of higher than about 10 volts, the cables 108 are operating at a voltage of from about 5 volts to about 8 volts, and the tool assemblies 280 are operating at a voltage of smaller than about 4 volts.

Figure 26:
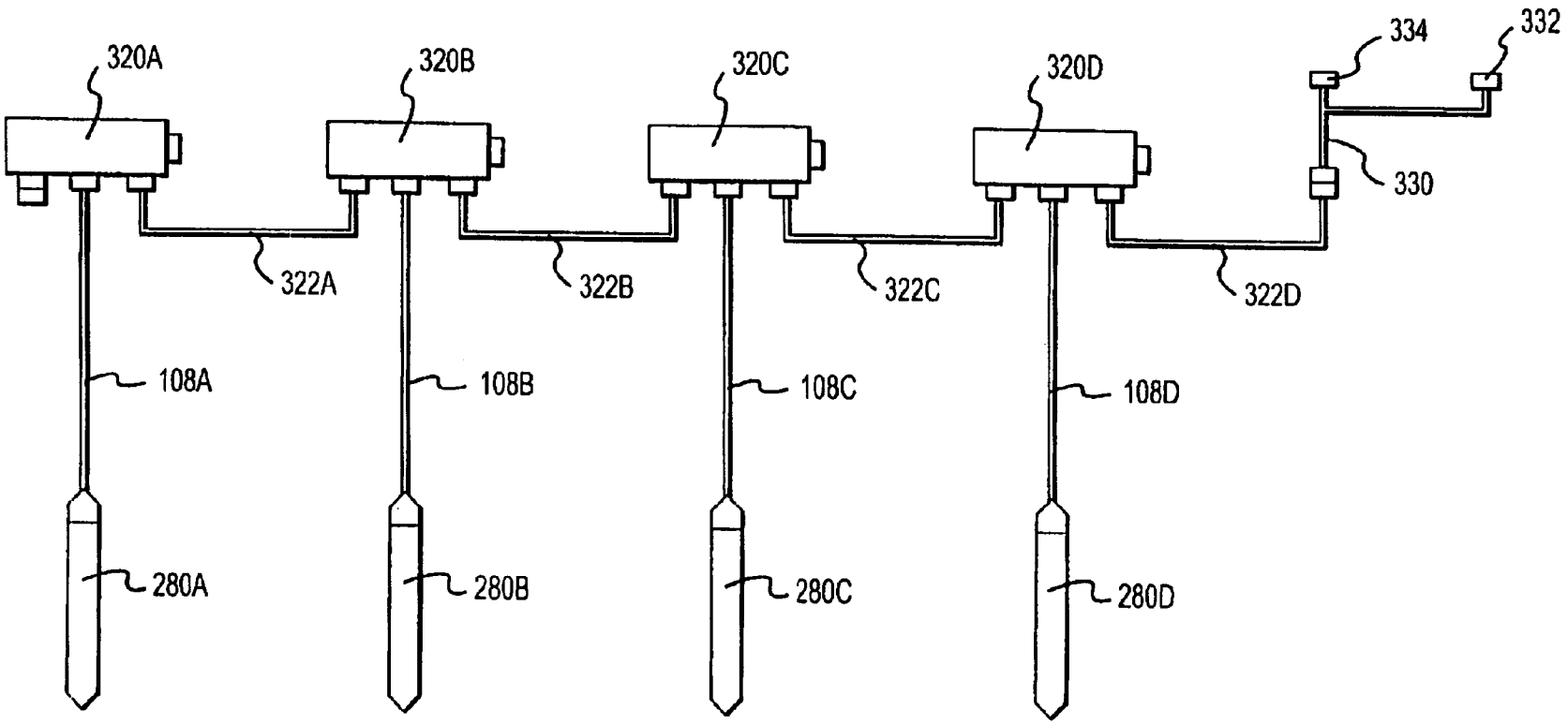
FIG. 26 is a schematic showing another embodiment for field deploying a tool assembly of the present invention in a network with other like tool assemblies.

With the present invention, there is significant flexibility with respect to use of a network of the tool assemblies. As one example, reference is made to FIG. 26. FIG. 26 shows the same network of four of the tool assemblies 280 as shown in FIG. 25, except that the last network interconnect cable 322D is connected to a multiple cable connection unit 330. The multiple cable connection unit 330 includes a first connector 332 to connect with a power source and a second connector 334 to make a communication connection. The communication connection may be to a personal computer or palm top computer that may be temporarily or permanently interconnected to communicate with the network, or may be to a communication device, such as a telemetry unit to permit telemetric communication from and to the network. Other communication connections could be made, such as via modem or otherwise.

Figure 28:
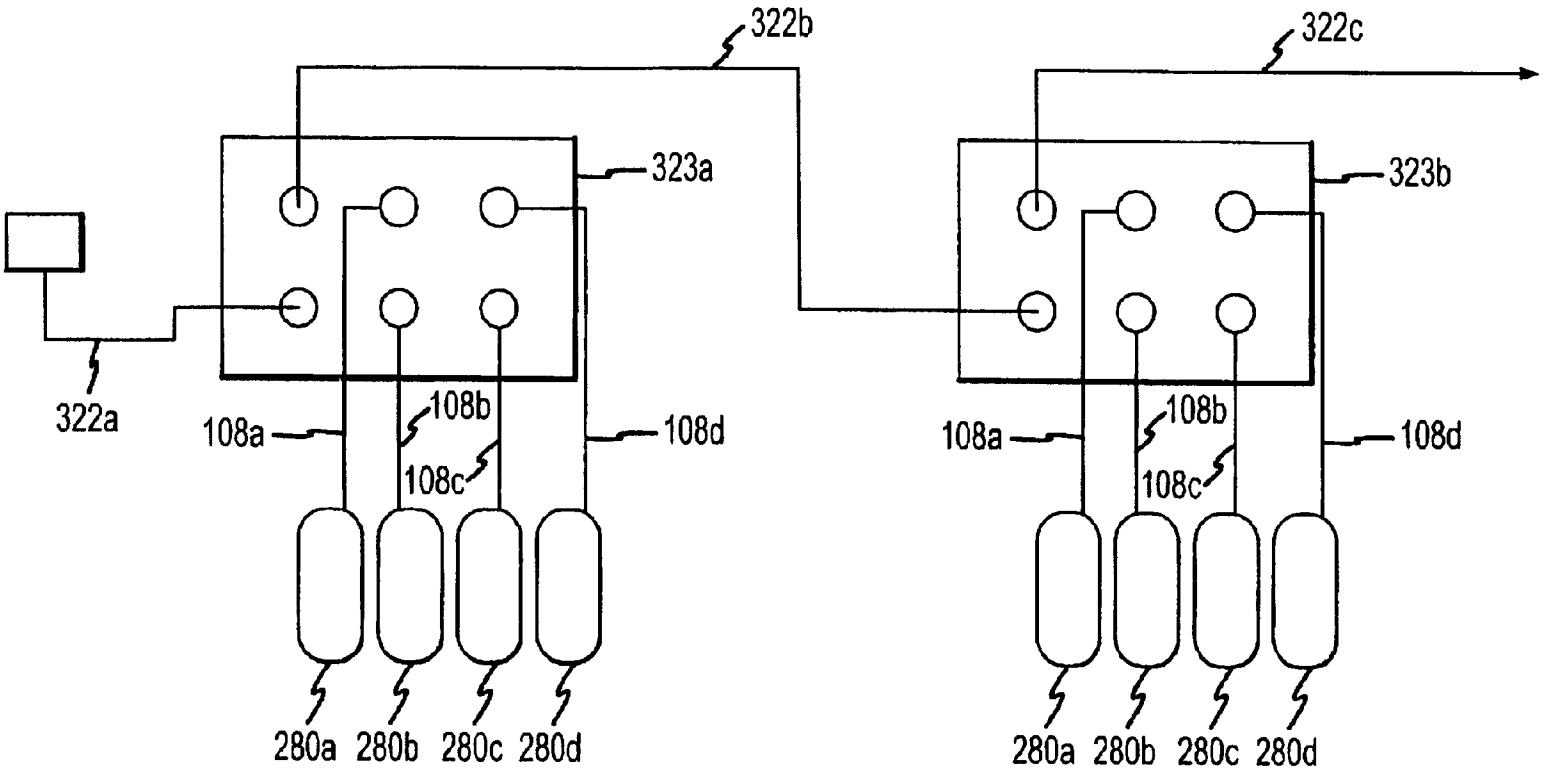
FIG. 28 is a schematic showing another embodiment for field deploying a tool assembly of the present invention in a network with other like tool assemblies.

As an alternative to the networked configurations shown in FIGS. 25 and 26, the networked junction boxes 320 may replaced by a quad connection box which provides for the interconnection of four tool assemblies to the network through a single box. Disclosed in FIG. 28 is diagram of networked tool assemblies using a number of quad boxes. Included in the diagram are at least eight tool assemblies 280 suspended from cables 108. Each of the cables is directly connected to quad box 323, which provides for the connection into the communications network. Interconnection cable 322*a* provides connection to a power source for the tool assemblies. The power requirements for the tool assemblies are substantially the same as those described above with regards to the configuration shown in FIGS. 25 and 26. Cables 322*a* and 322*b* may provide electrical connections between other quad boxes. Cable 322*a* may be further connected to a communications device so as to provide a connection to a central controller device either directly or through a telemetry interface.

A significant design feature of the tool assembly of the present invention is that the tool assembly has been designed for use in small diameter monitoring wells. For some applications, however, the tool assemblies will be used directly in a river, lake, ocean or other water feature, where the size constraints of a small diameter monitoring well are not present. Although the tool assembly, as described previously, can be used for these applications, it is often desirable to have multiple sensor capabilities available in a single unit for these applications. In one aspect of the present invention, the tool assembly may be in the form of a tool bundle to provide multiple sensor capabilities in situations where tool size is not a significant constraint.

Figure 27:
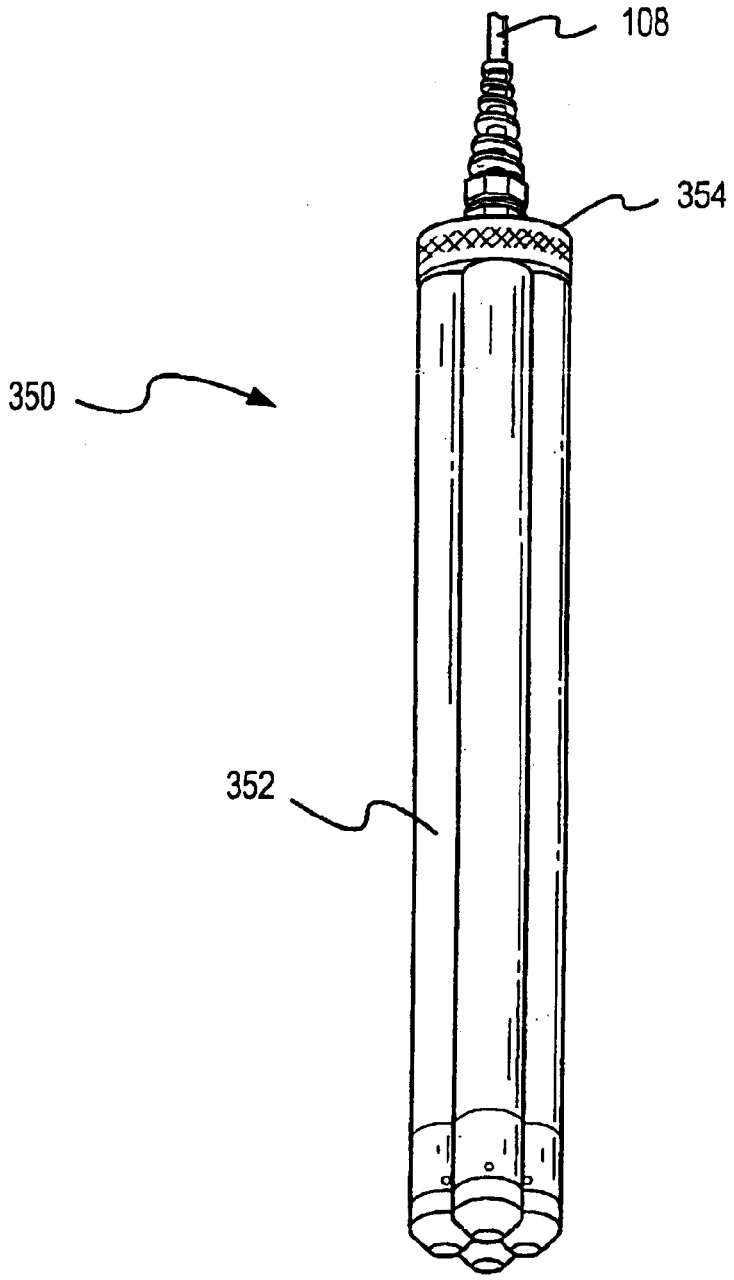
FIG. 27 is a perspective view of an embodiment of a tool assembly of the present invention in the form of a tool bundle including four monitoring tools, to provide a number of sensor capabilities in a single unit.

Referring now to FIG. 27, a tool assembly 350 in the form of a tool bundle is shown. the tool assembly 350 includes four monitoring tools 352 attached to a single cable component 354, which connects the monitoring tools 352 with the cable 108. Each of the monitoring tools 354 include the capabilities as discussed previously with the tool assembly embodiments 100, 220 and 280 referred in FIGS. 1–26. For example, each of the monitoring tools 352 could include a sensor and a main circuit board that is capable of being networked. In a preferred embodiment, the monitoring tools are comprised of either the control unit 102 and the sensor unit 106 of the tool assembly 100 (FIGS. 1–6 and 9), or the combined control/sensor component 222 of the tool assembly 220 (FIGS. 7 and 8). Rather than being assembled with the cable component 104 (FIGS. 1–9), however, the monitoring tools 352 are assembled with the cable component 354. Preferably, the connections of the monitoring tools 352 to the cable component 354 are made using the same rotatable engagement connector structure as previously described. For example, each of the monitoring tools 352 could be a combined control/sensor component 220 (FIGS. 7 and 8) each rotatably engaged with a different threaded nipple on the cable component 354 in a manner to electrically interconnect each of the monitoring tools 352 with the cable component 354. When connected in the tool bundle, the monitoring tools 352 are, in effect, a miniature network of monitoring tools 352, and can interact in any of the ways previously described for networked tool assemblies. Moreover, the tool bundle of the tool assembly 350 can be further interconnected in a broader network via the cable 108. Moreover, each of the monitoring tools 352 may include a different sensor capability. For example, one of the monitoring tools 352 could include a pressure sensor and the other monitoring tools 352 could each include a different electrochemical sensor. In this way, the tool bundle can be operated as a multi-parameter water quality probe. Also, it should be appreciated that as shown in FIG. 27, the tool bundle includes four of the monitoring tools 352, but tool bundles of a larger or smaller number of the monitoring tools are also possible.

As was disclosed above the tool assemblies described herein are connectable in a network to comprise a monitoring system. A central controller may be employed as part of the monitoring system to provide centralized control and access to each of the tool assemblies connected to the network. In the network, many of the tool assemblies may be located at very remote locations with respect to the central controller such that some mode of long distance communication must be employed for the various components of the system to communicate. Disclosed below are a number of different modes communication which may be employed in the monitoring system.

Figure 29A:
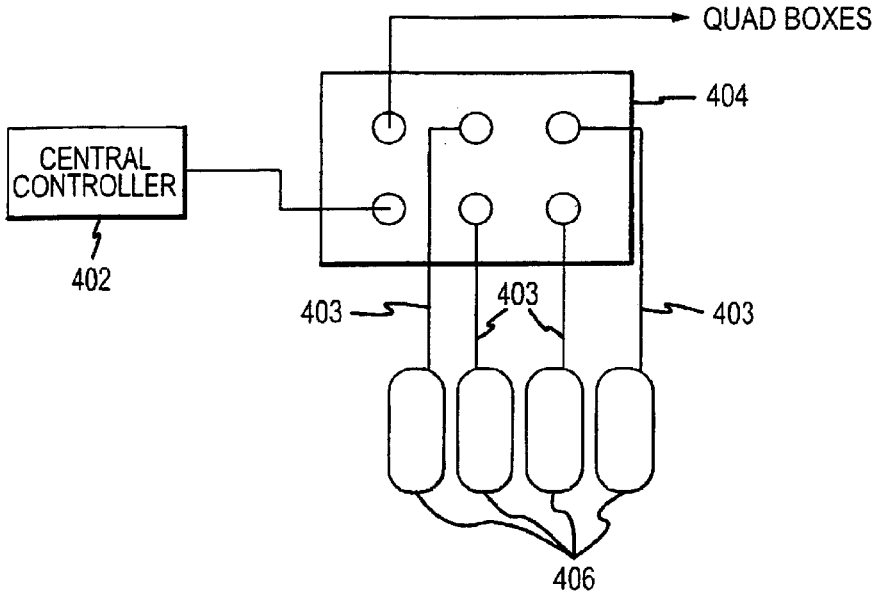
FIGS. 29*a–d* are system diagrams, which show the various configurations of the communication network.

Disclosed in FIGS. 29*a*–*d* are system diagrams for various configurations of communications network within which one or more of the tool assemblies may communicate with a central controller. In short, the communications networks disclosed provide a communications medium between one or more of the tool assemblies and the central controller such that data employed for performing various test may be exchanged between these components. Disclosed in FIG. 29*a* is one configuration of the communications network where a direct electrical connection is established between central controller 402 and quad box 404. Connected to the quad box 404 are a number of tool assemblies 406. Further connections may be established from the quad box shown to other quad boxes on the network. With regards to this configuration, communications cable 403 has been disclosed in detail above with regards to cable 108 shown in FIGS. 19–22 of the present application. Alternatively, the configuration shown in FIG. 29*a* may be simplified such that a communications cable 403 is employed to establish a direct electrical connection between the central controller and a single tool assembly.

Figure 29B:
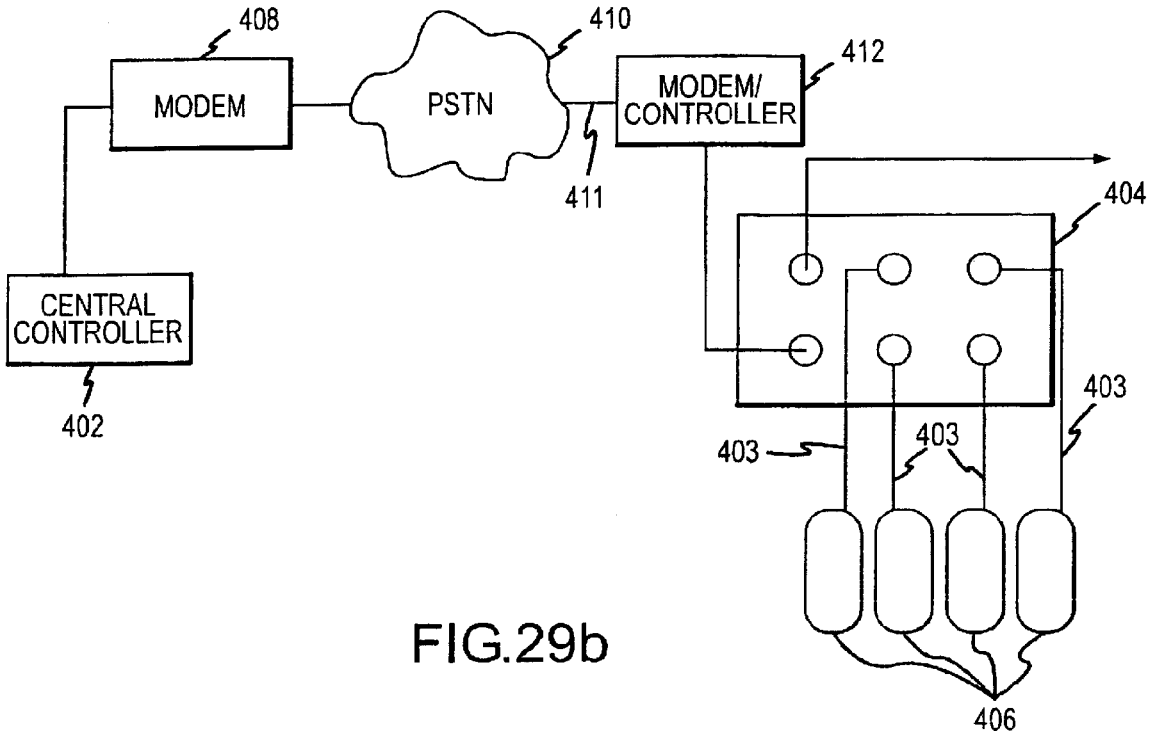

Disclosed in FIG. 29*b* is a configuration of the communications network in which the public switch telephone network (PSTN) 410 is employed as the medium for communications. In order to employ the PSTN, the central controller 402 is equipped with, or is in connection with, a modem 408. The modem is employed to establish a telephonic connection from the central controller over the PSTN 410. At a remote location, the modem/controller 412 is also employed to establish a connection with the PSTN 410. The modem/controller 412 is in communications with a quad box 404 which in turn is connected to each of the tool assemblies 406. Functionality is also included in modem/controller 412 to establish telephonic connections over the PSTN. The communications line 411 may comprise hard telephone line, or the modem/controller may comprise a cellular telephone device, which is employable to establish a telephonic over the PSTN via a wireless connection. Although a network of tool assemblies is shown, it is conceivable that the present network configuration may be employed to communicate with just a single tool assembly, where a direct connection is established between modem/controller 412 and a single tool assembly through communications cable 403.

The modem/controller 412 may comprise any number of devices. One possibility may be a palmtop computer such as a pocket PC or a Palm Pilot which includes a modem and has been configured to provide certain amount of data processing for the tool assemblies connected to the network as well as establish connections over the PSTN. The palm top computer may perform a number of different tasks in that in addition to providing a line of communication this device may provide most or all of the computing capability of the central controller locally. More specifically, the palm top computer may be configured such that all the processes of the central controller which are described in great detail below, may be performed by the palm top computer at the remote locations proximate to the tool assemblies themselves. In another configuration of the invention, the palm top computer may be employed to provide emulation functionality for allowing tool assemblies which employ a certain set of standards to communicate with a network which employs a different set of standards. Programming included in the palm top computer would allow the device to make the necessary conversions so that the different devices can communicate.

Figure 29C:
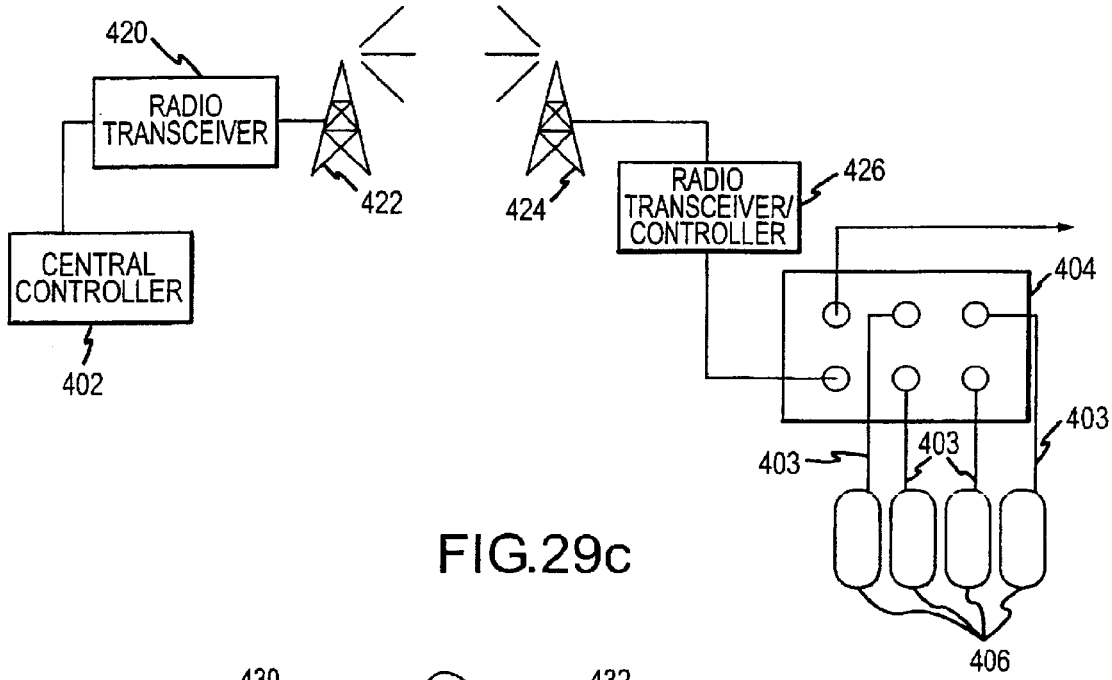

Disclosed in FIG. 29*c* is yet another configuration of the communications network wherein radio transceivers are employed to provide for the exchange of signals between the central controller 402 and the remotely located tool assemblies. In this configuration, a radio transceiver 420 is in electrical connection with central controller 402 and it is configured such that data signals received from the central controller are converted to electromagnetic signals, which are transmitted via an antenna 422. At the remotely located site is antennae 424 which in turn is connected to radio transceiver/controller 426. Transceiver/controller 426 is configured to receive and transmit radio signals and to communicate with the tool assemblies 406 through at least one quad box. 404 Although a network of tool assemblies is shown, it is conceivable that the present network configuration may be employed to communicate with just a single tool assembly, where a direct connection is established between transceiver/controller 426 and the single tool assembly. The transceiver/controller 426 further provides for transmitting signals generated by the tool assemblies to transceiver 420 and central controller 402 for processing.

Figure 29D:
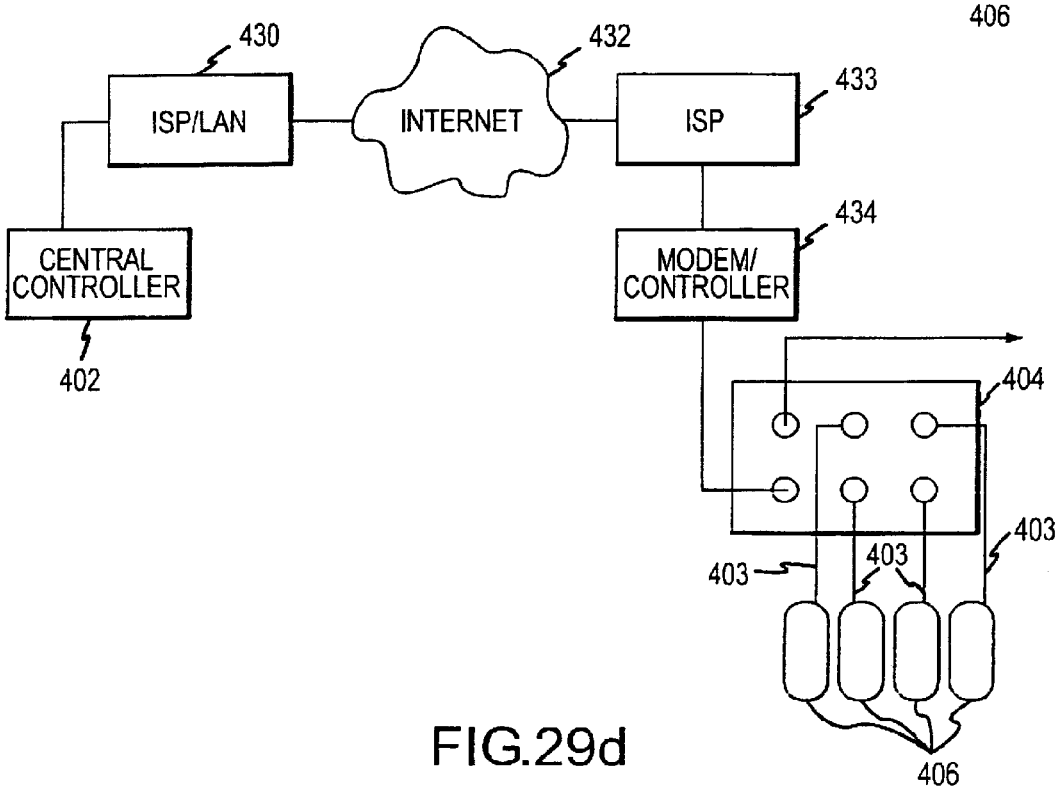

Disclosed in FIG. 29*d* is yet another configuration for the communications network. In this configuration, a data network such as the Internet or a local area network (LAN) may be employed as the medium to establish a line of communication. In one configuration of the invention, the central controller 402 may establish a telephonic connection with an Internet Service Provider (ISP) 430 through which connections may be established over the Internet to the modem/controller 434, either through ISP 433 or directly to modem/controller 434 if it is employed as a node on the data network. The modem controller 434 would also provide for the transmission of data signals back to central controller 402 over the Internet 432. One skilled in the art would realize that although only four configurations for a communications network are disclosed herein, any number of different configurations may be employed for establishing a line of communication between a central controller and one or more tool assemblies connected to a communications network.

Figure 30:
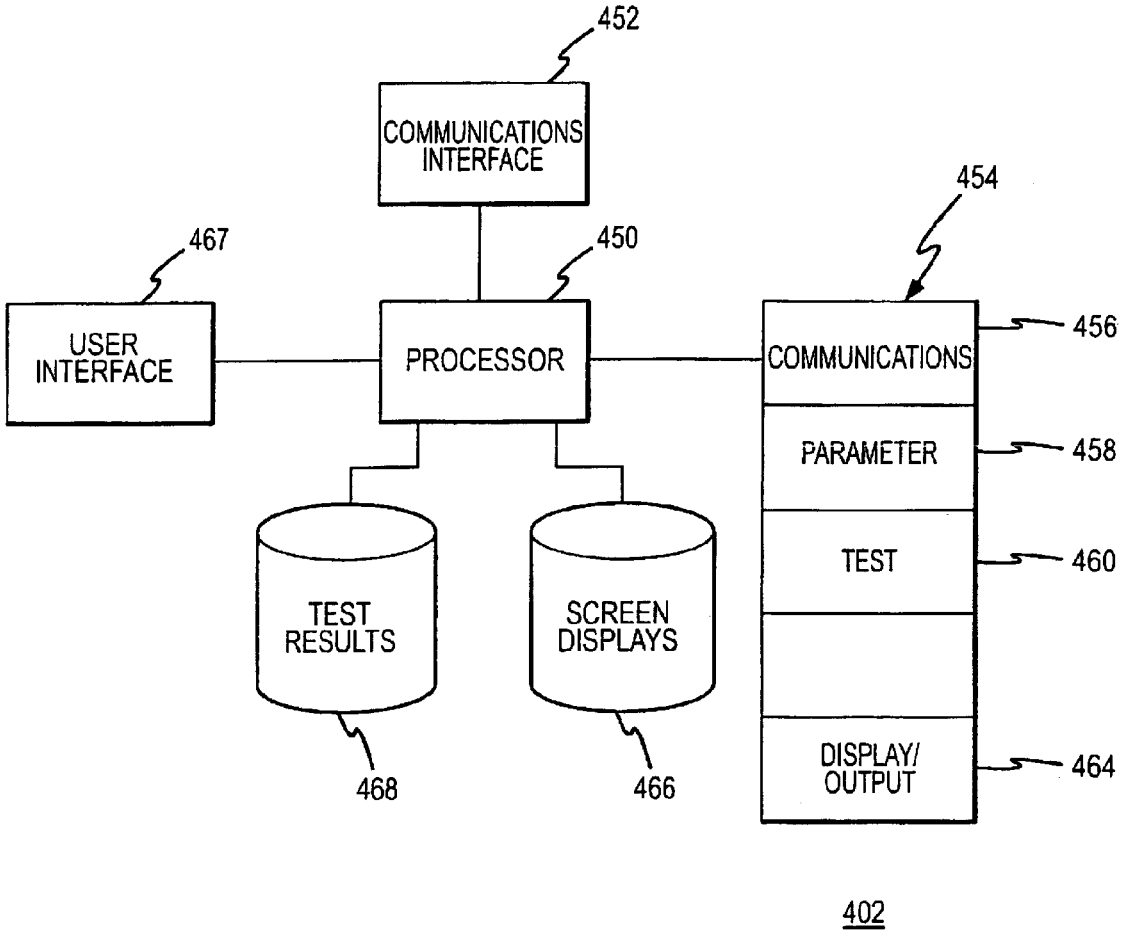
FIG. 30 is an internal system diagram for the central controller employed to communicate with the networked tool assemblies.

As part of the monitoring system described herein, the central controller 402 is specially configured to perform various functions with regards to communicating with the one or more tool assemblies connected in a network configuration. In one configuration of the invention, the central controller 402 may be a personal computer, palm top computer or other computing device upon which a monitoring system has been installed. A palm top computer may be especially advantageous because it is employable at the remote sites where the tool assemblies are located. Disclosed in FIG. 30 is a system diagram, which shows in particular the monitoring system configuration for the central controller 402. Included in the central controller 402 is processor 450, which provides for internal routing of signals and execution of various processing modules. In electrical connection with the processor is communications interface 452 which provides for the processing of signals, which are received and transmitted from the central controller. The interface includes the necessary protocols for communicating over the different communications networks described above.

Also in connection with processor 450 is random access memory (RAM) 454, within which a number of the processing modules are loaded for performing the various functions of the monitoring system. The various processing modules may be initiated either automatically or through the receipt of various user inputs received from user interface 467. In one configuration of the invention, the user interface 467 may comprise a computer monitor, keyboard and mouse.

Returning again to the processing modules in RAM 454, included therein are communications module 456 which is employed to identify tool assemblies connected to the network as well the generation and transmission of messages over the communications network, a parameters modules 458 which is employed to display or change various parameter settings the tool assemblies employ when performing tests, tests module 460 which is employed to load automated tests schedules on to the tool assemblies, manually initiate test programs and to extract test data from selected tool assemblies, and finally a display/output module 464 which is employed to display various screen displays through the user interface such that various user commands may be received and processed.

Also included in the central controller 402 are a number of databases which are employed to store information either generated by components in the communications network or used in operations of the monitoring system. Specifically, database 466 is used to screen displays which are presented on the user interface such that system users may view system data and/or initiate various system functions. In on configuration of the invention, the monitoring system described herein maybe configured such that it operates in a Windows type environment and includes a number of pull-down menus and directory tree type structure for organizing information. For example, the communications network information may be organized in a screen display such that each COM port for the computer may be presented with its own node in a tree type directory structure. Beneath each of the COM port nodes may be a listing of the tool assemblies, which communicate with the monitoring system through that particular node. Further, below each tool assembly node in the directory tree structure may be additional nodes which provide access to additional information about the particular tool assembly. These nodes may include information about the parameters with which the tool assembly is employing to take measurements as well test information relating to the particular tool assembly.

Associated with each node in the directory structure may be a screen display which presents information about the particular selection that has been made. With use of these display tools, the system user may move between screen displays to view information or initiate various functions which will be described in greater detail below.

Also included in the central controller 402 is a tests results database 468. This database is employed store and organize information which has been extracted from the various tool assemblies.

Figure 31:
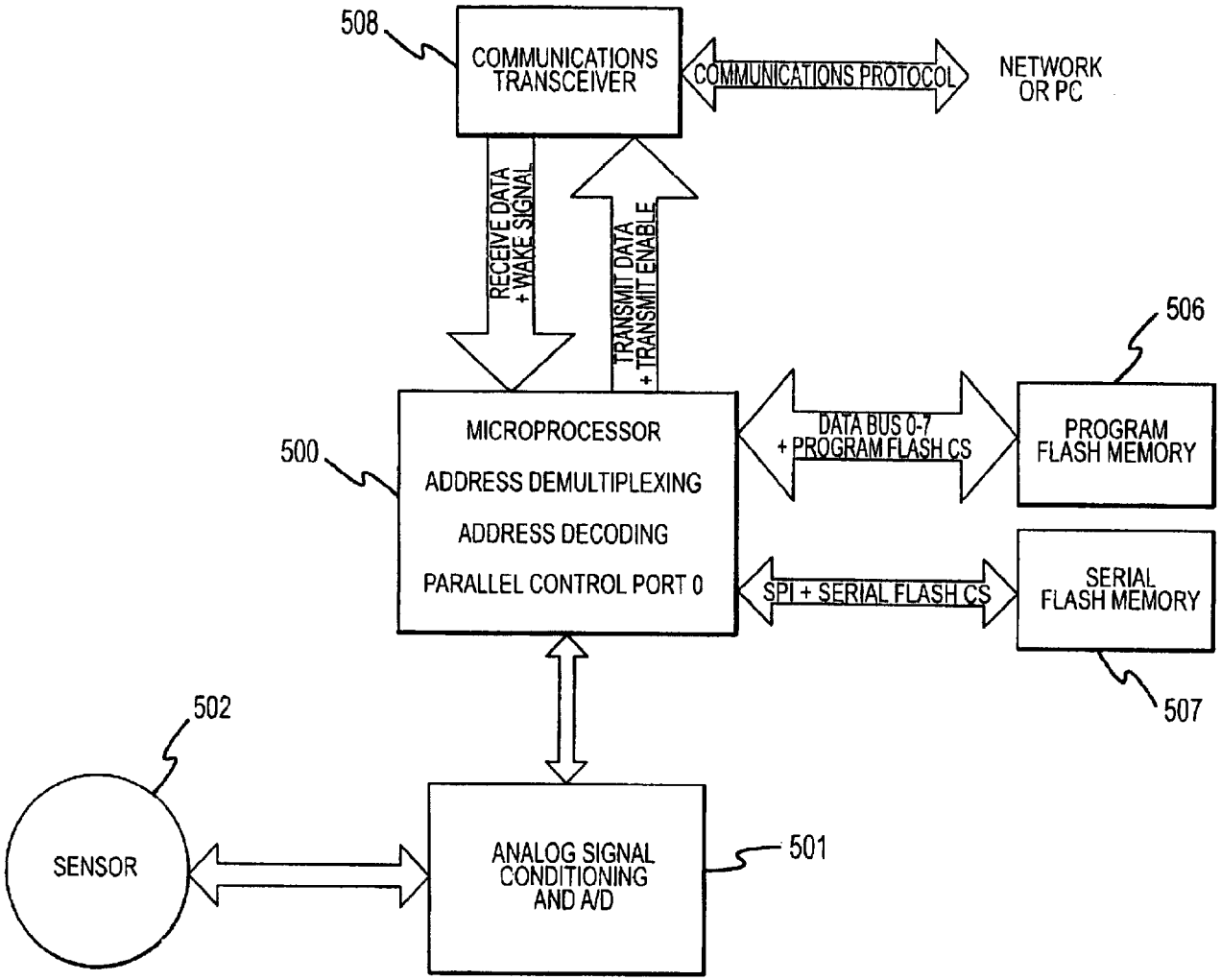
FIG. 31 discloses an electrical system diagram for the tool assembly.

As was described in great detail above, the tool assemblies described herein are configured to be positionable at locations remote from the central controller and to perform various tests according to programming received from the central controller. As an example, the tool assemblies may comprise a down well pressure probe which are connectable to the communications network. The down well probes include the functionality to take pressure readings at various times, store this data in a local memory and then provide this data when requested by the central controller. Disclosed in FIG. 31 is an electrical system diagram for a tool assembly which is connectable to the communications network. Included in the tool assembly is a microprocessor 500, which provides for the internal routing of electrical signals and the execution of various programming included in firmware stored in memory. In connection with microprocessor 500 is a communications transceiver 508. This transceiver performs a conversion to between communications formats for signals transmitted from the tool assembly over communications network. The transceiver also provides for format conversion of signals received over the communications network.

Also in connection with the microprocessor 500 are the program flash memory 506 and the serial flash memory 507. The program flash memory 506 is employed to store the version of firmware which the tool assembly is employs for its operation. Incorporated in the firmware are a number processes which the tool assembly employs in various aspects of its operation. Some of the processes are described in greater detail below. The serial flash memory 507 is employed to download any firmware upgrades as well as store data accumulated during tests by the tool assembly. Also in connection with the processor 500 is A/D converter 501 which processes signals generated by pressure sensor 502.

Figure 32:
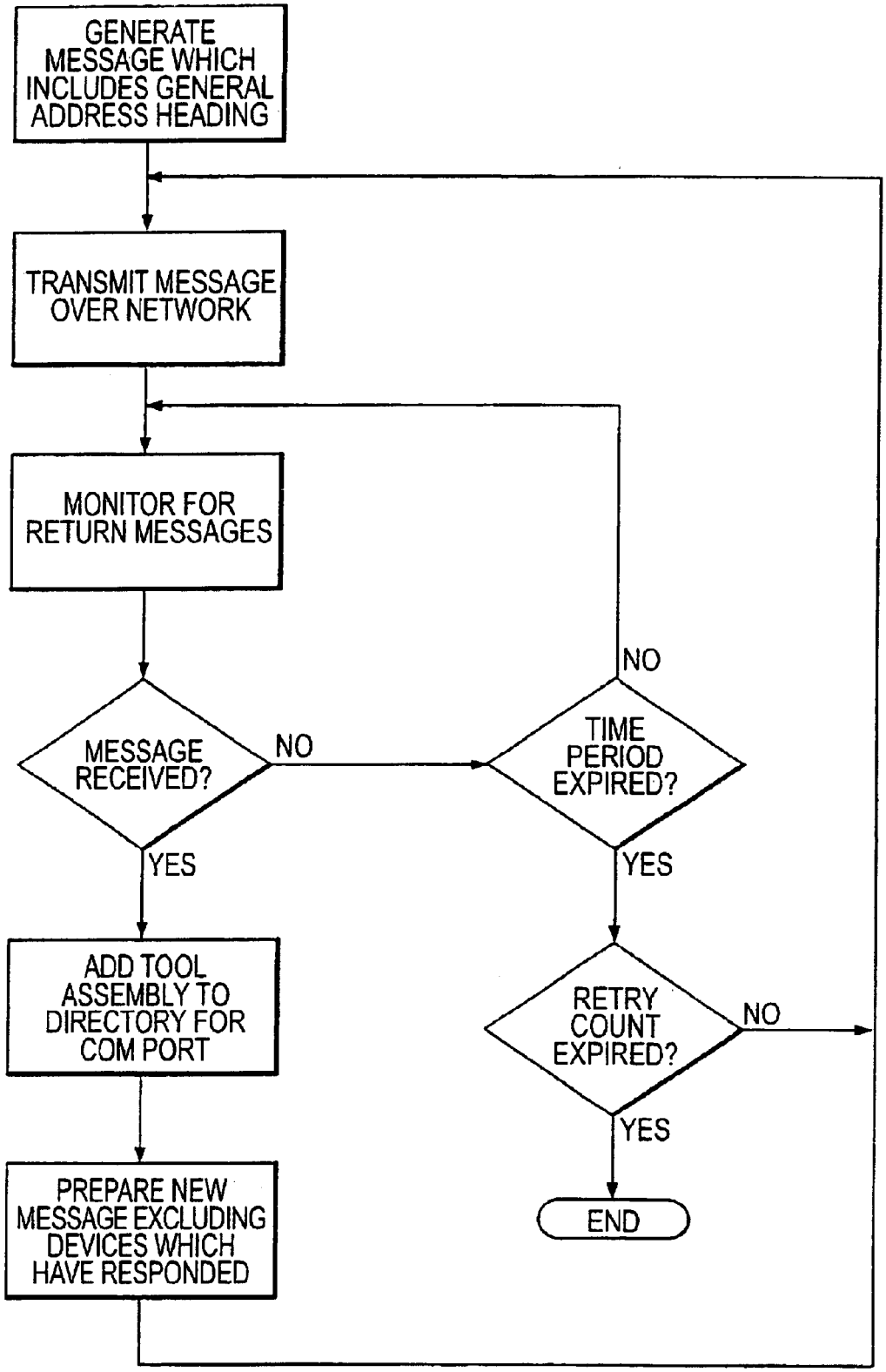
FIG. 32 discloses a flowchart, which describes the steps performed by the central controller in identifying tool assemblies connected to the communications network.

In operation, the monitoring system employed for communicating with the various tool assemblies is initially installed on the central controller. Once operational, a first step to be performed is to identify the tool assemblies which are connected to the network. In order to perform this function, the communications module 454 disclosed in FIG. 30 may be employed. Disclosed in FIG. 32 is a flow chart which describes the steps performed by the communications processing module in identifying which tool assemblies are connected to the communications network. As an initial step a selection may be by a system user as to which communications node will be analyzed. Once this selection is made, a general identification message is generated and transmitted over the data network such that each tool assembly connected to that particular node will receive the message. In one configuration of the invention, communication between components is established through use of a message based system. The message to be transmitted are comprised of data packets wherein the message includes a address header which identifies the message destination. The communications network employed herein is "open" in that each of the components connected to the network receives all of the transmissions, but only processes those message that are either addressed specifically or are addressed generally.

Returning again to the flow chart of FIG. 32, each tool assembly which receives the message, will generate a reply message, which the central controller in turn will wait to receive. As each reply message is received at the central controller, the information provided by the replying tool assembly is logged in memory and may be presented on a screen display in the tree type directory structure. A listing for the probe is also added to the directory for the corn port being employed.

If multiple tool assemblies are connected to the communications network, it is possible that two or more tool assemblies may transmit a reply message at the same time, thus creating the situation where only one or none of the reply messages is received by the central controller. As such, the central controller has been configured such that each of the tool assemblies may have multiple opportunities to reply if a particular message is not received by the central controller. Returning again to FIG. 32, when the central controller receives reply messages, it continually updates a list of tool assemblies connected to the communications network which have responded to the message. After the receipt and processing of each reply message, a new general message is generated and transmitted requesting that all tool assemblies on the network identify themselves. Additional instructions are included in the new general message which directs the tool assemblies which have already responded, not to respond further.

Upon transmission of the new general message, the central controller will wait a selected time period in order to receive a reply. If no reply is received after the time period has elapsed, the central controller will retransmit the message. The central controller will again wait a period of time in order to receive a reply message. If no reply message is received after set number retries of the general message the process will end and the tool identification process will be complete.

The reply message received from the tool assemblies may include detailed information about the configuration of the tool assembly. This information may include such items as communication type, serial number of the assembly, name of the location, manufacture date of the assembly, calibration date of the assembly, hardware version installed in the assembly, firmware version, storage capacity, battery type, battery installation date, battery capacity, as well as microprocessor run time. This information is displayable for all tool assemblies which provide a reply message. In the situations where connections are being established from more than one central controller, information gathered during one connect session may be saved in a file and employed by other central controllers.

Once all of the tool assemblies on a particular COM port are identified, the monitoring system may be employed to transmit messages to one or more of these components. As was described above, each of the each of the tool assemblies runs on a energy conservation mode, or "sleep" when not communicating with the central controller or performing tests. One feature which has been incorporated into the system to further conserve energy is a selective activation process for selectively activating one or more tool assemblies when desired, without activating all the tool assemblies connected to a node. Messages which are generated by the central controller and transmitted to the individual tool assemblies are in the form of a data packets, which include an identifying byte in the header of the message. Included with the information stored about each of the tool assemblies stored in the central controller, is an multi-bit address header, which the central controller may employ when transmitting messages to particular tool assemblies. A general header may also be used in outgoing message to which all the tool assemblies will reply.

Figure 33:
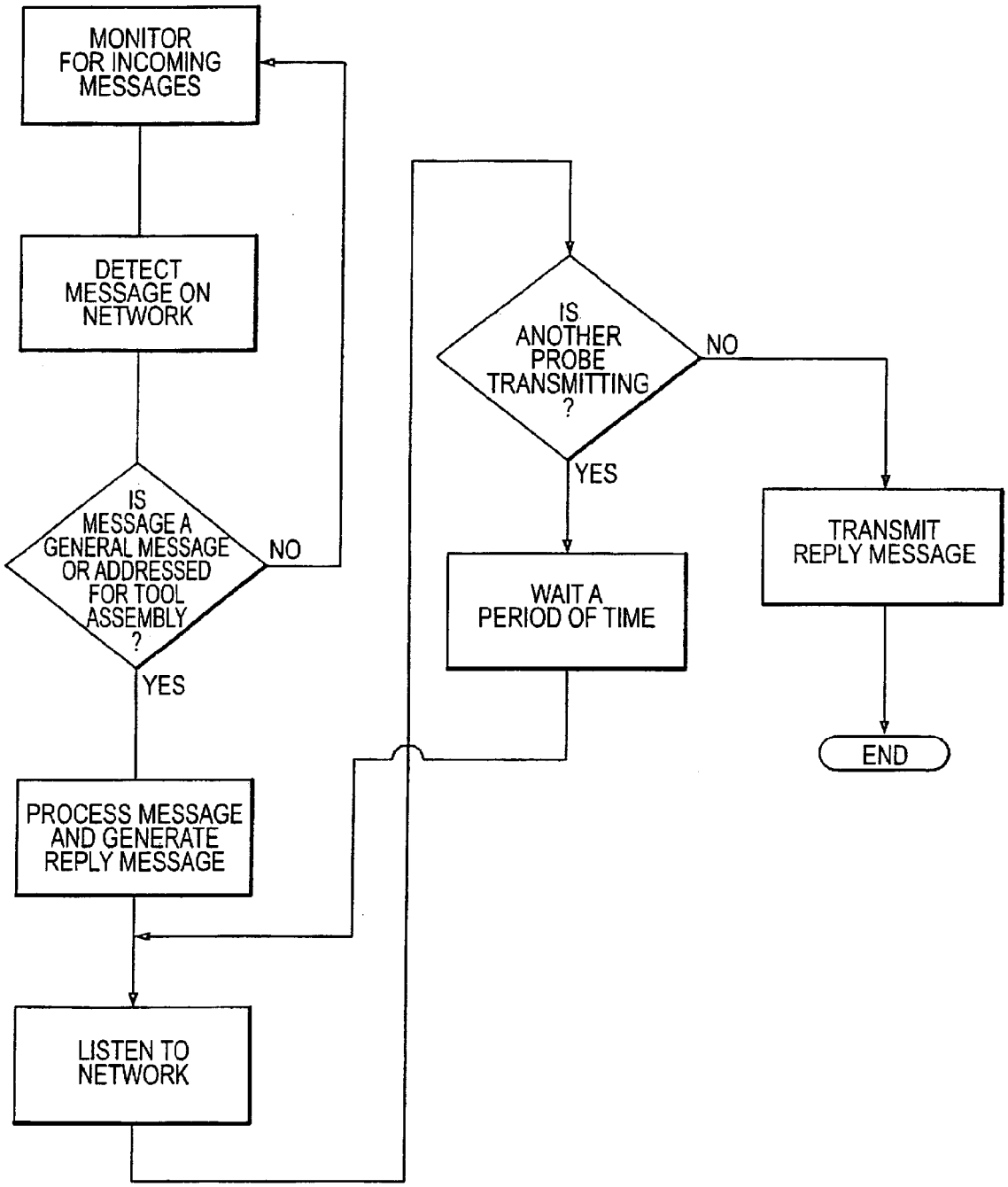
FIG. 33 is a flowchart, which describes the steps performed by each of the tool assemblies connected to the communications network when transmitting messages to the central controller.

Disclosed in FIG. 33 is a flowchart which describes the step performed by each of the tool assemblies which receive the messages. As was described above, each of the tool assemblies operates in a sleep mode wherein the tool assembly is turned off for the most part and is only operational to the extent that it monitors messages transmitted over the communications network. When the tool is in the "sleep" mode, it continually monitors the network for signals received and only activates when a message is detected which is addressed to the particular tool assembly or has a general message header.

Returning again to the flowchart in FIG. 33, during the sleep mode, a tool assembly will detect the receipt of an incoming message and perform the limited function of determining whether the message header includes the address for that particular tool assembly. Once the header is read, a query is made as to whether the message is a general message to which all tool assemblies connected to the communications network must respond. If this is so, the tool assembly is activated and the message is received and processed. If this is not a general wake-up message, the tool assembly makes a determination as to whether the message is addressed to that particular tool assembly. If the multi-bit message address matches the address for the particular tool assembly, it activates and begins processing the received message. If the multi-bit message address does not match the address for the particular tool assembly, the assembly stays in the sleep mode and continues monitoring incoming messages received over the communications network.

Also related to the selected activation of tool assemblies, is another feature incorporated into the system which provides a level of certainty that when messages are generated and transmitted over the data network, replies are indeed received from all the tool assemblies which have been addressed. As was described above, one draw back of having an open communications network such as that described herein, is that when the central controller sends out a general message in which all the tool assemblies are to reply, the possibility exists that all of the tool assemblies will reply at the same time thus interfering with each other. According to the invention described herein, the tool assemblies is configured to provide some certainty that all reply messages from the tool assemblies are received by the central controller.

Returning again to the flowchart disclosed in FIG. 33, once an incoming message is determined to be a general message or addressed to that tool assembly, the tool assembly will activate, receive and process the message. After the processing is performed, the tool assembly will generate a reply message to be sent back to the central controller. At this point, the tool assembly will first monitor the communications network to determine if any of the other tool assemblies are currently replying. This monitoring step is performed so that two or more tool assemblies will not reply at the same time. If a determination is made that another tool assembly is currently replying, the replying tool assembly waits a period of time then check the network again to determine if any other tool assemblies are replying. If no other reply messages are detected, the tool assembly will transmit its reply to the central controller. The tool assembly will continue to try to transmit a reply message until a clear network is detected.

As was described above, the situation may occur where two tool assemblies do reply at precisely the same time to a general message and thus interfere with each other. As was described above, the central controller will periodically regenerate the message and transmit it so that the non-replying tool assemblies may respond. Once the messages are received, the steps disclosed in FIG. 33 are performed again by the tool assemblies.

The monitoring system described herein is employable by a system user to perform a number of different functions with regards to the one or more tool assemblies connected to the communications network. As was described in FIG. 30, the central controller 402 includes a number of processing sub-modules which may be selectively employed to perform various monitoring functions. In particular, the parameters sub-module 458 is used to view and amend any parameters which the tool assembly employs in performing its designated functions. The parameters are stored in the flash memory for the tool assembly, and are provided to the central controller during the initial tool assembly identification process. In the configuration of the invention where the tool assembly is a down well probe, pressure readings are taken by the probe in order to determine, among other things, water depth at the probe location. It may be advantageous to periodically change the context in which the pressure reading are taken in order to perform various analyses. For example, pressure readings may be taken purely at the pressure head which is a display of raw pressure exerted by the column on water of the pressure sensor. The pressure measurement may also incorporate depth which may convert the pressure of the water column to a depth reading in meters, centimeters or inches. In the situation where surface water elevations are measured, a pressure reading may be converted to a surface water elevation. Further, in the situation where the draw down in a ground water well is being measured, as the water level decreases, this may result in an increased reading. Still further, at various points-in-time, the system user may initiate an extraction of data from a particular tool assembly so that the test results may be compiled and viewed. As with the other functions, a message for the particular tool assembly is generated and transmitted to said tool assembly and the tool assembly responds by compiling information with regard to the specified test and transmits such information back to the central controller for further processing.

When a system user wishes to view or amend a particular parameter of a tool assembly, the listing of tool assemblies connected to a particular communications node may be displayed on the user interface and the tool assembly may be selected in order to view sub categories for the particular tool assembly, which parameters is included. When parameters is selected, this information is then viewable. In one configuration of the invention, a screen display is provided which displays all the parameter information with regards to a particular tool assembly. Through dialog boxes presented in the screen display, various parameter information may be entered or amended. If a system user wishes to add change parameters for a particular tool assembly, a message is generated by the central controller which includes the parameter information as well as an address heading for that particular tool assembly. This generated message is then transmitted over the communications network and once received by the tool assembly, implemented into its programming. Although the discussion above with regards to parameters is directed to ways of measuring pressure in a probe, one skilled in the art would realize that depending on the type of sensor used, these change in parameters may be directed at any number of measurable values.

Yet another processing module employed in the monitoring system described herein is directed to programming and implementing tests in the tool assemblies. Using the directory tree structure described above, the system user may select to view information about tests programmed into a particular tool assembly. Tests to be performed are stored on the flash memory for the tool assembly and a listing of the tests is provided to the central controller during the initial tool assembly identification process described When this selection is made, a screen display may be presented which includes this program information. As was discussed previously, each of the tool assemblies include processing capability and memory. Stored into memory may be a number of automated tests which the tool assembly has been programmed to perform at designated intervals. When a system user selects to go into the testing mode for the system, the system user may retrieve and view information with regards to tests currently programmed into the device. This may be done for each of the tool assemblies individually. When viewing the information, the system user may have the option to manually initiate a program test or add a new test. When adding a test, certain information and/or internal information may be entered, such as the type of test (linear, event, or linear average). Other options may be to program tests using adaptive scheduling. Steps performed in employing adaptive scheduling will be described in greater detail below.

Further items which may be programmed for tests include measurement intervals for taking readings in an automated test as well as the point-in-time which a test is to begin. Once necessary information for the new test or the amended information is entered, the central controller may compile and transmit a message to the particular tool assembly instructing the assembly to load and execute the test.

As an additional feature of the system described herein, the system user may have the option of manually initiating or terminating a test. The selection may be made through a dialog box in a screen display, and in turn, the central controller will generate a message for the particular tool assembly and transmit the same. According to the protocols described above, the central controller will then wait for a reply message either indicating that the test has begun or it has been stopped according to instructions.

As was discussed above, one mode of performing tests is called adaptive scheduling. Through use of adaptive scheduling, space in the flash memory for the tool assembly may be conserved by only storing data points measured after the occurrence of significant events. A test may be programmed to be performed when a particular condition is detected, a customized monitoring program may be initiated and the data which is collected during this time period is specially identified. One example of a time when such a program may be employed is when a water table is monitored for such conditions as flooding or flash floods. When a significant event occurs which causes the water table rises, this condition is detected it may be advantageous to provide a continuous monitoring of the situation while it exists and then to discontinue the monitoring once the situation has passed.

Figure 34:
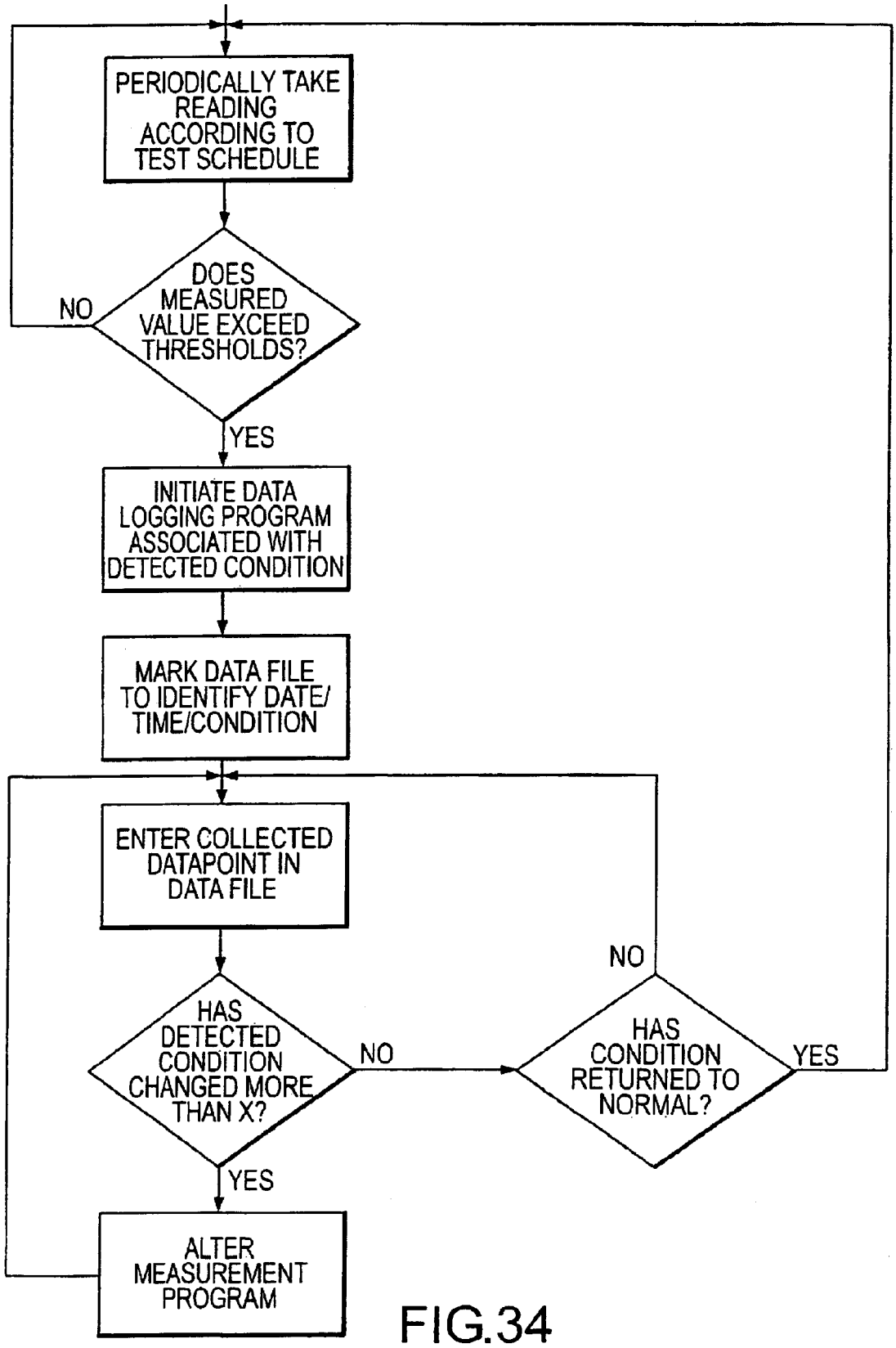
FIG. 34 is a flowchart, which describes the steps performed by a tool assembly to collect data during the adaptive scheduling process.

Disclosed in FIG. 34 is a flowchart which describes in detail the step performed by a tool assembly during adaptive scheduling and monitoring. Initially the tool assembly may be operating in a mode where measurements are taken at set intervals but are not stored in memory. During the monitoring, a particular condition may occur which exceeds a threshold value for the monitoring condition. If this threshold value is exceeded, the tool assembly will access memory and retrieve a test program designated for monitoring conditions during the particular detected condition. As part of initiating the test program, an identifier is added to the first page of data collected by the tool assembly indicating such things as the date/time/condition of the initial event detected. From that point, data points may be periodically taken and stored in the data pages. In order to conserve memory, it is not necessary to associate dates and times with data points that follow as long as the readings are taken after known periods.

As the tool assembly continues it's monitoring, it may detect that the measured condition has changed in a significant way which requires the use of another test program. For example, if the measured water level exceeds a particular value during a rainstorm, the frequency of readings taken may need to increase. When any type of change in test occurs, another identifier is added to the data page on which the new data points begins. As with the previous program, it may include date, time and condition which required the change. As was described above, additional readings may then be taken without the necessity of adding date or time information.

As the monitoring and the taking of data points continues, it may then be detected that the measured condition falls below the threshold of value and back to a "normal". At this point, the employment of the customized program may be discontinued and the tool assembly monitoring returned to the idle mode wherein it only takes readings periodically and does not store them in memory.

Yet another function performed by the test processing module of the central controller includes the extraction of test data from the tool assemblies. When viewing particular tests for a tool assembly a selection may be made to extract data from the tool assembly for that particular test. Specifically, a system user may select the particular tool assembly in the directory tree structure and navigate to one of the existing tests in the tool assembly. At this point, a selection may be made to extract test data from a particular tool assembly for that test. In order to perform the above functions, the central controller will generate a message which is transmitted over the communications network and detected by the particular tool assembly. Once the message is received, the tool assembly will perform steps extract the selected test data from the flash memory. This information is transmitted back to the central controller in a form of a message and through use of display/output module 464 disclosed in FIG. 30 and included in the central controller, the test information may be presented in the desired format.

Figure 35:
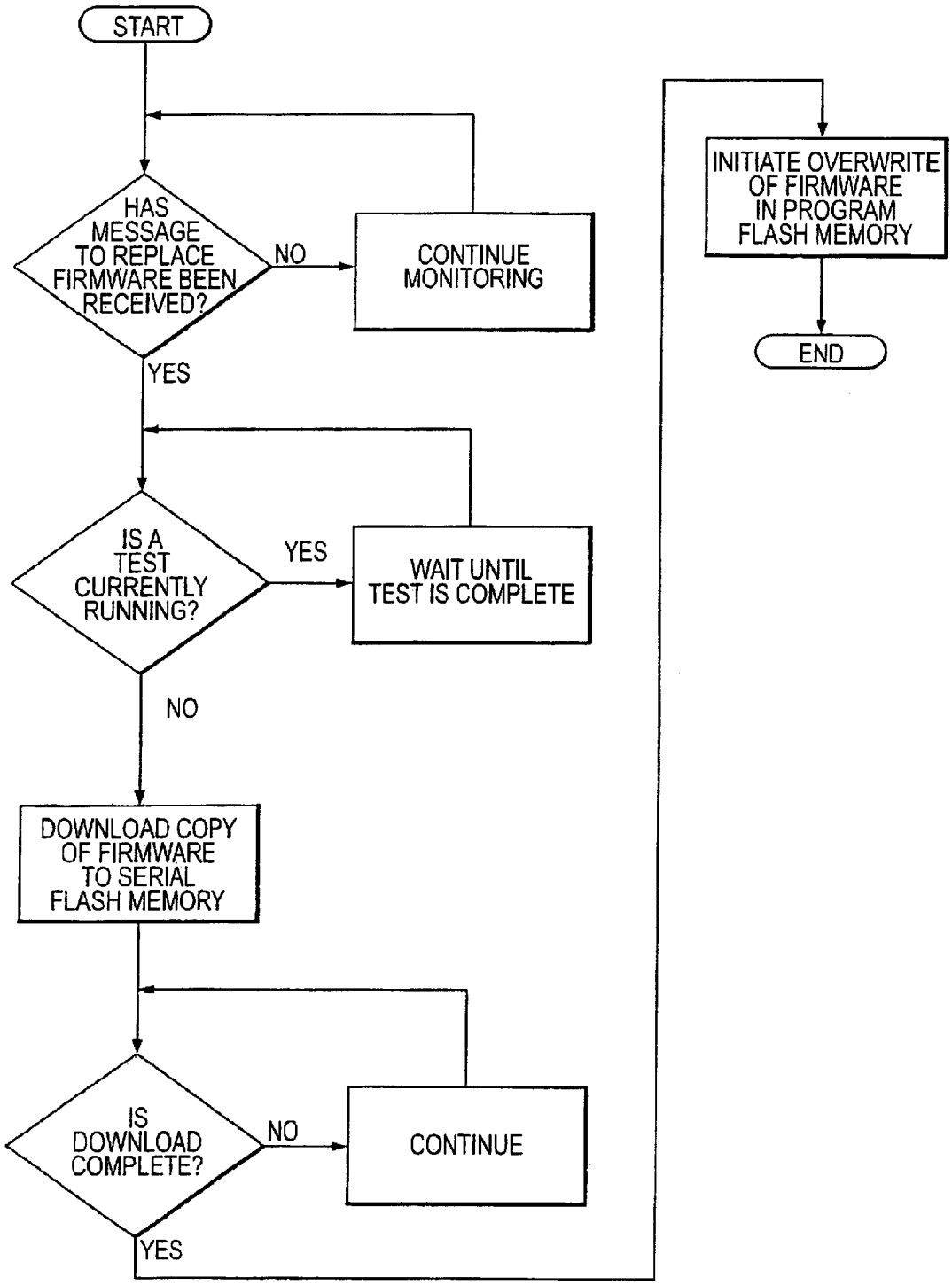
FIG. 35 is a flowchart, which describes the steps performed in the upgrading or replacement of firmware in a tool assembly connected to the communications network.

One further feature of the system described herein is the functionality for a system user to update the firmware in a particular tool assembly as the firmware becomes available. Through the process described herein, it is done in a manner which ensures the integrity of the existing firmware as well as the new version which has been downloaded. To perform this process, a selection may be made to manually upgrade or replace the existing firmware. This selection may be made through use of an interactive screen display. If this selection is made, the central controller first identifies the appropriate firmware to be transferred and generates a message which includes the firmware. This message is then transmitted over the communication network to the particular tool. The steps performed by the tool assembly in downloading of the firmware is disclosed in FIG. 35.

Initially, the message is received from the central controller indicating that the firmware is to be downloaded. The tool assembly may at that point indicate that a test is being performed and the download cannot occur until the testing is complete. This is purely as an extra precaution to protect integrity of the firmware on the tool assembly. One skilled in the art would realize that the system may be configured such that the test can be performed and firmware downloaded at the same time. Once it is determined that a test is not currently running, an entire copy of the upgrade firmware is downloaded directly into serial flash memory 507, as shown in the system diagram of FIG. 31. The current version of the firmware is resident on the program flash memory 506. At any point after that the microprocessor may initiate a transfer of the upgrade firmware from the serial flash memory to the program flash memory. At this point the old firmware is overwritten. Once the transfer of the upgraded firmware is complete, a message is generated and transmitted back to the central controller indicating that the upgrade of the firmware was successful.

Various embodiments of the present invention have been described in detail. It should be understood that any feature of any embodiment can be combined in any combination with a feature of any other embodiment. Furthermore, adaptations and modifications to the described embodiments will be apparent to those skilled in the art. Such modifications and adaptations are expressly within the scope of the present invention, as set forth in the following claims.

What is claimed is:

1. A tool assembly adapted for insertion into a well or other hole to direct monitoring of at least one condition existing in the well or other hole, the tool comprising:

an elongated housing with first and second ends, where the second end includes an opening sized to receive and provide access to one or more energy storage units insertable therein;

a computing unit positioned within the elongated housing and connectable to at least one sensor which is configured to provide a sensor reading of at least one monitored condition, the sensor reading comprising a sensor output signal including sensor reading data corresponding to the at least one monitored condition, the computing unit being configured to receive and process the sensor output signal, wherein the computing unit is capable of directing the obtainment of sensor readings according to at least two different sampling schedules a main circuit board positioned within the elongated housing, the main circuit board including at least one electrical contact positioned to contact one or more electrodes of the one or more energy storage units components upon insertion through the opening of the second end; and an electrical assembly including the at least one electrical contact and an electrical circuit configured to conduct electrical signals between the second end of the elongated housing and the computing unit.

2. A tool assembly adapted for insertion into a well or other hole to direct monitoring of at least one condition existing in the well or other hole, the tool comprising:

an elongated housing including a first end which comprises a removable sensor component configured to engage and disengage with the first end, the sensor component further including at least one sensor positionable therein, where the at least one sensor is configured to provide a sensor reading of at least one monitored condition, the sensor reading comprising a sensor output signal including sensor reading data corresponding to the at least one monitored condition;

said elongated housing further including a second end, where said second end includes an opening sized to receive and provide access to one or energy storage units insertable therein;

a computing unit positioned within the elongated housing and connectable to the at least one sensor, the computing unit being configured to receive and process the sensor output signal, wherein the computing unit is capable of directing the obtainment of sensor readings according to at least two different sampling schedules;

a main circuit board positioned within the elongated housing, the main circuit board including at least one electrical contact positioned to contact one or more electrodes of the one or more energy storage units components upon insertion through the opening of the second end; and an electrical assembly including the at least one electrical contact and an electrical circuit configured to conduct electrical signals between the second end of the elongated housing and the computing unit.

3. A tool assembly adapted for insertion into a well or other hole to direct monitoring of at least one condition existing in the well or other hole, the tool comprising:

an elongated housing with first and second ends, where the second end includes an opening sized to receive and provide access to one or more energy storage units insertable therein;

a computing unit positioned within the elongated housing and connectable to at least one sensor which is configured to provide a sensor reading of at least one monitored condition, the sensor reading comprising a sensor output signal including sensor reading data corresponding to the at least one monitored condition, the computing unit being configured to receive and process the sensor output signal;

a main circuit board positioned within the elongated housing, the main circuit board including at least one electrical contact positioned to contact one or more electrodes of the one or more energy storage units components upon insertion through the opening of the second end;

an electrical assembly including the at least one electrical contact and an electrical circuit configured to conduct electrical signals between the second end of the elongated housing and the computing unit; and a removable cable assembly which is connectable to the second end so as to enclose the elongated housing and further configured to electrically interconnect with said electrical assembly, the removable cable assembly including a cable component with a housing portion for engaging and disengaging the second end of the elongated housing and a cable which terminates in the cable component and includes at least one: a first plurality of electrical conductors for carrying data signals, a second plurality of electrical conductors for carrying power signals;

wherein the cable component is a vented cable, having a first fluid conductive path extending along the length of the cable such that when the elongated housing and cable assembly are connected and the at least one sensor is a pressure sensor, the pressure sensor is capable of taking pressure readings adjusted for atmospheric pressure.

4. A tool assembly adapted for insertion into a well or other hole to direct monitoring of at least one condition existing in the well or other hole, the tool comprising:

an elongated housing with first and second ends, where the second end includes an opening sized to receive and provide access to one or more energy storage units insertable therein;

a computing unit positioned within the elongated housing and connectable to at least one sensor which is configured to provide a sensor reading of at least one monitored condition, the sensor reading comprising a sensor output signal including sensor reading data corresponding to the at least one monitored condition, the computing unit being configured to receive and process the sensor output signal, wherein the computing unit is capable of directing the obtainment of sensor readings according to at least two different sampling schedules;

a main circuit board positioned within the elongated housing, the main circuit board including at least one electrical contact positioned to contact one or more electrodes of the one or more energy storage units components upon insertion through the opening of the second end;

an electrical assembly including the at least one electrical contact and an electrical circuit configured to conduct electrical signals between the second end of the elongated housing and the computing unit; and a removable cable assembly which is connectable to the second end so as to enclose the elongated housing and further configured to electrically interconnect with said electrical assembly the removable cable assembly including a cable component with a housing portion for engaging and disengaging the second end of the elongated housing and a cable which terminates in the cable component and includes at least one: a first plurality of electrical conductors for carrying data signals, a second plurality of electrical conductors for carrying power signals.

5. A tool assembly adapted for insertion into a well or other hole to direct monitoring of at least one condition existing in the well or other hole, the tool comprising:

an elongated housing with first and second ends, where the second end includes an opening sized to receive and provide access to one or more energy storage units insertable therein;

at least one sensor positioned within the first end which is configured to provide a sensor reading of at least one monitored condition, the sensor reading comprising a sensor output signal including sensor reading data corresponding to the at least one monitored condition;

a computing unit positioned within the elongated housing and in electrical connection with the at least one sensor, the computing unit being configured to receive and process the sensor output signal;

a main circuit board positioned within the elongated housing, the main circuit board including at least one electrical contact positioned to contact one or more electrodes of the one or more energy storage units components upon insertion through the opening of the second end;

an electrical assembly including the at least one electrical contact and an electrical circuit configured to conduct electrical signals between the second end of the elongated housing and the computing unit; and a removable cable assembly which is connectable to the second end so as to enclose the elongated housing and further configured to electrically interconnect with said electrical assembly, the removable cable assembly including a cable component with a housing portion for engaging and disengaging the second end of the elongated housing and a cable which terminates in the cable component and includes at least one: a first plurality of electrical conductors for carrying data signals, a second plurality of electrical conductors for carrying power signals;

wherein the cable component is a vented cable, having a first fluid conductive path extending along the length of the cable such that when the elongated housing and cable assembly are connected and the at least one sensor is a pressure sensor, the pressure sensor is capable of taking pressure readings adjusted for atmospheric pressure.

6. A tool assembly adapted for insertion into a well or other hole to direct monitoring of at least one condition existing in the well or other hole, the tool comprising:

an elongated housing with first and second ends, where the second end includes an opening sized to receive and provide access to one or more energy storage units insertable therein;

at least one sensor positioned within the first end which is configured to provide a sensor reading of at least one monitored condition, the sensor reading comprising a sensor output signal including sensor reading data corresponding to the at least one monitored condition;

a computing unit positioned within the elongated housing and in electrical connection with the at least one sensor, the computing unit being configured to receive and process the sensor output signal, wherein the computing unit is capable of directing the obtainment of sensor readings according to at least two different sampling schedules;

a main circuit board positioned within the elongated housing, the main circuit board including at least one electrical contact positioned to contact one or more electrodes of the one or more energy storage units components upon insertion through the opening of the second end;

an electrical assembly including the at least one electrical contact and an electrical circuit configured to conduct electrical signals between the second end of the elongated housing and the computing unit; and a removable cable assembly which is connectable to the second end so as to enclose the elongated housing and further configured to electrically interconnect with said electrical assembly, the removable cable assembly including a cable component with a housing portion for engaging and disengaging the second end of the elongated housing and a cable which terminates in the cable component and includes at least one: a first plurality of electrical conductors for carrying data signals, a second plurality of electrical conductors for camming power signals.

7. A tool assembly adapted for insertion into a well or other hole to direct monitoring of at least one condition existing in the well or other hole, the tool comprising:

an elongated housing with first and second ends, where the second end includes an opening;

a computing unit positioned within the elongated housing and connectable to at least one sensor which is configured to provide a sensor reading of at least one monitored condition, the sensor reading comprising a sensor output signal including sensor reading data corresponding to the at least one monitored condition, the computing unit being configured to receive and process the sensor output signal;

a main circuit board positioned within the elongated housing, the main circuit board including at least one electrical contact positioned to contact one or more components positionable within the second end of the elongated housing; and an electrical assembly including an electrical circuit configured to conduct electrical signals between the second end of the elongated housing and the computing unit;

wherein the one or more components comprise at least one of: the electrical assembly and one or more energy storage units.

8. A tool assembly adapted for insertion into a well or other hole to direct monitoring of at least one condition existing in the well or other hole, the tool comprising:

an elongated housing with first and second ends, where the second end includes an opening;

a computing unit positioned within the elongated housing and connectable to at least one sensor which is configured to provide a sensor reading of at least one monitored condition, the sensor reading comprising a sensor output signal including sensor reading data corresponding to the at least one monitored condition, the computing unit being configured to receive and process the sensor output signal;

a main circuit board positioned within the elongated housing, the main circuit board including at least one electrical contact positioned to contact one or more components positionable within the second end of the elongated housing; and an electrical assembly including an electrical circuit configured to conduct electrical signals between the second end of the elongated housing and the computing unit;

whereon the one or more components comprise at least one of: the electrical assembly and one or more energy storage units;

wherein the one or more energy storage units comprises at least two AA cells in series.

* * * * *

UNITED STATES PATENT AND TRADEMARK OFFICE

CERTIFICATE OF CORRECTION

PATENT NO. : 6,928,864 B1
DATED : August 16, 2005
INVENTOR(S) : Henry et al.

It is certified that error appears in the above-identified patent and that said Letters Patent is hereby corrected as shown below:

Column 42,
Line 9, after “or”, insert -- more --.

Column 43,
Line 35, after the first occurrence of “assembly”, insert -- , --.

Column 46,
Line 17, delete “whereon”, and insert therefor -- wherein --.

Signed and Sealed this

Twenty-fifth Day of October, 2005

JON W. DUDAS
*Director of the United States Patent and Trademark Office*